US008462072B2

(12) United States Patent
Andrenko et al.

(10) Patent No.: US 8,462,072 B2
(45) Date of Patent: Jun. 11, 2013

(54) ANTENNA DEVICE, PRINTED CIRCUIT BOARD INCLUDING ANTENNA DEVICE, AND WIRELESS COMMUNICATION DEVICE INCLUDING ANTENNA DEVICE

(75) Inventors: Andrey Andrenko, Kawasaki (JP); Takashi Yamagajo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 708 days.

(21) Appl. No.: 12/645,551

(22) Filed: Dec. 23, 2009

(65) Prior Publication Data

US 2010/0156745 A1 Jun. 24, 2010

(30) Foreign Application Priority Data

Dec. 24, 2008 (JP) ..... 2008-327040

(51) Int. Cl.
*H01Q 1/48* (2006.01)

(52) U.S. Cl.
USPC ..... 343/848; 343/700 MS; 343/702

(58) Field of Classification Search
USPC ..... 343/700 MS, 702, 846, 848
See application file for complete search history.

(56) References Cited

U.S. PATENT DOCUMENTS

| | | | | |
|---|---|---|---|---|
| 6,549,170 | B1 | 4/2003 | Kuo et al. | |
| 7,071,877 | B2 * | 7/2006 | Okado | 343/700 MS |
| 7,391,376 | B2 * | 6/2008 | Yeh et al. | 343/700 MS |
| 7,518,556 | B2 * | 4/2009 | Kurashima et al. | 343/700 MS |
| 7,629,930 | B2 | 12/2009 | Murch et al. | |
| 2007/0001911 | A1 | 1/2007 | Fujio et al. | |
| 2008/0143613 | A1 | 6/2008 | Iwai et al. | |
| 2009/0195459 | A1 * | 8/2009 | Chua | 343/700 MS |

FOREIGN PATENT DOCUMENTS

| | | | |
|---|---|---|---|
| GB | 2401994 | A | 11/2004 |
| JP | 2007-013643 | A | 1/2007 |
| JP | 2008-167421 | A | 7/2008 |

* cited by examiner

*Primary Examiner* — Tan Ho
(74) *Attorney, Agent, or Firm* — Fujitsu Patent Center

(57) ABSTRACT

An antenna device includes a substrate, a pair of antenna elements formed on a face of the substrate and which is arranged so as to be axisymmetrical with respect to a symmetrical axis, and a ground section formed on the face of the substrate on which the pair of antenna elements is formed and which is arranged proximal to the pair of antenna elements, wherein the ground section is arranged so as to be axisymmetrical with respect to the symmetrical axis, and the ground section includes a first pair of slit sections notched from an end section and extending in one direction of the symmetrical axis.

23 Claims, 38 Drawing Sheets

900
130A
930A
960A
5
5A
5a
5b
110
111
120
121
141
142
130
131
132
930
931
932
960
961
962
L
W
D
ℓ

ANTENNA DEVICE, PRINTED CIRCUIT BOARD INCLUDING ANTENNA DEVICE, AND WIRELESS COMMUNICATION DEVICE INCLUDING ANTENNA DEVICE

CROSS-REFERENCE TO RELATED APPLICATION

This application is based upon and claims the benefit of priority of the prior Japanese Patent Application No. 2008-327040, filed on Dec. 24, 2008, the entire contents of which are incorporated herein by reference.

FIELD

Embodiments of the present invention relate to an antenna device for performing diversity communication, a printed circuit board including the antenna device, and a wireless communication device including the antenna device.

BACKGROUND

A diversity antenna device that selectively uses an antenna element with excellent signal quality is used in a small wireless communication terminal such as a mobile phone.

However, with the miniaturization of mobile phones and other types of antenna devices in recent years, less and less space is afforded to antenna devices, making it difficult to improve the capabilities of antenna devices by reducing the mutual coupling and the correlation coefficient between diversity antenna elements.

Under such circumstances, various antenna devices have been proposed in order to improve the capabilities of antenna devices (for example, refer to U.S. Pat. No. 6,549,170, Japanese Patent Laid-Open No. 2007-13643, and Japanese Patent Laid-Open No. 2008-167421).

SUMMARY

According to an aspect of the embodiments discussed herein, an antenna device includes a substrate, a pair of antenna elements formed on a face of the substrate and which is arranged so as to be axisymmetrical with respect to a symmetrical axis, and a ground section formed on the face of the substrate on which the pair of antenna elements is formed and which is arranged proximal to the pair of antenna elements, wherein the ground section is arranged so as to be axisymmetrical with respect to the symmetrical axis, and the ground section includes a first pair of slit sections notched from an end section in one direction of the symmetrical axis.

It is to be understood that both the foregoing general description and the following detailed description are exemplary and explanatory and are not restrictive of the embodiments, as claimed.

BRIEF DESCRIPTION OF DRAWINGS

FIGS. 19A and 19B are diagrams illustrating an antenna device according to a fifth embodiment, wherein FIG. 19A is a diagram illustrating a front surface side of a printed circuit board and FIG. 19B is a diagram illustrating a rear surface side of the printed circuit board;

FIGS. 25A-B are diagrams illustrating an antenna device according to a sixth embodiment, wherein FIG. 25A is a diagram illustrating a front surface side of a printed circuit board and FIG. 25B is a diagram illustrating a rear surface side of the printed circuit board;

FIGS. 28A-B are diagrams illustrating an antenna device according to a seventh embodiment, wherein FIG. 28A is a diagram illustrating a front surface side of a printed circuit board and FIG. 28B is a diagram illustrating a rear surface side of the printed circuit board;

FIGS. 31A-B are diagrams illustrating an antenna device according to an eighth embodiment, wherein FIG. 31A is a diagram illustrating a front surface side of a printed circuit board and FIG. 31B is a diagram illustrating a rear surface of the printed circuit board;

FIGS. 32A-B are diagrams illustrating an antenna device for comparison, wherein FIG. 32A is a diagram illustrating a front surface side of a printed circuit board and FIG. 32B is a diagram illustrating a rear surface side of the printed circuit board;

FIGS. 38A-C are diagrams illustrating an antenna device according to a ninth embodiment, wherein FIG. 38A is a diagram illustrating a front surface side of a printed circuit board 5, FIG. 38B is a diagram illustrating a ground section formed between layers of the printed circuit board, and FIG. 38C is a diagram illustrating a ground section formed between different layers of the printed circuit board from those in FIG. 38B.

DESCRIPTION OF EMBODIMENTS

Figure 1:
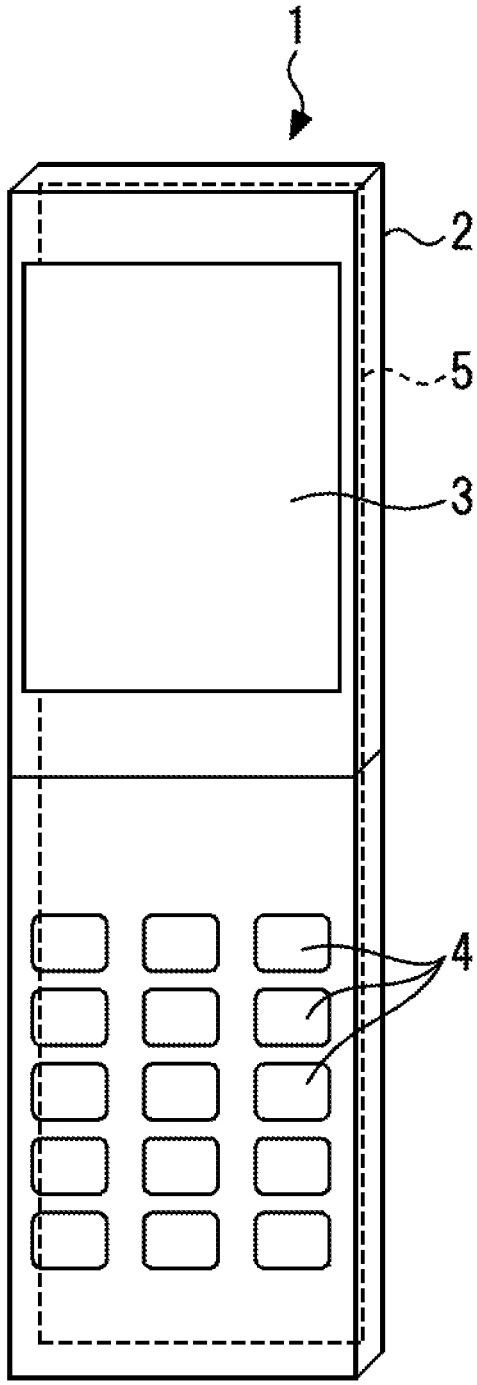
FIG. 1 is an oblique perspective view illustrating a mobile phone including an antenna device according to a first embodiment.

In the figures, dimensions and/or proportions may be exaggerated for clarity of illustration. It will also be understood that when an element is referred to as being "connected to" another element, it may be directly connected or indirectly connected, i.e., intervening elements may also be present. Further, it will be understood that when an element is referred to as being "between" two elements, it may be the only element layer between the two elements, or one or more intervening elements may also be present. Like reference numerals refer to like elements throughout.

FIG. 1 is an oblique perspective view illustrating a mobile phone including an antenna device according to a first embodiment. A display section 3 and an operating section 4 are provided on an outer surface of a chassis 2 of a mobile phone 1. A printed circuit board 5, indicated by a dashed line, is housed in the chassis 2.

The chassis 2 is a resin or metal chassis and includes an opening for installing the display section 3 and the operating section 4. For the display section 3, for example, a liquid crystal panel capable of displaying characters, numerals, images, and the like will suffice. Furthermore, the operating section 4 includes, in addition to a numerical keypad, various selection keys for selecting functions of the mobile phone 1. Moreover, the mobile phone 1 may include accessory devices such as a proximity communication device (an infrared communication device, a communication device for electronic money, or the like), a camera, and the like. While FIG. 1 illustrates the mobile phone 1 as an example of a wireless communication device including an antenna device according to the first embodiment, a wireless communication device including an antenna device according to the first embodiment may be a device other than a mobile phone.

Figure 2:
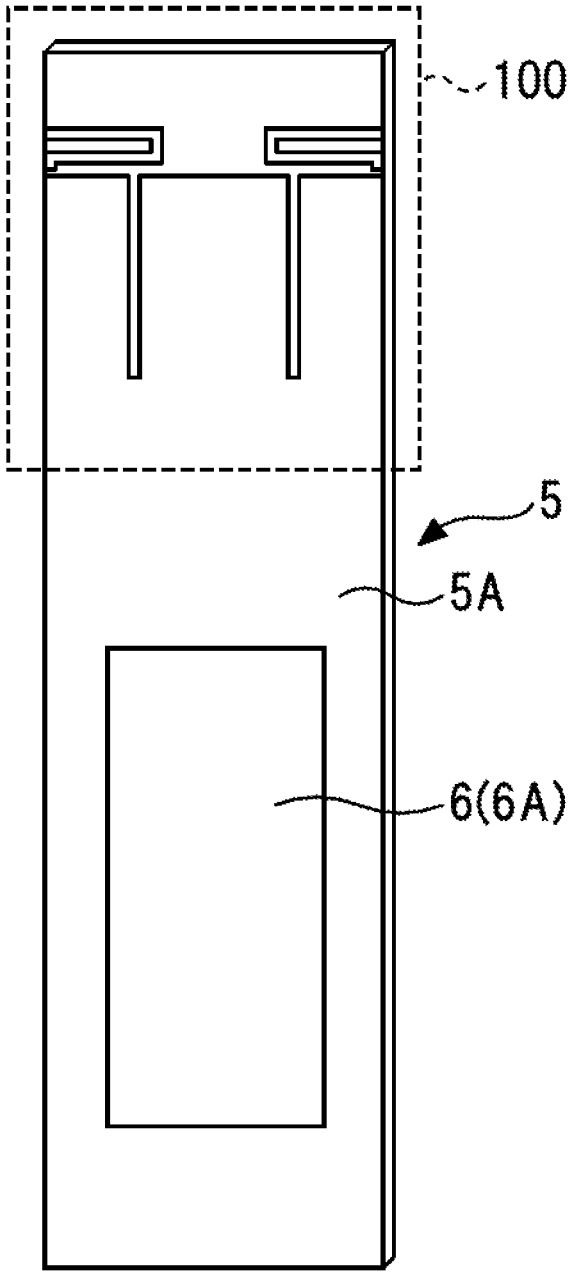
FIG. 2 is a perspective view illustrating a printed circuit board including an antenna device according to the first embodiment.

FIG. 2 is a perspective view illustrating the printed circuit board 5 including an antenna device according to the first embodiment.

The printed circuit board 5 is made of, for example, FR4 (glass-fabric base epoxy-resin substrate). Copper foil is formed on a front surface 5A of the printed circuit board 5. The copper foil on the front surface 5A of the printed circuit board 5 is patterned by, for example, an etching process using a resist. Formed on the copper foil is an area 6A in which a circuit section 6 is formed and an antenna device 100.

Metallic wiring for electrically connecting an IC (Integrated Circuit), a memory, and the like included in the circuit section 6 is patterned in the area 6A in which the circuit section 6 is formed. The IC, the memory, and the like included in the circuit section 6 are elements used to carry out communication involving speech, electronic mail, the Internet, and the like using the mobile phone 1.

The antenna device 100 is an antenna device constructed in the area indicated by the dashed line through patterning of the copper foil on the front surface 5A of the printed circuit board 5 and, as described above, is patterned together with the metallic wiring in the area 6A in which the circuit section 6 is formed. In other words, the copper foil that forms the antenna device 100 is a part (the part in the area indicated by the dashed line) of the copper foil formed over the entire front surface 5A of the printed circuit board 5, and is the same copper foil that forms the metallic wiring in the area 6A in which the circuit section 6 is formed.

In the first embodiment, an FR4 whose thickness is 0.9 mm and having a copper foil with a thickness of 15 μm and a permittivity $\in$=4.9 on the front surface 5A is used as the printed circuit board 5.

The FR4 used as the printed circuit board 5 is generally made by laminating a plurality of insulating layers and includes patterned copper foil between the respective insulating layers (interlayers), on the uppermost surface of the laminated structure, and on the bottommost surface of the laminated structure.

Therefore, a circuit used for carrying out communication involving speech, electronic mail, the Internet, and the like using the mobile phone 1 may alternatively be formed between layers or on the bottommost surface of the FR4.

In addition, the printed circuit board 5 may be a dielectric substrate other than FR4 as long as the circuit section 6 may be mounted and the antenna device 100 may be formed thereon.

Furthermore, besides copper (Cu), the metal to be formed on the printed circuit board 5 may be any metal (such as aluminum (Al)) as long as the metal has low power loss and high conductivity.

Next, a description will be given on the antenna device 100 to be formed on the front surface 5A of the printed circuit board 5 in the area indicated by the dashed line in FIG. 2.

Figure 3:
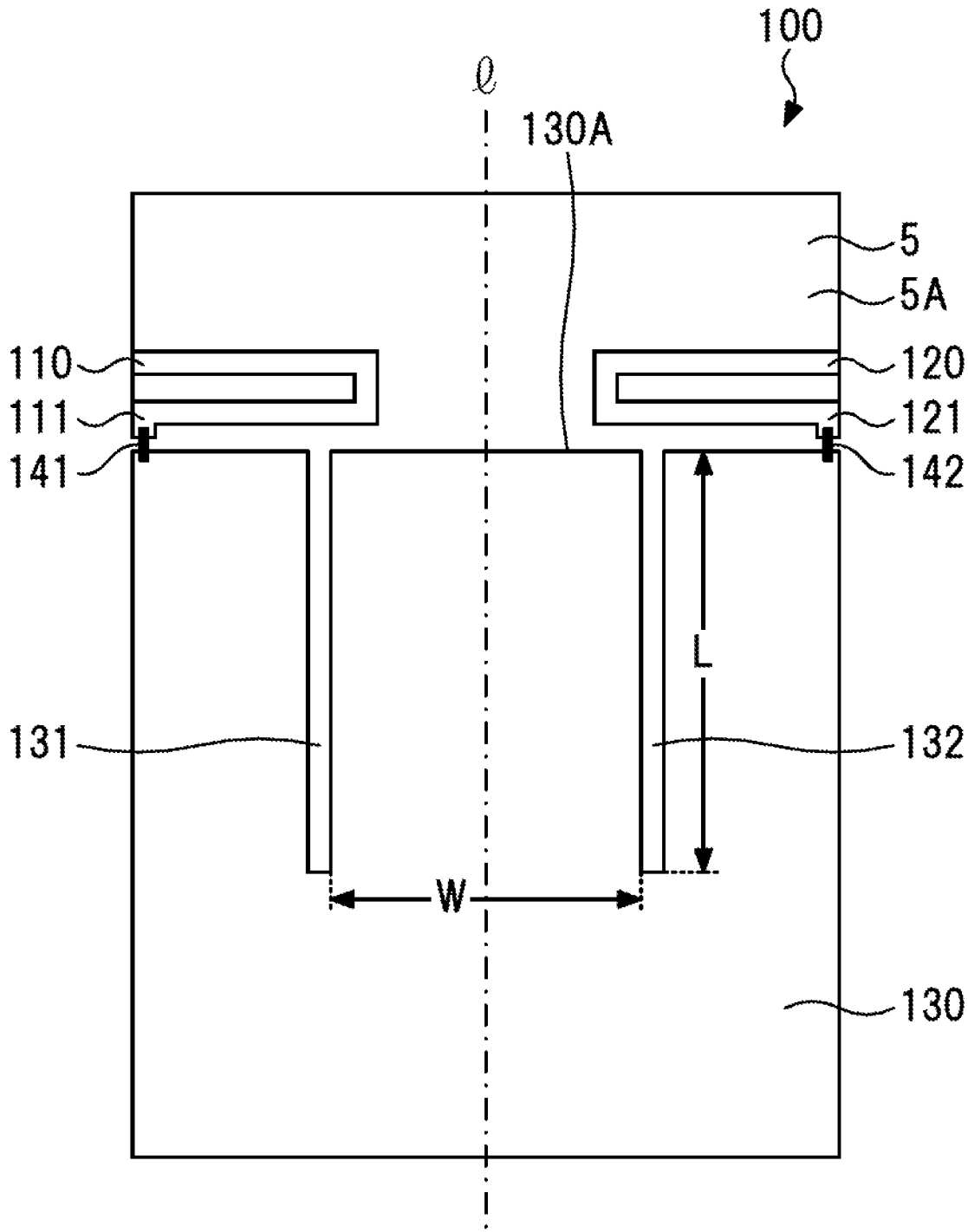
FIG. 3 is a diagram illustrating an antenna device according to the first embodiment.

FIG. 3 is a diagram illustrating the antenna device 100 according to the first embodiment.

The antenna device 100 includes antenna elements 110 and 120 and a ground section 130 formed on the front surface 5A of the printed circuit board 5.

The antenna elements 110 and 120 are a pair of antenna elements disposed on the front surface 5A of the printed circuit board 5 so as to be axisymmetrical with respect to a symmetrical axis I. The symmetrical axis I is an axis that is coincident with a central line in the longitudinal direction (upwards and downwards in the diagram) of the printed circuit board 5.

The antenna elements 110 and 120 respectively include feed sections 111 and 112. The antenna elements 110 and 120 are respectively patterned so as to stretch in a meander shape from the feed sections 111 and 112.

In addition, as seen in a plan view, the antenna elements 110 and 120 are patterned such that the meander shapes thereof are axisymmetrical with respect to the symmetrical axis I. The respective lengths of the antenna elements 110 and 120 are set by chip capacitors 141 and 142, to be described later, so as to be equivalent to approximately ¼ the length of a wavelength λ of a usable frequency (resonant frequency).

The antenna elements 110 and 120 have a length of approximately 21.5 mm and a width of approximately 1 mm. In the first embodiment, since a usable frequency of approximately 2.0 GHz is assumed, λ/4 may be calculated to be approximately 26 mm. Therefore, the lengths of the antenna elements 110 and 120 are shortened by the chip capacitors 141 and 142.

A core of a coaxial cable, not illustrated, with an impedance of 50 (Ω) is respectively connected to the feed sections 111 and 121 of the antenna elements 110 and 120, whereby power is supplied from an external circuit.

Moreover, while meander-shaped antenna elements 110 and 120 have been illustrated, the shapes of the antenna elements 110 and 120 are not limited to a meander shape and antenna elements with various shapes may be used instead.

The ground section 130 is a ground plane formed proximally to the antenna elements 110 and 120 on the front surface 5A of the printed circuit board 5. By connecting the ground section 130 to a ground line of a coaxial cable, not illustrated, with an impedance of 50 (Ω), the ground section 130 is kept at a ground potential.

The ground section 130 includes a pair of slit sections 131 and 132 notched, starting from an end section 130A near the antenna elements 110 and 120, so as to be parallel to and axisymmetrical with respect to the symmetrical axis I.

In this case, if λ denotes the wavelength of the usable frequency (resonant frequency), then lengths L of the slit sections 131 and 132 in the direction of the symmetrical axis I is to be set to approximately λ/4. In the first embodiment, since a usable frequency of approximately 2.0 GHz is assumed, the lengths L of the slit sections 131 and 132 are to be approximately 26 mm.

In addition, the distance W between the slit sections 131 and 132 is 12 mm and the width (slit width) of the slit sections 131 and 132 is approximately 1 mm.

Moreover, the width of the ground section 130 (the width perpendicular to the symmetrical axis I as seen in a plan view) is 50 mm.

The antenna elements 110 and 120 respectively collaborate with the ground section 130 to become monopole antennas. When power is supplied via the feed sections 111 and 121, the antenna elements 110 and 120 transmit or receive radio waves of a predetermined frequency. In other words, by selecting an antenna element (110 or 120) that is supplied with power from an external circuit depending on the communication state, the antenna device 100 illustrated in FIG. 3 functions as a diversity antenna having two monopole antennas.

The chip capacitors 141 and 142 are arranged between the antenna elements 110, 120 and the ground section 130 in order to adjust the usable frequency of the antenna elements 110 and 120. The use of the chip capacitors 141 and 142 enables the active lengths of the antenna elements 110 and 120 to be shortened as described above, in turn making it possible to downsize the antenna device 100. In addition, by adjusting the capacitances of the chip capacitors 141 and 142, the band of the usable frequency may be shifted to a low-band side or a high-band side. In the first embodiment, the capacities of the chip capacitors 141 and 142 are 1 pF.

Figure 4:
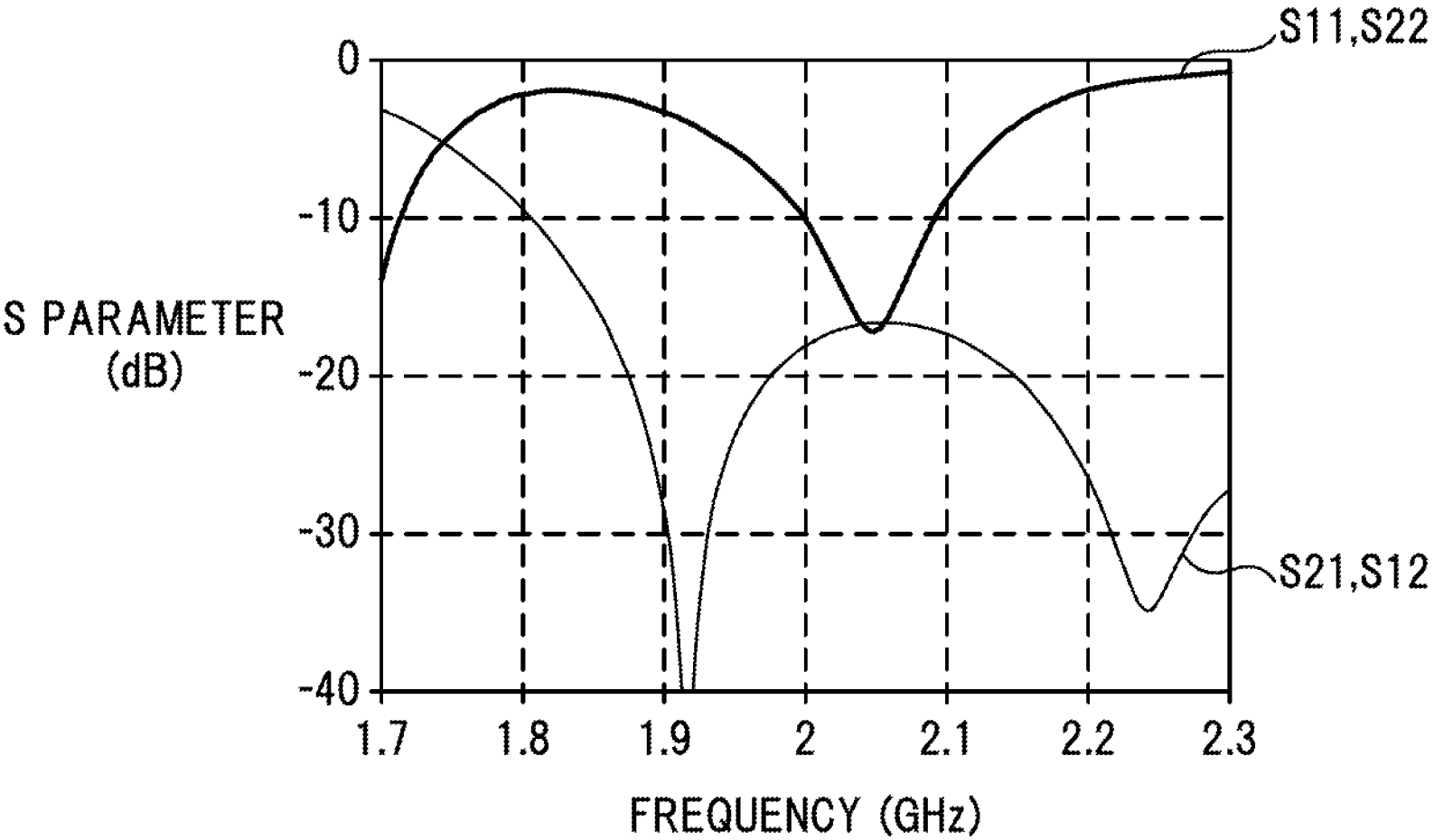
FIG. 4 is a diagram illustrating frequency characteristics of scattering parameters (S parameters) of the antenna device according to the first embodiment.

FIG. 4 is a diagram illustrating frequency characteristics of S parameters (scattering parameters) of the antenna device 100 according to the first embodiment.

When the two antenna elements 110 and 120 of the antenna device 100 are perceived as a two-terminal pair network, values of the S parameters (reference characters S11, S21, S12, and S22) exhibit the following characteristics.

Reference character S11 represents the intensity of a signal reflected to the antenna element 110 when a signal is inputted from the antenna element 110. The smaller the value of S11, the better the impedance matching with which the signal is radiated and the lower the return loss (reflectance loss) at the antenna element 110.

Reference character S21 represents the intensity of a signal passing through to the antenna element 120 when a signal is inputted from the antenna element 110. The smaller the value of S21, the lower the insertion loss from the antenna element 110 to the antenna element 120 and therefore the smaller the mutual coupling between the antenna elements 110 and 120.

Reference character S12 represents the intensity of a signal passing through to the antenna element 110 when a signal is inputted from the antenna element 120. The smaller the value of S12, the lower the insertion loss from the antenna element 120 to the antenna element 110 and therefore the smaller the mutual coupling between the antenna elements 120 and 110.

Reference character S22 represents the intensity of a signal reflected to the antenna element 120 when a signal is inputted from the antenna element 120. The smaller the value of S22, the better the impedance matching with which the signal is radiated and the lower the return loss (reflectance loss) at the antenna element 120.

With the antenna device 100, since the antenna elements 110 and 120 are axisymmetrical to each other and the ground section 130 is also axisymmetrical, S11=S22 and S21=S12 are true.

In addition, as for numerical values required as a diversity antenna, for example, generally S11, S12, S21, and S22 are each desirably substantially equals to or lower than −10 dB, and particularly, S21 and S12 are each desirably substantially equals to or lower than −20 dB.

As illustrated in FIG. 4, with the antenna device 100 according to the first embodiment, favorable values of −10 dB or lower were obtained for S11 and S22 in a frequency band ranging from approximately 2.0 GHz to approximately 2.1

GHz. In addition, for S21 and S12, favorable values of −10 dB or lower were obtained over a wide range from approximately 1.9 GHz to approximately 2.3 GHz. In particular, for S21 and S12, very favorable values of −20 dB or lower were obtained at a range from approximately 1.9 GHz to approximately 2.0 GHz and at a range from approximately 2.15 GHz to approximately 2.3 GHz.

Figure 5:
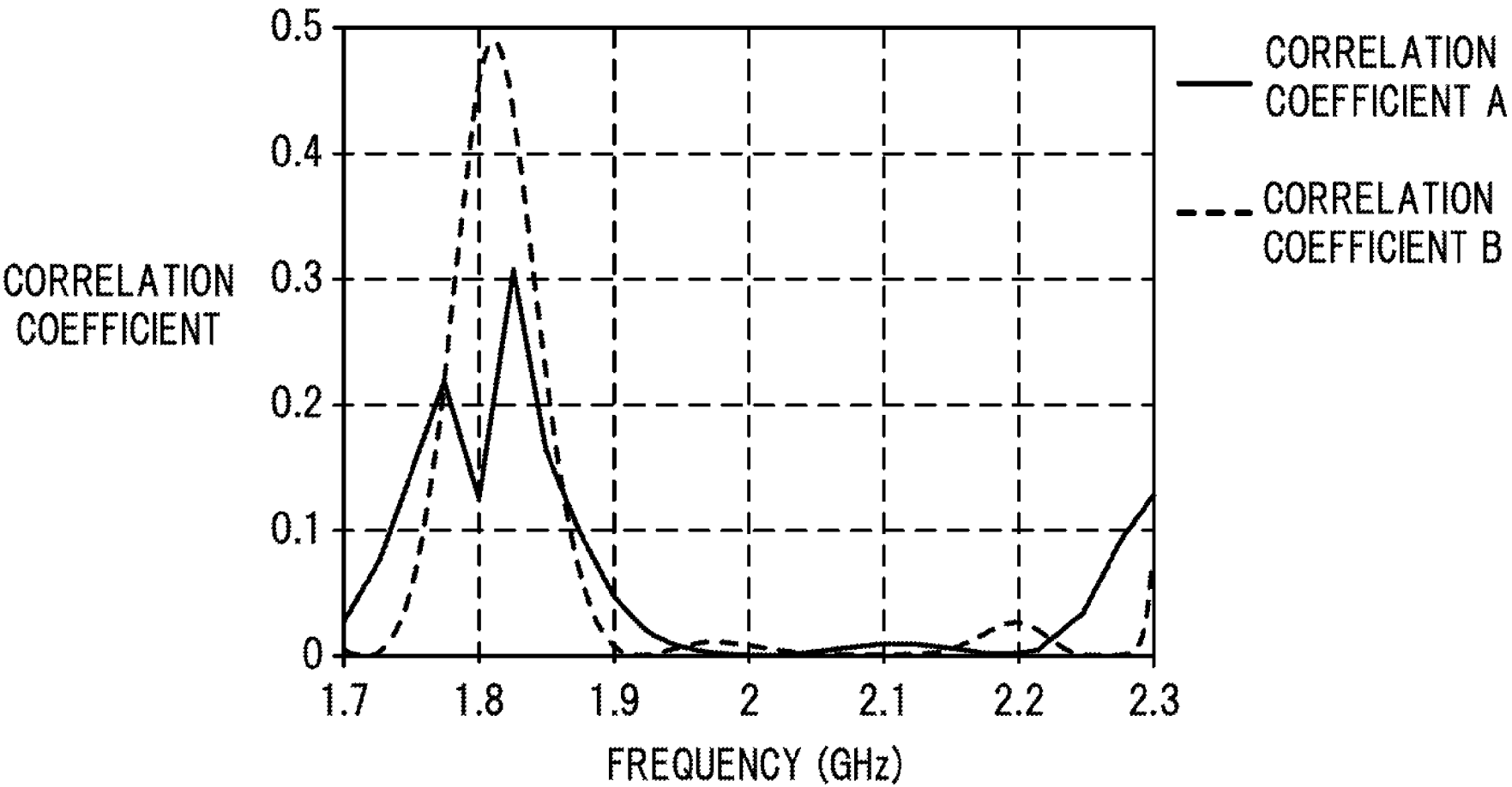
FIG. 5 is a diagram illustrating frequency characteristics of correlation coefficients of the antenna device according to the first embodiment.

FIG. 5 is a diagram illustrating frequency characteristics of correlation coefficients of the antenna device 100 according to the first embodiment.

In this case, two types of correlation coefficients A and B were calculated through simulation. The correlation coefficient A indicated by the solid line represents a degree of coincidence between the respective radiation patterns of the antenna elements 110 and 120. In addition, the correlation coefficient B indicated by the dashed line represents a correlation coefficient calculated based on the S parameters.

Generally, with a diversity antenna device, a correlation coefficient of 0.5 or lower is required.

With the antenna device 100 according to the first embodiment, results of 0.05 or lower were obtained for both correlation coefficients A and B across a wide range from approximately 1.9 GHz to approximately 2.5 GHz. This indicates that the correlation coefficients are 10 times lower as compared to a generally required level, the correlation between the antenna elements 110 and 120 is extremely low, and a favorable communication state may be achieved as a diversity antenna device.

An antenna device 100A for comparison will now be described with reference to FIGS. 6 to 8.

Figure 6:
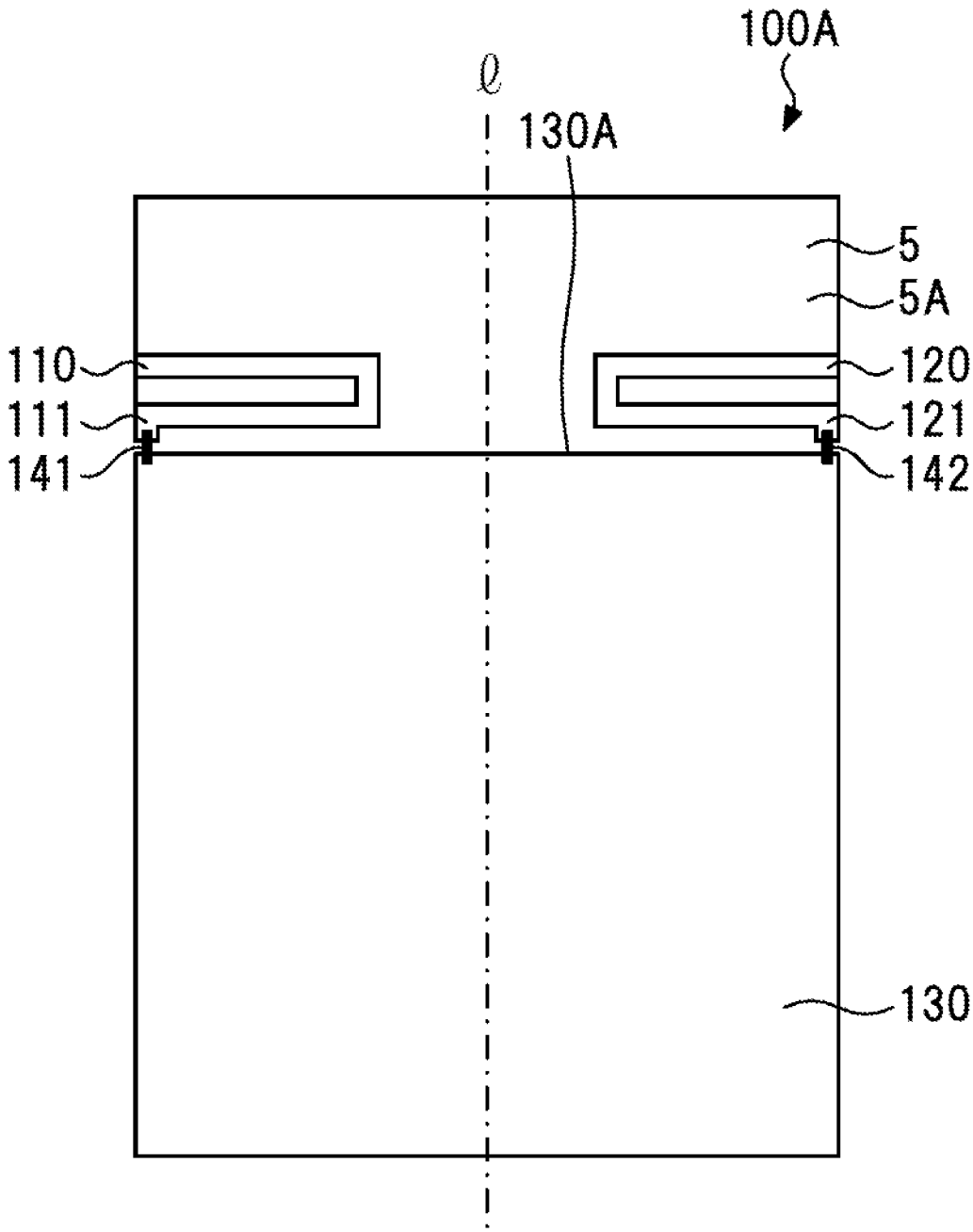
FIG. 6 is a diagram illustrating an antenna device for comparison.

FIG. 6 is a diagram illustrating the antenna device 100A for comparison.

The antenna device 100A differs from the antenna device 100 according to the present embodiment illustrated in FIG. 3 in that slit sections (refer to reference numerals 131 and 132 in FIG. 3) are not formed at the ground section 130. Otherwise, the configuration of the antenna device 100A is substantially the same as that of the antenna device 100 according to the first embodiment.

Figure 7:
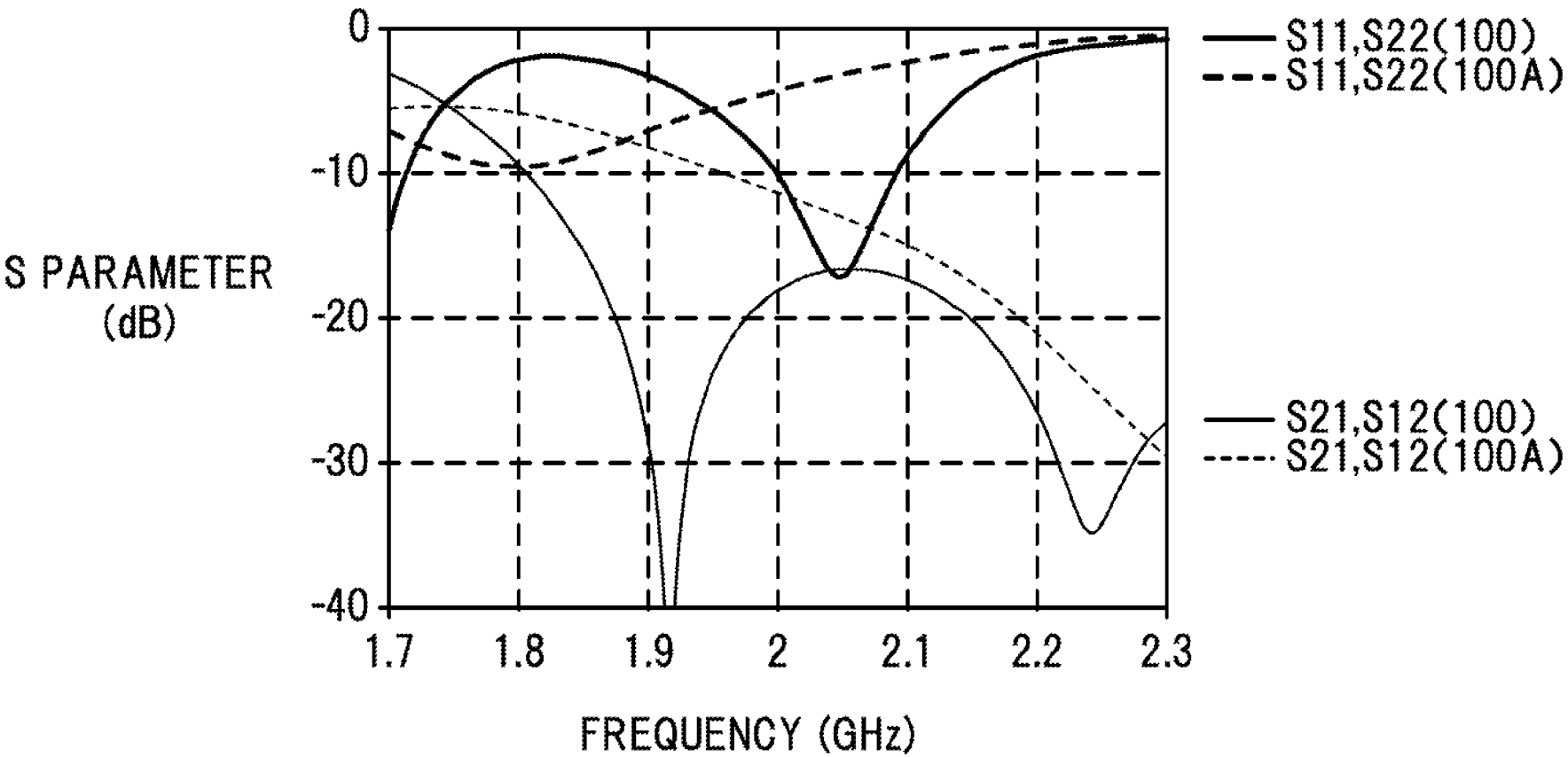
FIG. 7 is a diagram comparatively illustrating frequency characteristics of S parameters of the antenna device for comparison and frequency characteristics of S parameters of the antenna device according to the first embodiment.

FIG. 7 is a diagram comparatively illustrating frequency characteristics of S parameters of the antenna device 100A for comparison and frequency characteristics of S parameters of the antenna device 100 according to the first embodiment. The frequency characteristics of the S parameters of the antenna device 100 according to the first embodiment illustrated in FIG. 7 are the substantially same as the characteristics illustrated in FIG. 4.

For S11 and S22, the characteristics of the antenna device 100 according to the first embodiment are indicated by the solid line while the characteristics of the antenna device 100A for comparison are indicated by the dashed line.

Similarly, for S21 and S12, the characteristics of the antenna device 100 according to the first embodiment are indicated by the solid line while the characteristics of the antenna device 100A for comparison are indicated by the dashed line.

Although the usable frequency of the antenna device 100 according to the first embodiment is set to approximately 2.0 GHz in accordance with the lengths of the slit sections 131 and 132, the antenna device 100A not including the slit sections 131 and 132 has a different usable frequency that is set to approximately 1.8 GHz. Therefore, the minimum values of the S parameters of the antenna device 100A for comparison deviate from those of the antenna device 100 according to the first embodiment.

As illustrated in FIG. 7, at 1.8 GHz, S11 and S22 of the antenna device 100A for comparison are at a level barely falling short of −10 dB. In contrast, with the antenna device 100 according to the first embodiment, approximately −15 dB was obtained at 2.05 GHz. Accordingly, the usefulness of the slit sections 131 and 132 is substantiated.

Figure 8:
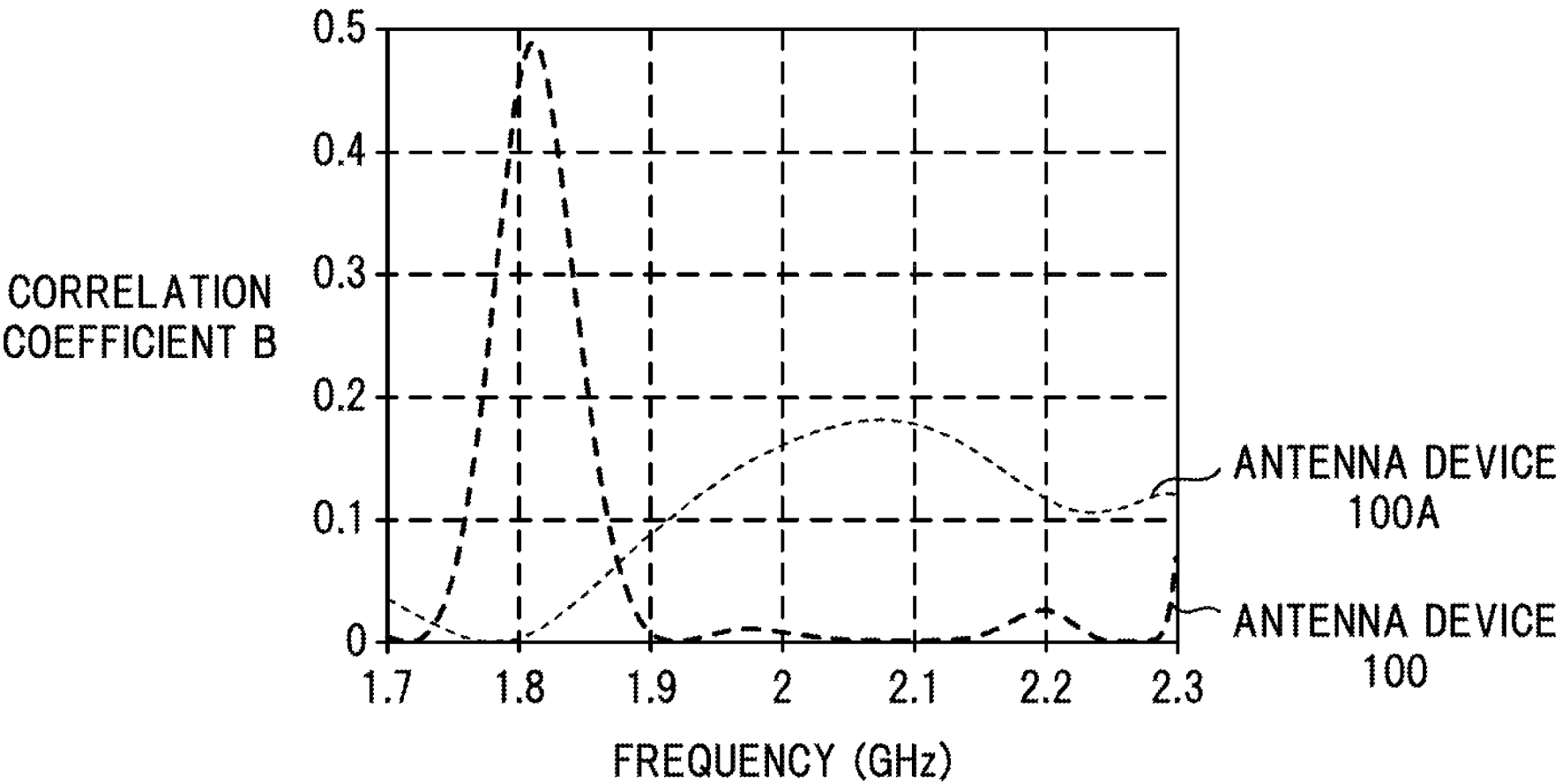
FIG. 8 is a diagram comparatively illustrating frequency characteristics of a correlation coefficient of the antenna device for comparison and frequency characteristics of the correlation coefficient of the antenna device according to the first embodiment.

FIG. 8 is a diagram comparatively illustrating frequency characteristics of a correlation coefficient B of the antenna device 100A for comparison and frequency characteristics of the correlation coefficient B of the antenna device 100 according to the first embodiment. The correlation coefficient B of the antenna device 100 is the same as the correlation coefficient B illustrated in FIG. 5.

While the correlation coefficient of the antenna device 100A for comparison took a value of approximately zero at 1.8 GHz, the correlation coefficient generally exhibited a high level including both below and above 1.8 GHz. This result is inferior compared to the antenna device 100 according to the first embodiment which exhibited results of approximately zero over a wide range from approximately 1.9 GHz to approximately 2.3 GHz. Accordingly, the usefulness of the slit sections 131 and 132 is substantiated for the correlation coefficient as well.

As described above, according to the first embodiment, as illustrated in FIGS. 4 and 5, a diversity antenna device 100 may be provided which features low return loss, favorable radiation characteristics, a low mutual coupling between the antenna elements 110 and 120, and an extremely low correlation between the antenna elements 110 and 120.

Moreover, the usable frequency of the antenna device 100 may be adjusted by varying the dimensions of the slit sections 131 and 132, the dimensions of the antenna elements 110 and 120, or the capacitances of the chip capacitors 141 and 142. Even when the usable frequency is changed, favorable characteristics such as those described above may be achieved by forming a pair of the slit sections 131 and 132 at the ground section 130 as described above.

In other words, by varying the dimensions of the slit sections 131 and 132, the dimensions of the antenna elements 110 and 120, or the capacitances of the chip capacitors 141 and 142, the frequency band may be adjusted so that favorable values may be obtained as described above.

Figure 9:
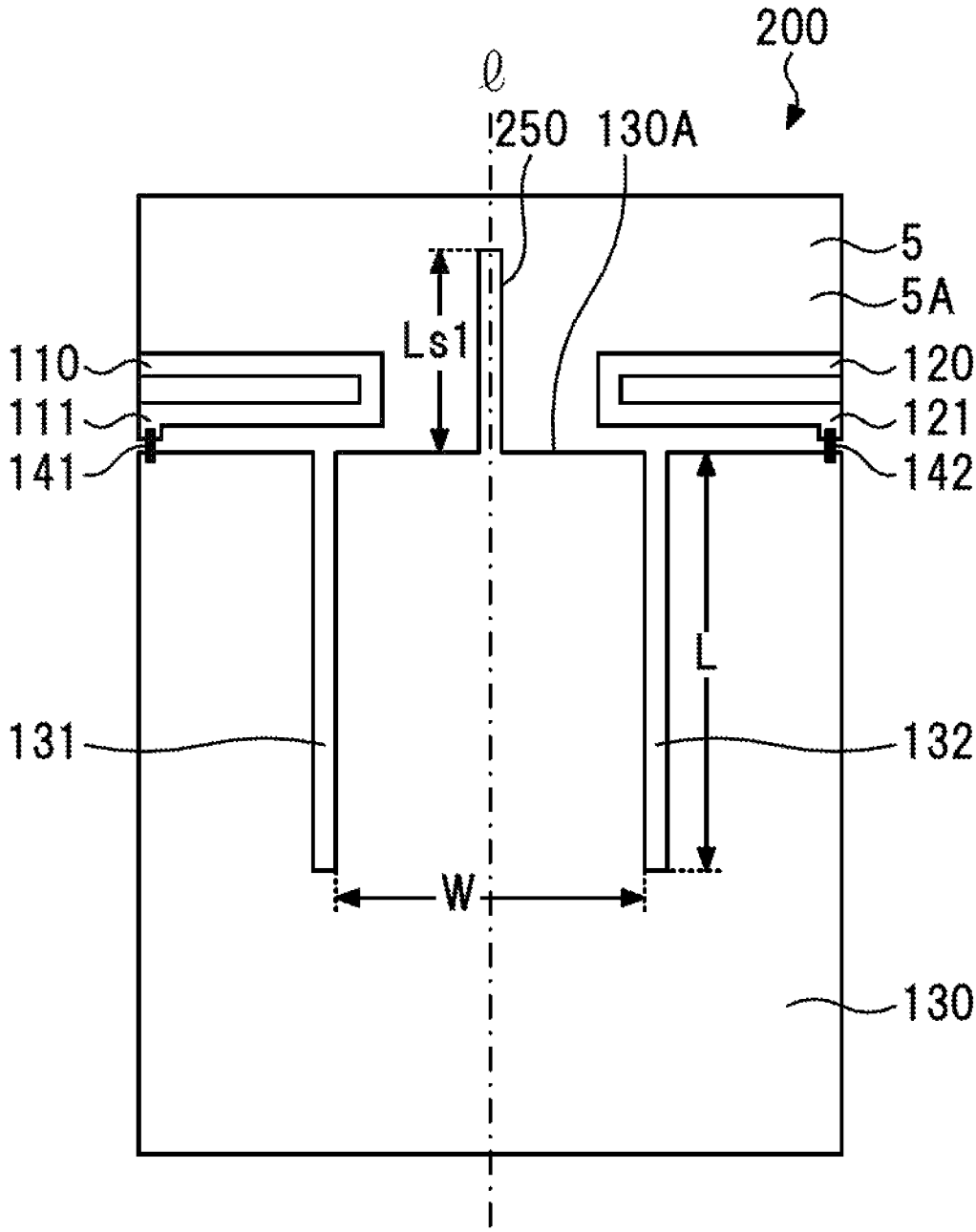
FIG. 9 is a diagram illustrating an antenna device according to a second embodiment.

FIG. 9 is a diagram illustrating an antenna device 200 according to a second embodiment.

The antenna device 200 according to the second embodiment differs from the antenna device 100 according to the first embodiment in that the antenna device 200 includes a stub section 250. Since the configuration of the antenna device 200 according to the second embodiment is otherwise substantially the same as that of the antenna device 100 according to the first embodiment with the exception of a portion of the dimensions or numerical values, like components will be denoted by like reference characters and descriptions thereof will be omitted. In addition, the differences in dimensions and the like will be described later.

The stub section 250 is a protruding section formed so as to extend over the symmetrical axis I from an end section 130A of the ground section 130 near the antenna elements 110 and 120. The stub section 250 is arranged so that a center line thereof is positioned above the symmetrical axis I (i.e., so as to be axisymmetrical with respect to the symmetrical axis I). The stub section 250 extends from the end section 130A by a length Ls1 of 14 mm and has a width of 1 mm.

In the second embodiment, the lengths of the slit sections 131 and 132 are set to 27 mm, the permittivity $\in$ of the printed circuit board 5 is set to 4.2, and the capacitances of the chip capacitors 141 and 142 are set to 1.5 pF. In addition, tangent delta is determined to be 0.01.

Furthermore, simulations were performed on three types of the antenna device 200 whose distances W between the slit sections 131 and 132 were 8 mm, 10 mm, and 12 mm, respectively.

Figure 10:
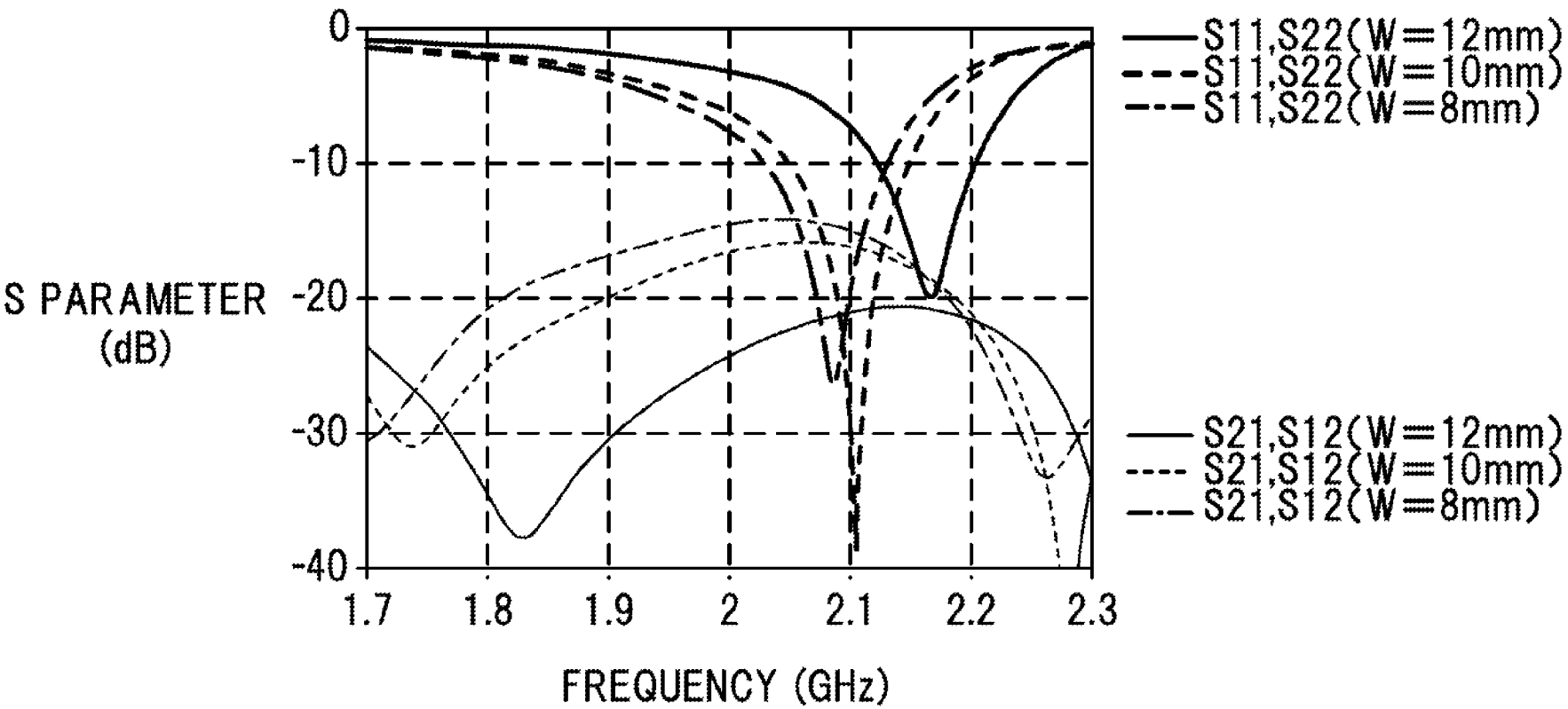
FIG. 10 is a diagram illustrating frequency characteristics of S parameters of the antenna device according to the second embodiment.

FIG. 10 is a diagram illustrating frequency characteristics of S parameters of the antenna device 200 according to the second embodiment.

For S11 and S22, characteristics in the case of W=12 mm are indicated by the solid line, characteristics in the case of W=10 mm are indicated by the dashed line, and characteristics in the case of W=8 mm are indicated by the dashed-dotted line.

Similarly, for S21 and S12, characteristics in the case of W=12 mm are indicated by the solid line, characteristics in the case of W=10 mm are indicated by the dashed line, and characteristics in the case of W=8 mm are indicated by the dashed-dotted line.

For S11 and S22, when W=12 mm, results of −10 dB or lower were obtained from approximately 2.1 GHz to approximately 2.2 GHz, and when W=8 mm and W=10 mm, results of −10 dB or lower were obtained from approximately 2.05 GHz to approximately 2.15 GHz. In regards to minimum values, slightly more favorable results were obtained when W=8 mm or W=10 mm as compared to W=12 mm.

In addition, for S21 and S12, results of −10 dB or lower were obtained from approximately 1.7 GHz to approximately 2.3 GHz for all of W=8 mm, 10 mm, and 12 mm. However, when focusing on, for example, 2.0 GHz, results of approximately −25 dB were obtained when W=12 mm while results of approximately −15 dB were obtained when W=8 mm and 10 mm. That is, more favorable values were obtained when W=12 mm as compared to W=8 mm or 10 mm.

Consequently, it is illustrated that varying the distance W between the slit sections 131 and 132 in this manner has a greater impact on S21 and S12 than on S11 and S22. In particular, with S21 and S12, since the value of W=12 mm is particularly superior as compared to W=8 mm or 10 mm in a range from approximately 1.8 GHz to approximately 2.2 GHz, it is found that a desirable distance W between the slit sections 131 and 132 is 12 mm.

This result describes that the shorter the distance W between the slit sections 131 and 132 (the smaller the value of S11 and S22), the easier matching is achieved between the antenna elements 110 and 120. On the other hand, it is found that the greater the distance W (because the values of S21 and S12 are small), the lower the mutual coupling between the antenna elements 110 and 120, and that a tradeoff relationship exists between the matching and the mutual coupling of the antenna elements 110 and 120.

Moreover, from a comparison of the antenna device 200 whose distance W between the slit sections 131 and 132 is the same 12 mm as the first embodiment and the antenna device 100 according to the first embodiment, more favorable S parameter characteristics were obtained for the antenna device 200 according to the second embodiment which includes the stub section 250. Accordingly, it is found that the stub section 250 is beneficial for the improvement of the S parameters.

In addition, while the frequency characteristics of the correlation coefficients of the antenna device 200 according to the second embodiment will be omitted, characteristics at approximately the same level as the antenna device 100 according to the first embodiment were obtained.

Figure 11:
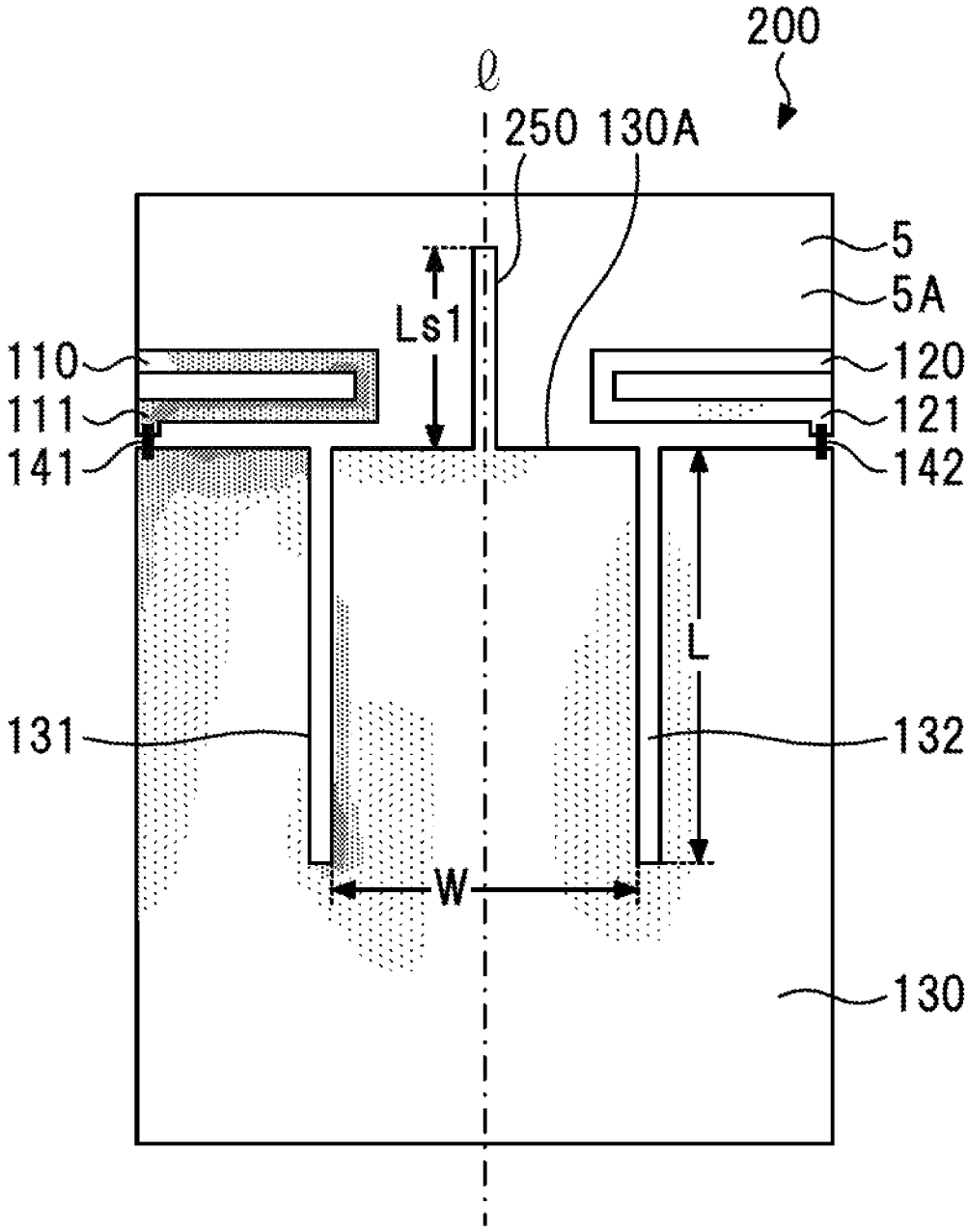
FIG. 11 is a diagram illustrating the result of a current density simulation performed on the antenna device according to the second embodiment.

FIG. 11 is a diagram illustrating the result of a current density simulation performed on the antenna device 200 according to the second embodiment. The simulation result represents a state where power is supplied to the feed section 111 but not to the feed section 121. In other words, FIG. 11 illustrates current density in a state where communication is performed with the diversity antenna device 200 using the antenna element 110.

Current density is represented by the density of dots. That is, it is illustrated that places where dot density is higher have higher current density and, conversely, places where dot density is lower have lower current density.

As illustrated in FIG. 11, current density is high at the antenna element 110 and at a position of the ground section 130 which is near the feed section 111. In addition, it is illustrated that current density is high around the slit section 131 and low around the right-side slit section 132.

Accordingly, it is found that current may be efficiently collected around one of the antenna elements 110 and one of the slit sections 131 and that a state is entered in which communication may be efficiently performed with the antenna element 110. In other words, it is found that the mutual coupling between the antenna elements 110 and 120 is reduced and the correlation coefficients have also decreased.

As described above, according to the second embodiment, by including a stub section 250 that stretches over the symmetrical axis from the end section 130A of the ground section 130, a diversity antenna device 200 may be provided which features low return loss, favorable radiation characteristics, a low mutual coupling between the antenna elements 110 and 120, and an extremely low correlation between the antenna elements 110 and 120.

Figure 12:
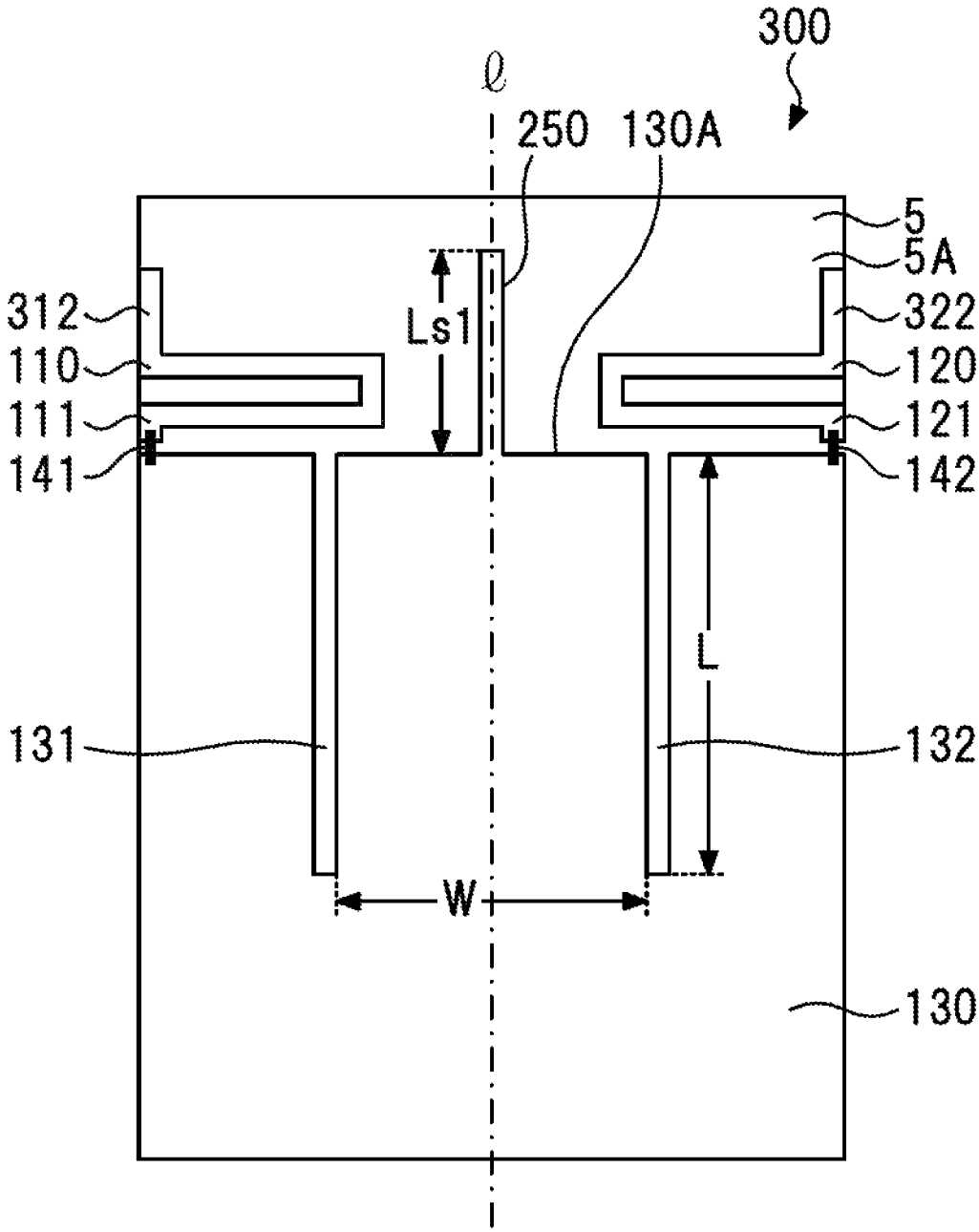
FIG. 12 is a diagram illustrating an antenna device according to a third embodiment.

FIG. 12 is a diagram illustrating an antenna device 300 according to a third embodiment.

The antenna device 300 according to the third embodiment differs from the antenna device 200 according to the second embodiment in that the antenna device 300 includes stretched sections 312 and 322 at the tips of the antenna elements 110 and 120. Since the configuration of the antenna device 300 according to the third embodiment is otherwise substantially the same as that of the antenna device 200 according to the second embodiment with the exception of a portion of the dimensions or numerical values, like components will be denoted by like reference characters and descriptions thereof will be omitted. In addition, the differences in dimensions and the like will be described later.

The antenna device 300 according to the third embodiment is an antenna device adjusted so that a usable frequency thereof takes a value of approximately 2.0 GHz.

The lengths of the slit sections 131 and 132 are set to 27 mm, the permittivity $\in$ of the printed circuit board 5 is set to 4.2, and tangent delta is set to 0.01, which are the same values as in the antenna device 200 according to the second embodiment.

In addition, the distance W between the slit sections 131 and 132 is set to 10 mm. Simulations were performed on two types of the antenna device 300 whose chip capacitors 141 and 142 have capacitances of 1 pF and 1.5 pF.

As described above, the antenna device 300 according to the third embodiment includes the stretched sections 312 and 322. The stretched sections 312 and 322 are respectively arranged on the tips of the antenna elements 110 and 120 (the tips that are opposite to the end sections at which the feed sections 111 and 112 proximal to the ground section 130 are located) so as to extend the respective active lengths of the antenna elements 110 and 120.

Figure 13:
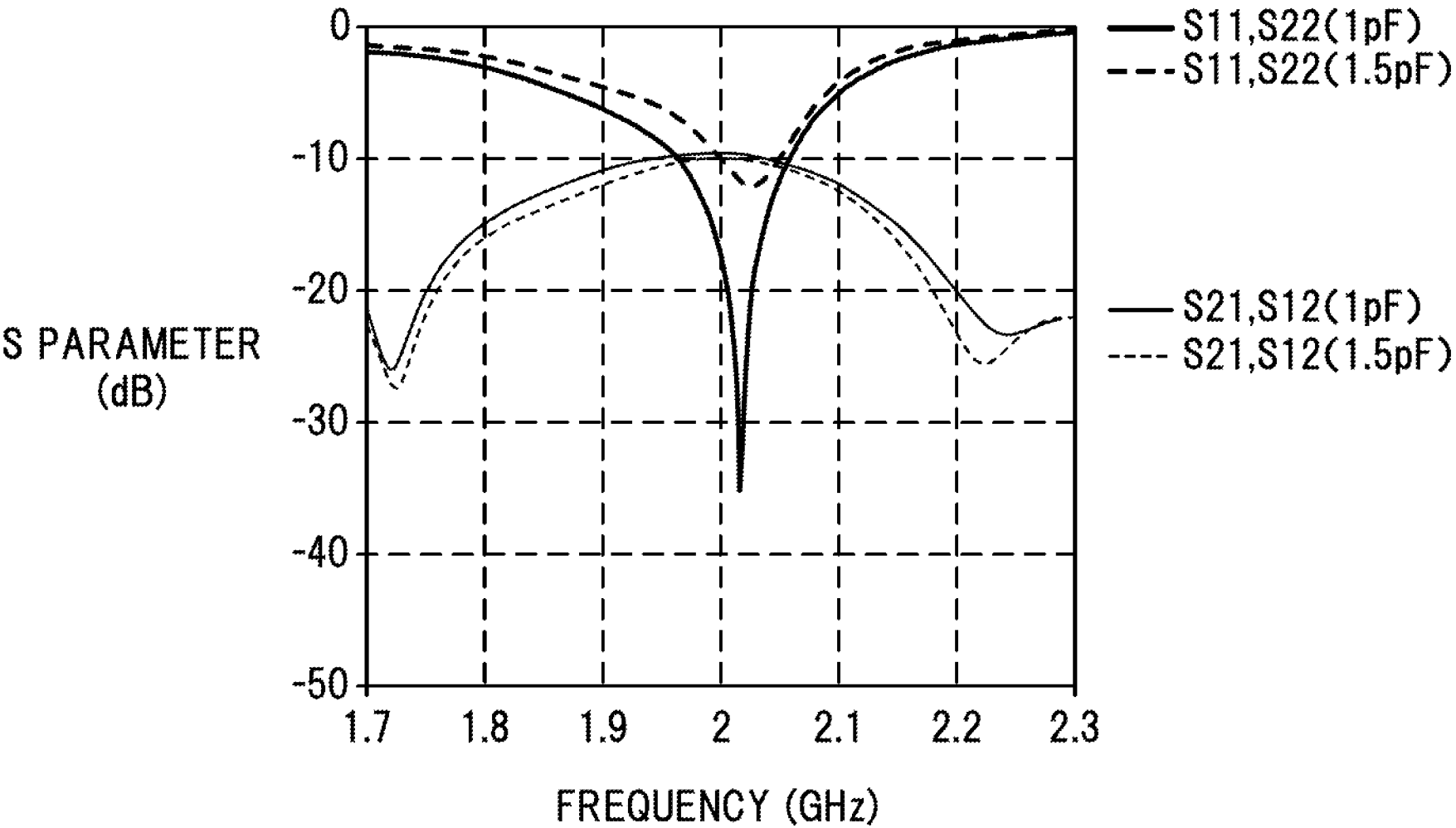
FIG. 13 is a diagram illustrating frequency characteristics of S parameters of the antenna device according to the third embodiment.

FIG. 13 is a diagram illustrating frequency characteristics of S parameters of the antenna device 300 according to the third embodiment.

For S11 and S22, characteristics in the case where the capacitances of the chip capacitors 141 and 142 are 1 pF are indicated by the solid line while characteristics in the case where the capacitances are 1.5 pF are indicated by the dashed line.

Similarly, for S21 and S12, characteristics in the case where the capacitances of the chip capacitors 141 and 142 are 1 pF are indicated by the solid line while characteristics in the case where the capacitances are 1.5 pF are indicated by the dashed line.

For S11 and S22, favorable values of −10 dB or lower were obtained for both antenna devices 300 of 1 pF and 1.5 pF at frequency bands of around approximately 2 GHz. In particular, with the antenna device 300 of 1 pF, characteristics were obtained which exhibited a sharp drop at approximately 2 GHz.

Focusing on approximately 2.0 GHz, when the capacitances of the chip capacitors 141 and 142 are 1 pF, desirable values of approximately −22 dB to 23 dB or lower were obtained for S11 and S22. In contrast, when the capacitances of the chip capacitors 141 and 142 are 1.5 pF, values of approximately −12 dB to 13 dB were obtained for S11 and S22.

Therefore, when constructing the antenna device 300 with a usable frequency band of 2 GHz, it is found that return loss (reflectance loss) is lower and signals may be radiated more efficiently by setting the capacitances of the chip capacitors 141 and 142 to 1 pF.

On the other hand, for S21 and S12, favorable results of −10 dB or lower were obtained from 1.7 GHz to 2.3 GHz for both cases where capacitances of the chip capacitors 141 and 142 were set to 1 pF and 1.5 pF.

While the antenna device 300 of 1.5 pF exhibited a slightly more favorable value, the difference was minimal and approximately the same value was obtained for the antenna device 300 of 1 pF.

Accordingly, it is found that the impact of an insertion loss on the capacitances of the chip capacitors 141 and 142 is relatively small.

Figure 14:
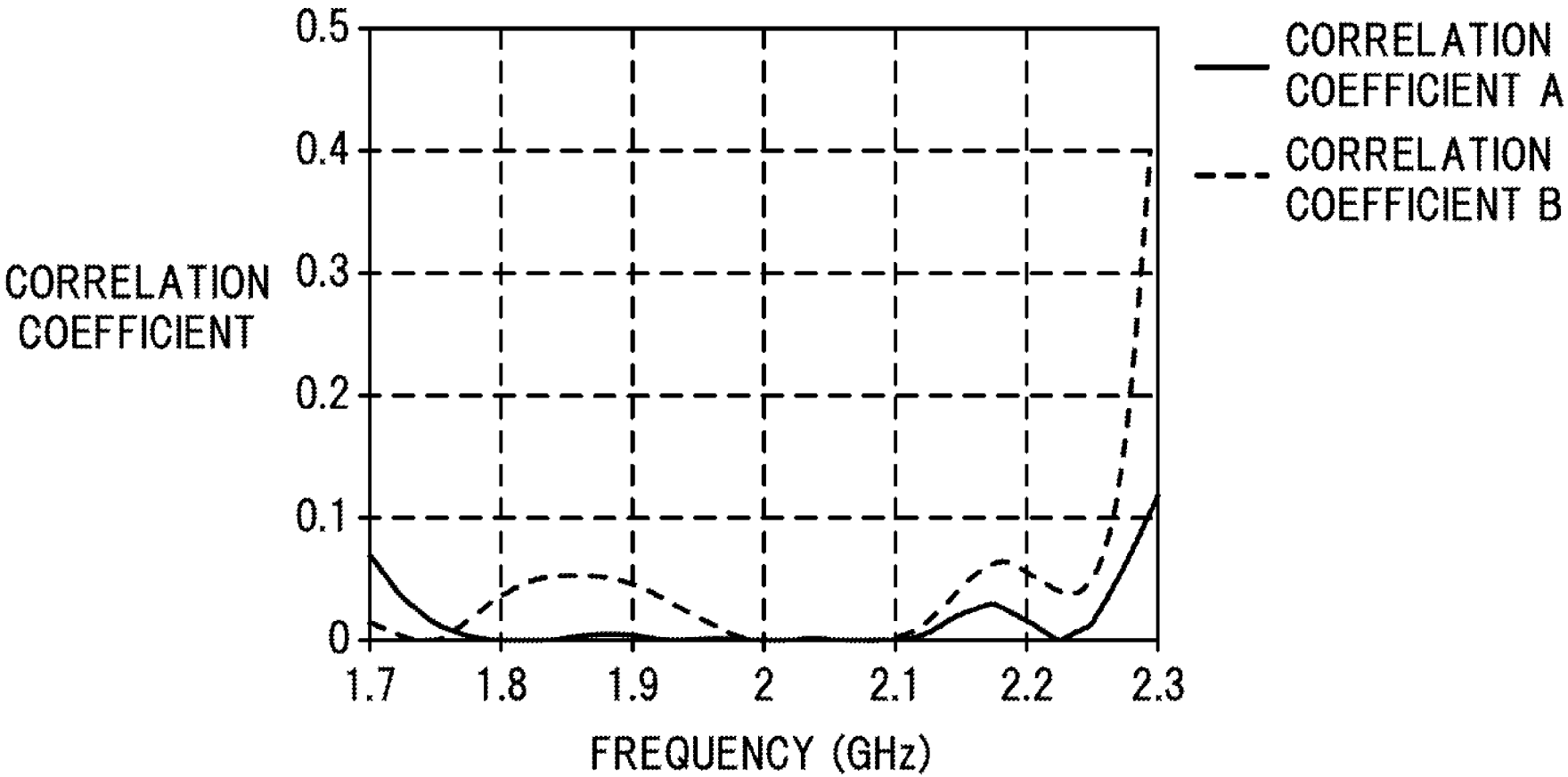
FIG. 14 is a diagram illustrating frequency characteristics of correlation coefficients of the antenna device according to the third embodiment.

FIG. 14 is a diagram illustrating frequency characteristics of correlation coefficients of the antenna device 300 according to the third embodiment.

In this case, two types of correlation coefficients A and B were calculated through simulation. The correlation coefficient A indicated by the solid line represents a degree of coincidence between the respective radiation patterns of the antenna elements 110 and 120. In addition, the correlation coefficient B indicated by the dashed line represents a correlation coefficient calculated based on the S parameters.

With the antenna device 300 according to the third embodiment, results of approximately 0.05 or lower were obtained for both correlation coefficients A and B across a wide range from approximately 1.7 GHz to approximately 2.3 GHz. In particular, an very favorable result of approximately zero was obtained around 2 GHz which had been set as the usable frequency.

This indicates that the correlation between the antenna elements 110 and 120 is negligible (extremely close to zero) and that an very favorable communication state as a diversity antenna device may be achieved.

As described above, according to the third embodiment, a diversity antenna device 300 may be provided which features low return loss, favorable radiation characteristics, an extremely low mutual coupling between the antenna elements 110 and 120, and a negligible correlation between the antenna elements 110 and 120.

Moreover, a calculation of the efficiency of the antenna device 300 according to the third embodiment resulted in a value of 85%.

Figure 15:
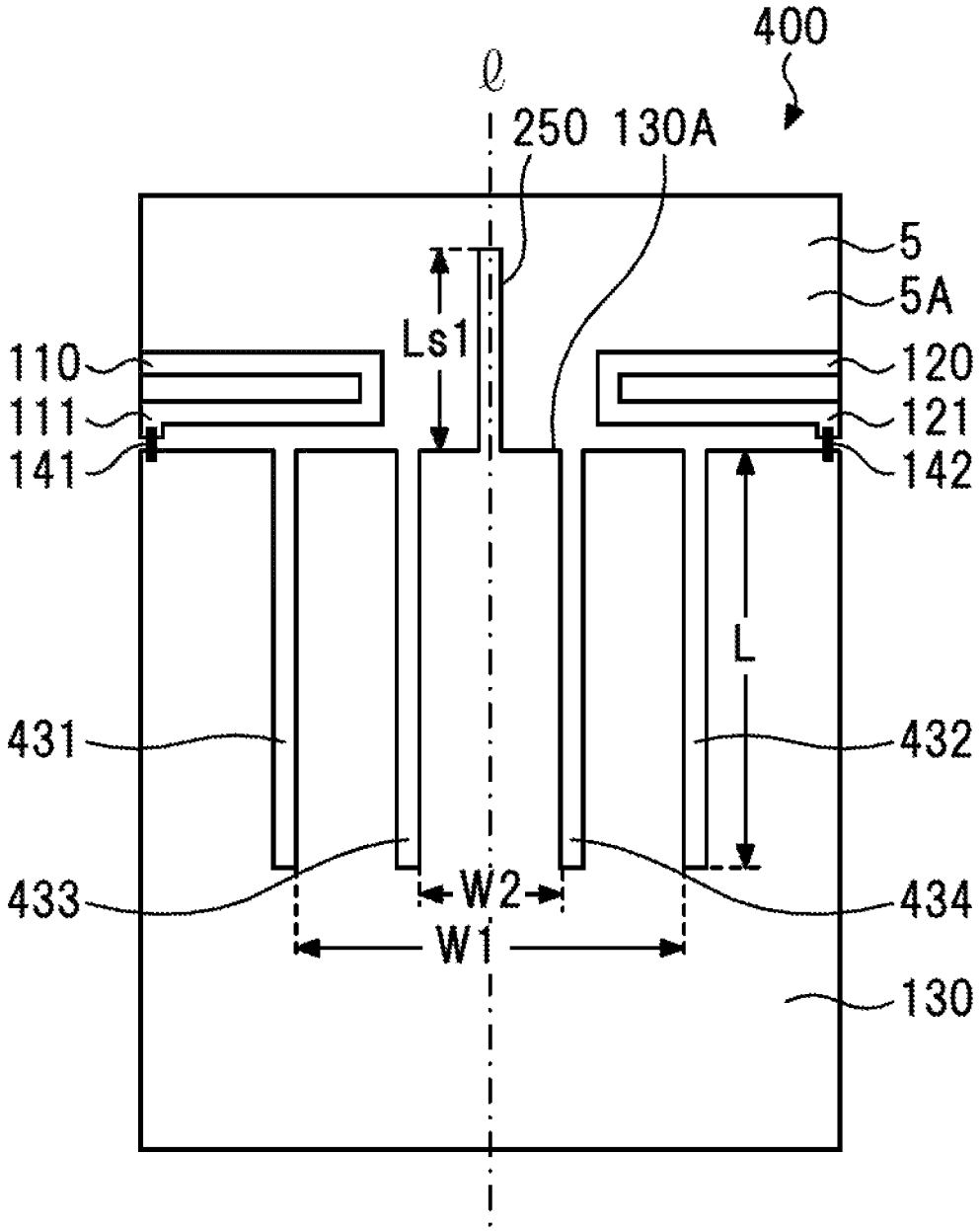
FIG. 15 is a diagram illustrating an antenna device according to a fourth embodiment.

FIG. 15 is a diagram illustrating an antenna device 400 according to a fourth embodiment.

The antenna device 400 according to the fourth embodiment differs from the antenna device 200 according to the second embodiment in that four slit sections are formed on the ground section 130. Since the configuration of the antenna device 400 according to the fourth embodiment is otherwise substantially the same as that of the antenna device 200 according to the second embodiment, like components will be denoted by like reference characters and descriptions thereof will be omitted.

Four slit sections 431, 432, 433, and 434 are formed on the ground section 130 of the antenna device 400 according to the fourth embodiment. As seen in a plan view, the slit sections 431 and 433 are arranged to the left of the symmetrical axis I while the slit sections 432 and 434 are arranged to the right of the symmetrical axis I.

The slit sections 431 and 432 are arranged so as to be axisymmetrical with respect to the symmetrical axis I and slit sections 433 and 434 are arranged so as to be axisymmetrical with respect to the symmetrical axis I.

Simulations were performed on three types of the antenna device 400 whose distances W1 between the slit sections 431 and 432 were 12 mm, 16 mm, and 20 mm. A distance W2 between the slit sections 433 and 434 was fixed at 6 mm.

In addition, separate simulations were performed on three types of the antenna device 400 whose distances W2 between the slit sections 433 and 434 were 6 mm, 10 mm, and 14 mm and whose distances W1 between the slit sections 431 and 432 were fixed at 20 mm.

Moreover, the lengths L of the slit sections 431 to 434 in the direction of the symmetrical axis I are all 27 mm and the widths thereof are all 1 mm.

In addition, the permittivity ∈ of the printed circuit board 5 is set to 4.2, the capacitances of the chip capacitors 141 and 142 are set to 1.5 pF, and tangent delta is set to 0.01.

Figure 16:
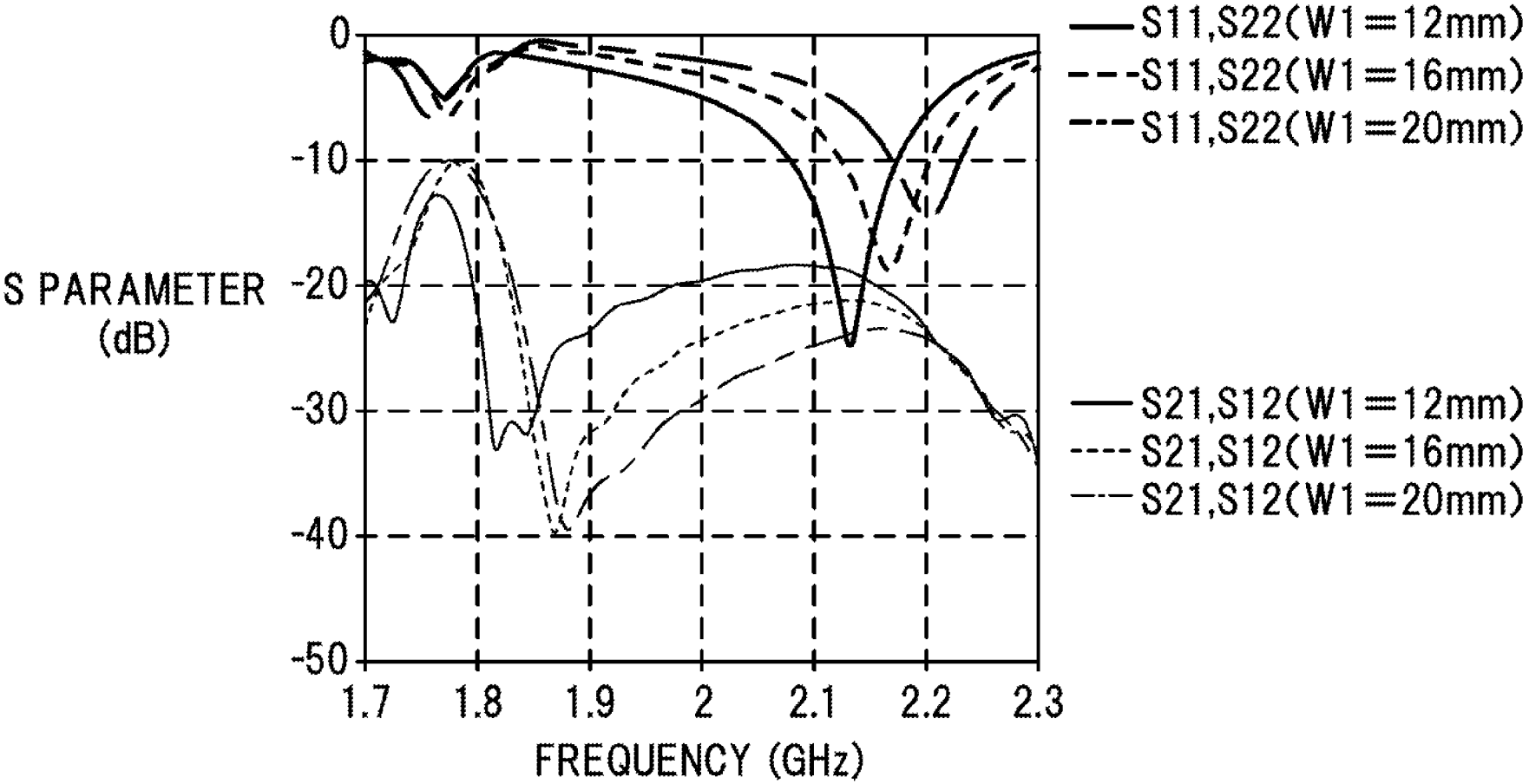
FIG. 16 is a diagram illustrating frequency characteristics of S parameters of the antenna device according to the fourth embodiment.

FIG. 16 is a diagram illustrating frequency characteristics of S parameters of the antenna device 400 according to the fourth embodiment. The diagram illustrates the results of a simulation of S parameters performed on the antenna device 400 for which the distance W2 between the slit sections 433 and 434 was fixed at 6 mm and the distance W1 between the slit sections 431 and 432 was varied among the three types of 12 mm, 16 mm, and 20 mm.

For S11 and S22, characteristics in the case of W1=12 mm are indicated by the solid line, characteristics in the case of W1=16 mm are indicated by the dashed line, and characteristics in the case of W1=20 mm are indicated by the dashed-dotted line.

Similarly, for S21 and S12, characteristics in the case of W1=12 mm are indicated by the solid line, characteristics in the case of W1=16 mm are indicated by the dashed line, and characteristics in the case of W1=20 mm are indicated by the dashed-dotted line.

For S11 and S22, favorable characteristics of −10 dB or lower were obtained from approximately 2.1 GHz to approximately 2.15 GHz for all of W1=12 mm, 16 mm, and 20 mm. However, the value was lowest at W1=12 mm and increased in the order of W1=16 mm and 20 mm. In addition, frequency bands at which a minimum value was obtained shifted towards a high band-side in the order of W1=12 mm, 16 mm, and 20 mm.

On the other hand, for S21 and S12, favorable characteristics of −20 dB or lower were obtained from approximately 1.85 GHz to approximately 2.3 GHz for all of W1=12 mm, 16 mm, and 20 mm. However, the value was lowest at W1=20 mm and increased in the order of W1=16 mm and 12 mm. In addition, frequency bands at which a minimum value was obtained exhibited substantially the same trend as S11 and S22 and shifted towards a high band-side in the order of W1=12 mm, 16 mm, and 20 mm.

Accordingly, it is illustrated that varying the distance W1 between the slit sections 431 and 432 in this manner has an impact on both S11 and S22 and on S21 and S12.

Since favorable values of approximately −20 dB or lower were obtained for S21 and S12 from approximately 1.8 GHz to approximately 2.3 GHz for all of W1=12 mm, 16 mm, and 20 mm, it is found that W1=12 mm is desirable when prioritizing the scarcity of return loss obtained from S11 and S22.

This is substantially the same trend as observed when varying the distance W between the slit sections 131 and 132 in the second embodiment, and the shorter the distance W1 between the slit sections 431 and 432 (the smaller the values of S11 and S22), the easier the matching is achieved between the antenna elements 110 and 120. On the other hand, it is found that the greater the distance W1 (because the values of S21 and S12 are small), the lower the mutual coupling between the antenna elements 110 and 120, and that a tradeoff relationship exists between the matching and the mutual coupling of the antenna elements 110 and 120.

Figure 17:
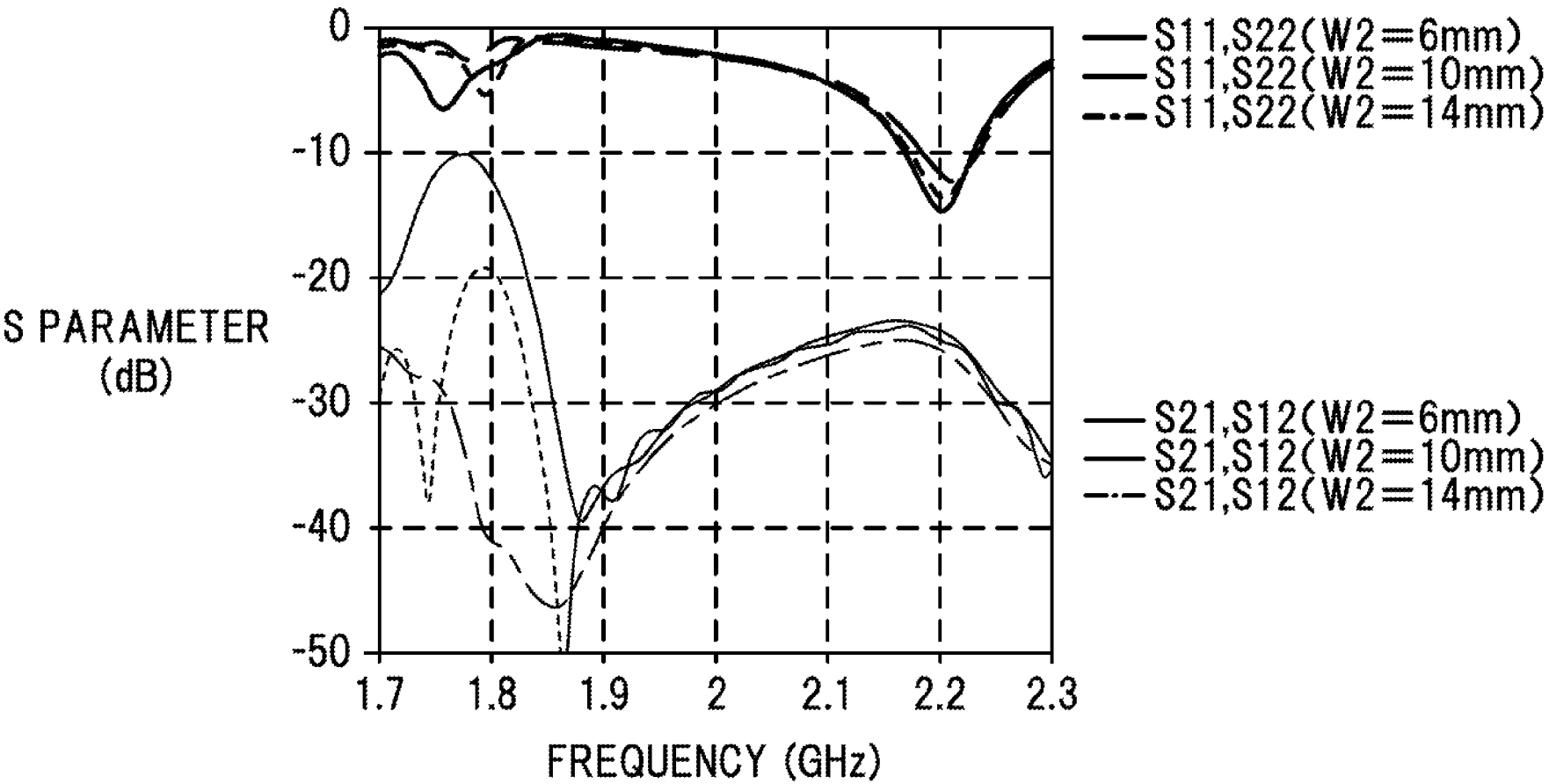
FIG. 17 is a diagram illustrating frequency characteristics of S parameters of the antenna device according to the fourth embodiment.

FIG. 17 is a diagram illustrating frequency characteristics of S parameters of the antenna device 400 according to the fourth embodiment. The diagram illustrates the results of a simulation of S parameters performed on the antenna device 400 for which the distance W1 between the slit sections 431 and 432 was fixed at 20 mm and the distance W2 between the slit sections 433 and 434 was varied among the three types of 6 mm, 10 mm, and 14 mm.

For S11 and S22, characteristics in the case of W2=6 mm are indicated by the solid line, characteristics in the case of W2=10 mm are indicated by the dashed line, and characteristics in the case of W2=14 mm are indicated by the dashed-dotted line.

Similarly, for S21 and S12, characteristics in the case of W2=6 mm are indicated by the solid line, characteristics in the case of W2=10 mm are indicated by the dashed line, and characteristics in the case of W2=14 mm are indicated by the dashed-dotted line.

For S11 and S22, while favorable characteristics of −10 dB or lower were obtained around approximately 2.2 GHz, the value was lowest at W2=6 mm and increased in the order of W2=10 mm and 14 mm. In addition, frequency bands at which a minimum value was obtained slightly shifted towards a high band-side in the order of W2=6 mm, 10 mm, and 14 mm.

On the other hand, for S21 and S12, while favorable values of −25 dB or lower were obtained across approximately 1.85 GHz to approximately 2.3 GHz, the value was lowest at W2=14 mm and increased in the order of W2=10 mm and 6 mm.

Accordingly, it is illustrated that varying the distance W2 between the slit sections 433 and 434 has an impact on both S11 and S22 and on S21 and S12.

Since favorable values of approximately −20 dB or lower were obtained for S21 and S12 at around approximately 2.2 GHz for all of W2=6 mm, 10 mm, and 14 mm, it is found that W2=6 mm is desirable when prioritizing the scarcity of return loss obtained from S11 and S22.

This is substantially the same trend as observed when varying the distance W1 between the slit sections 431 and 432, and the shorter the distance W2 between the slit sections 433 and 434 (the smaller the values of S11 and S22), the more easier matching is achieved between the antenna elements 110 and 120. On the other hand, it is found that the greater the distance W2 (because the values of S21 and S12 are small), the lower the mutual coupling between the antenna elements 110 and 120, and that a tradeoff relationship exists between the matching and the mutual coupling of the antenna elements 110 and 120.

Figure 18:
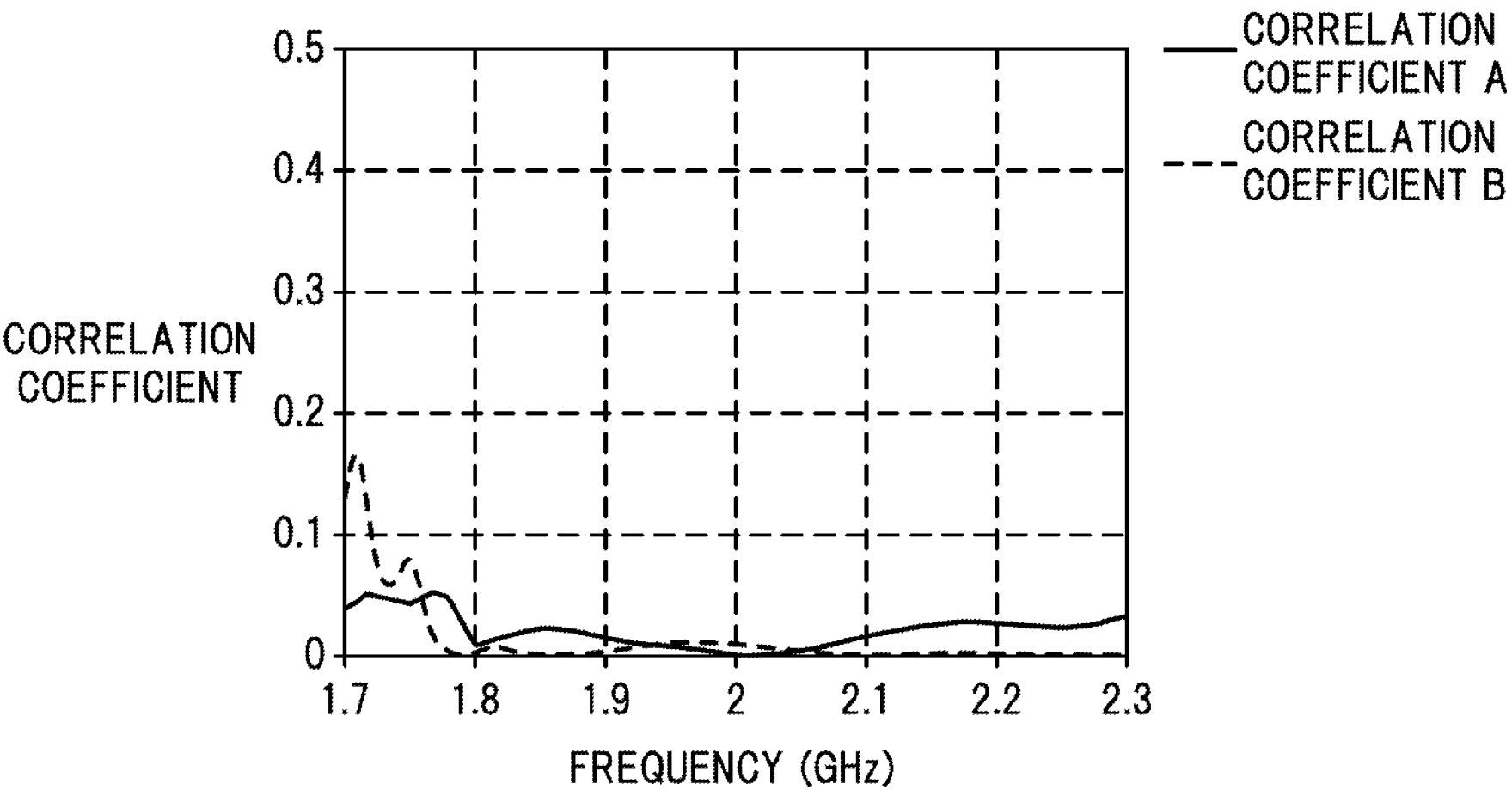
FIG. 18 is a diagram illustrating frequency characteristics of correlation coefficients of the antenna device according to the fourth embodiment.

FIG. 18 is a diagram illustrating frequency characteristics of correlation coefficients of the antenna device 400 according to the fourth embodiment.

In this case, two types of correlation coefficients A and B were calculated through simulation. The correlation coefficient A indicated by the solid line represents a degree of coincidence between the respective radiation patterns of the antenna elements 110 and 120. In addition, the correlation coefficient B indicated by the dashed line represents a correlation coefficient calculated based on the S parameters.

With the antenna device 400 according to the fourth embodiment, results of approximately 0.05 or lower were obtained for both correlation coefficients A and B across a wide range from approximately 1.75 GHz to approximately 2.3 GHz. In particular, an very favorable result of approximately zero was obtained around 2 GHz which had been set as the usable frequency.

This indicates that the correlation between the antenna elements 110 and 120 is negligible and that an very favorable communication state as a diversity antenna device may be achieved.

As described above, according to the fourth embodiment, a diversity antenna device 400 may be provided which features low return loss, favorable radiation characteristics, an extremely low mutual coupling between the antenna elements 110 and 120, and a negligible correlation between the antenna elements 110 and 120.

Figure 19B:
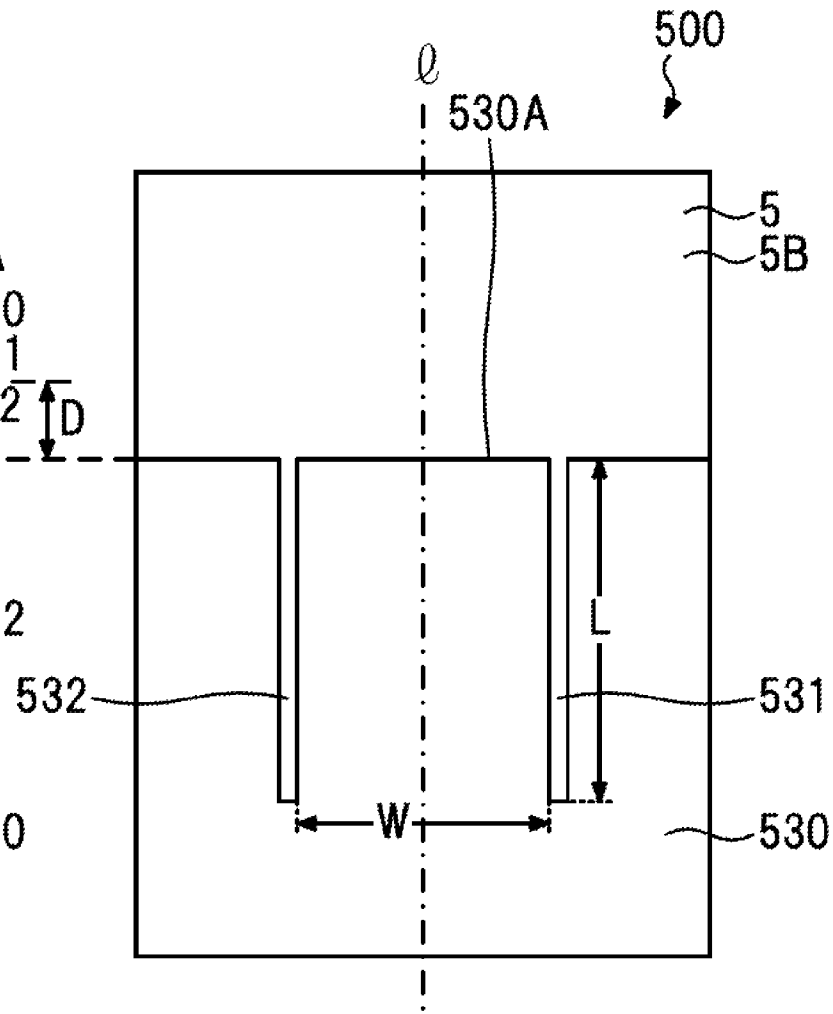
Figure 19A:
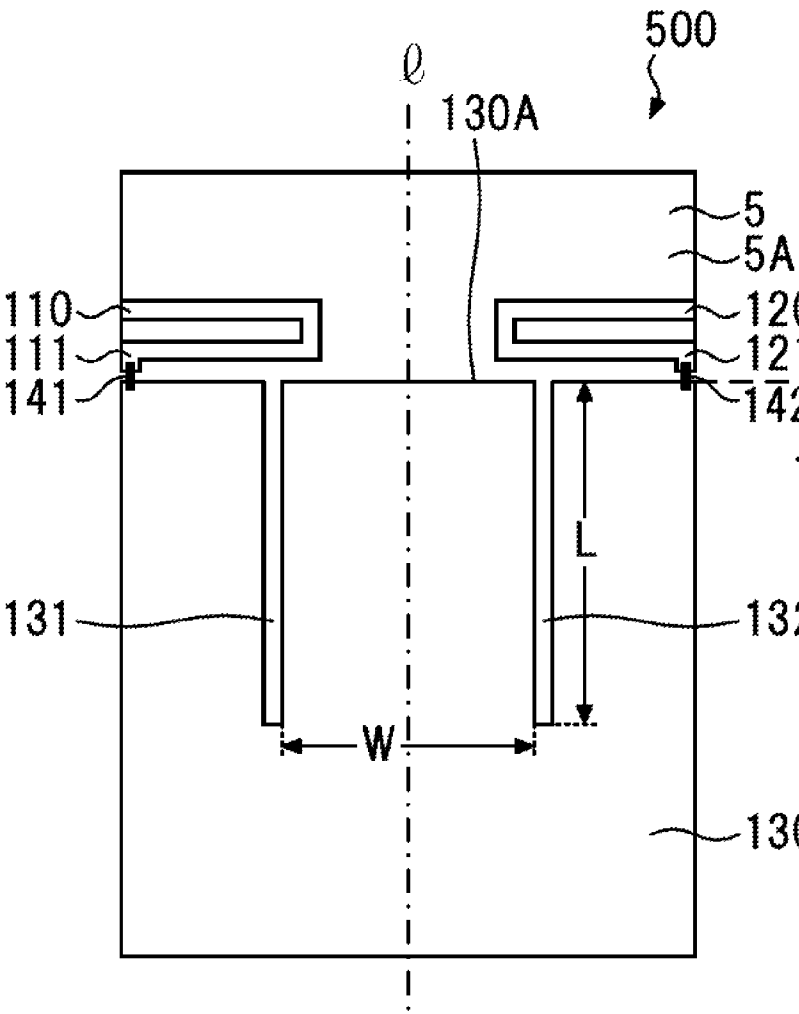

FIGS. 19A and 19B are diagrams illustrating an antenna device 500 according to a fifth embodiment, wherein FIG. 19A is a diagram illustrating the front surface 5A side of the printed circuit board 5 and FIG. 19B is a diagram illustrating the rear surface 5B side of the printed circuit board 5. Moreover, FIG. 19A and FIG. 19B illustrate the surfaces 5A and 5B of the printed circuit board 5 with their positions aligned. In addition, the symmetrical axes 1 illustrated in both diagrams are substantially the same.

The antenna device 500 according to the fifth embodiment differs from the antenna device 100 according to the first embodiment in that a ground section 530 is formed on the rear surface (bottommost surface) 5B in addition to the front surface (topmost surface) 5A of the printed circuit board 5.

Moreover, while a description will now be given on a configuration in which the antenna elements 110, 120 and the ground section 130 are formed on the front surface 5A and a separate ground section 530 is formed on the rear surface 5B of the printed circuit board 5, the ground section 530 may be formed between layers instead of on the rear surface 5B.

As illustrated in FIG. 19A, the structure of the side of the front surface 5A of the printed circuit board 5 of the antenna device 500 according to the fifth embodiment is substantially the same as that of the antenna device 100 according to the first embodiment illustrated in FIG. 3.

The antenna device 500 according to the fifth embodiment includes the ground section 530 on the rear surface 5B side of the printed circuit board 5. The ground section 530 is connected to the ground section 130 on the front surface 5A side via a via hole penetrating the printed circuit board 5. The ground section 530 on the rear surface 5B side is an additional ground section attached to the ground section 130 on the front surface 5A side.

As illustrated in FIG. 19B, the ground section 530 includes slit sections 531 and 532 arranged so as to be axisymmetrical with respect to a symmetrical axis in substantially the same manner as the slit sections 131 and 132 of the ground section 130. Dimensions of the slit sections 531 and 532 are substantially the same as the dimensions of the slit sections 131 and 132, with lengths L of 26 mm in the direction of the symmetrical axis I and a distance W of 12 mm between the slit sections 531 and 532. In addition, the widths of the slit sections 531 and 532 are 1 mm.

Furthermore, as illustrated in FIGS. 19A and 19B, an upper-side end section 530A of the ground section 530 in the direction of the symmetrical axis I is shifted by a distance D with respect to the end section 130A on the side of the ground section 130 near the antenna elements 110 and 120. In the fifth embodiment, the distance D is set to 5 mm.

In other words, the ground section 530 on the rear surface 5B side is displaced downward as seen in the diagram by the distance D (5 mm) in the direction of the symmetrical axis I with respect to the ground section 130 on the front surface 5A side.

Therefore, while the lateral (left-right direction in the diagram) positions as seen in a plan view of the slit section 531 and the slit section 132 are consistent with each other, their positions in the direction of the symmetrical axis I have been shifted by the distance D (5 mm).

In addition, similarly, while the lateral (left-right direction in the diagram) positions as seen in a plan view of the slit section 532 and the slit section 131 are consistent with each other, their positions in the direction of the symmetrical axis I have been shifted by the distance D (5 mm).

Moreover, in the fifth embodiment, the capacities of the chip capacitors 141 and 142 are set to 1 pF.

Before describing the frequency characteristics of the S parameters and the correlation coefficients of the antenna device 500 according to the fifth embodiment, a description will be given on the antenna device 500A for comparison.

Figure 20B:
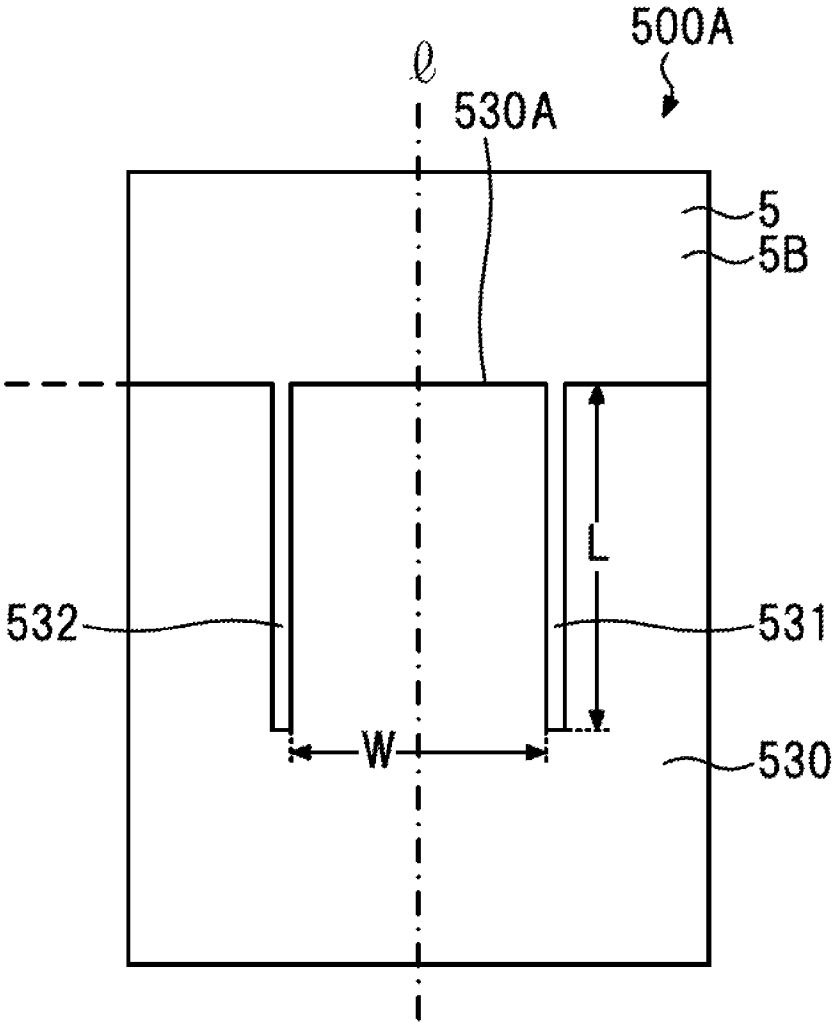
FIGS. 20A and 20B are diagrams illustrating an antenna device for comparison.
Figure 20A:
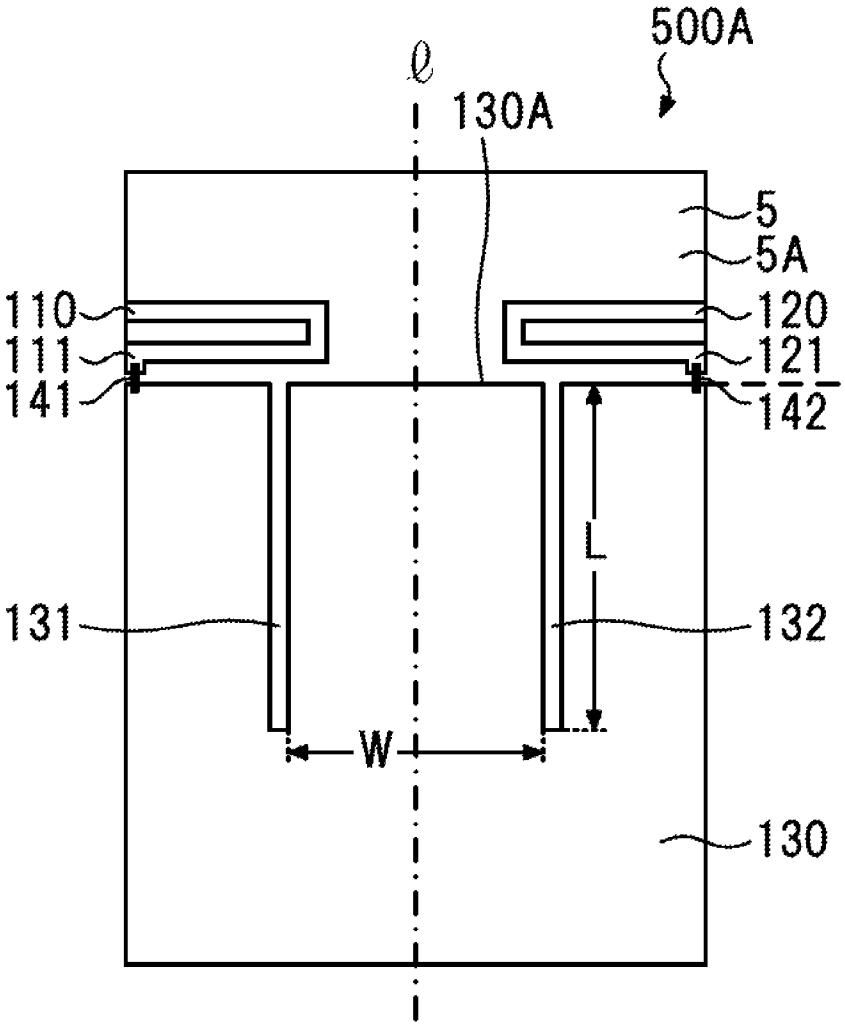

FIGS. 20A and 20B are diagrams illustrating the antenna device 500A for comparison.

The antenna device 500A for comparison is arranged such that the position of the ground section 530 on the rear surface 5B side is aligned with the position of the ground section 130 on the front surface 5A side of the antenna device 500 according to the fifth embodiment illustrated in FIGS. 19A and 19B. All other components are substantially the same as those of the antenna device 500 according to the fifth embodiment illustrated in FIGS. 19A and 19B.

The result of a simulation on frequency characteristics of S parameters and correlation coefficients performed on the antenna device 500A for comparison arranged as described above is illustrated in FIG. 21 and FIG. 22.

Figure 21:
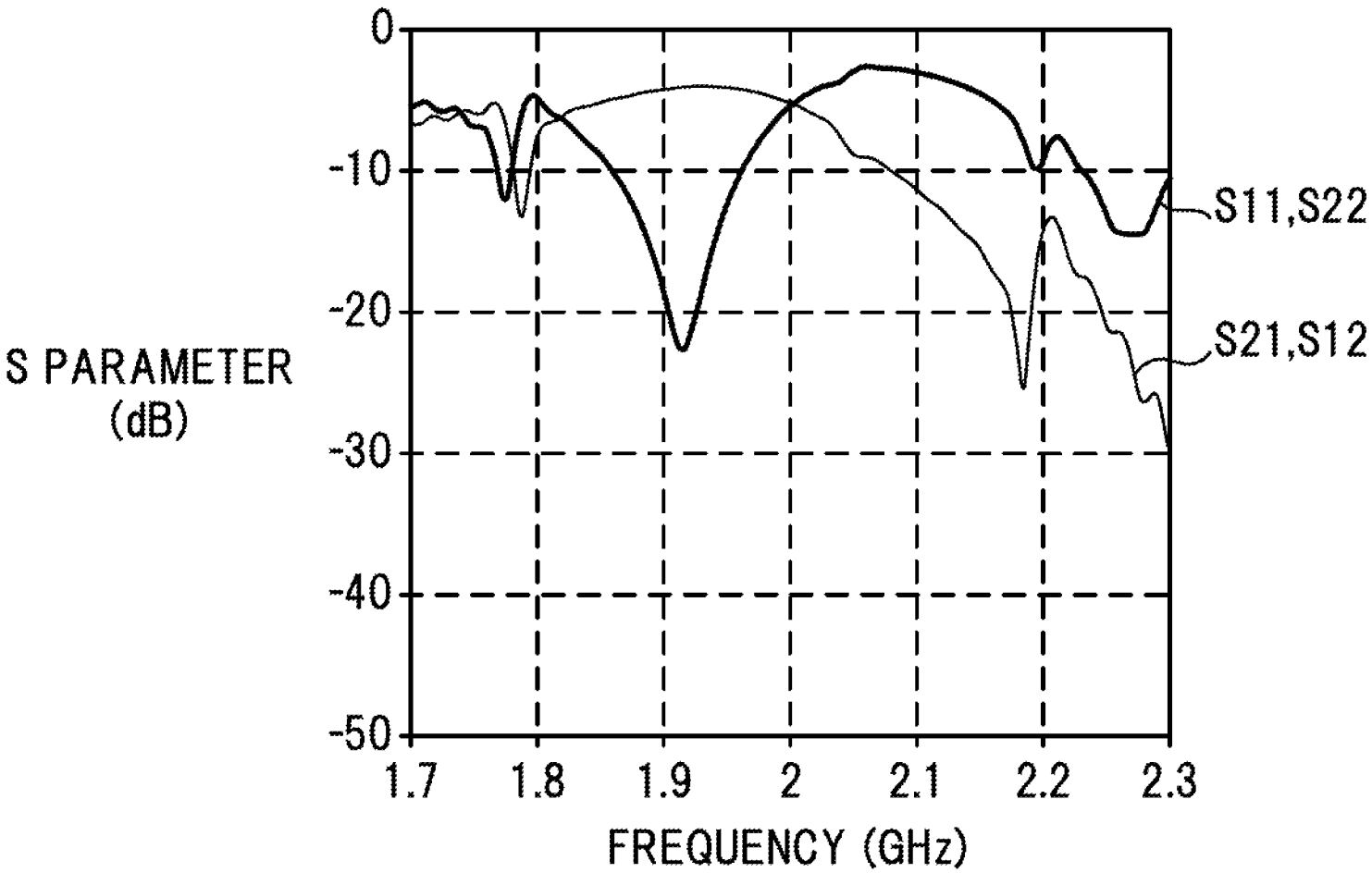
FIG. 21 is a diagram illustrating frequency characteristics of S parameters of the antenna device for comparison.

FIG. 21 is a diagram illustrating frequency characteristics of S parameters of the antenna device 500A for comparison.

According to the antenna device 500A for comparison, while favorable values of −10 dB or lower were obtained for S11 and S22 at a frequency band of approximately 1.9 GHz, relatively higher values than the antenna device 100 according to the first embodiment were exhibited overall.

In addition, while favorable values of −20 dB or lower were obtained for S21 and S12 at around approximately 2.2 GHz and approximately 2.3 GHz, the bandwidths of such favorable values were narrow and relatively high values were exhibited overall.

Figure 22:
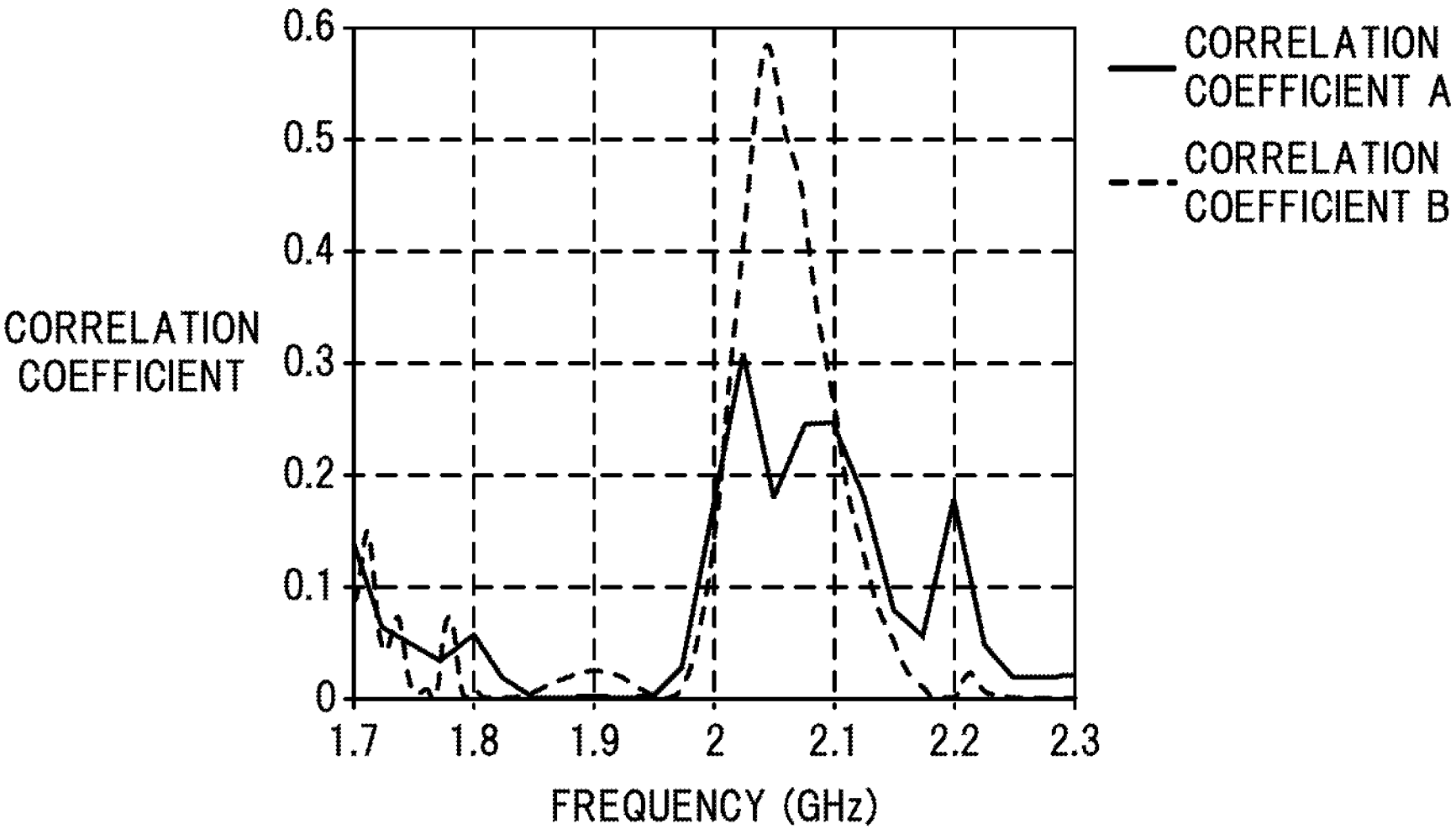
FIG. 22 is a diagram illustrating frequency characteristics of correlation coefficients of the antenna device for comparison.

FIG. 22 is a diagram illustrating frequency characteristics of correlation coefficients of the antenna device 500A for comparison.

In this case, two types of correlation coefficients A and B were calculated through simulation. The correlation coefficient A indicated by the solid line represents a degree of coincidence between the respective radiation patterns of the antenna elements 110 and 120. In addition, the correlation coefficient B indicated by the dashed line represents a correlation coefficient calculated based on the S parameters.

With the antenna device 500A for comparison, it is found that the correlation coefficient A took values of 0.5 or higher from approximately 2.0 GHz to approximately 2.1 GHz and that there were relatively few bands in which both correlation coefficients A and B took values of 0.1 or lower. This indicates that a generally required level (0.5 or lower) is not attained and that an extremely high correlation exists between the antenna elements 110 and 120, and indicates a state that is unfavorable as a diversity antenna device.

As seen, with the antenna device 500A for comparison, the values of the S parameters were relatively high and the correlation coefficients exhibited substantially the same result as a conventional antenna device. Conceivably, this is because the coincidence of the end section 130A of the ground section 130 and the end section 530A of the ground section 530 in the direction of the symmetrical axis I has caused capacitive coupling between the antenna elements 110, 120 and the ground section 530 on the rear surface 5B side.

Moreover, for further comparison, S parameters and correlation coefficients were calculated for an antenna device on which the slit sections 131 and 132 of the front surface 5A side of the printed circuit board 5 of the antenna device 500*a* for comparison illustrated in FIGS. 20Aa and 20B are not formed. As a result, the S parameters and the correlation coefficients were inferior in comparison to the characteristics illustrated in FIG. 21 and FIG. 22.

Figure 23:
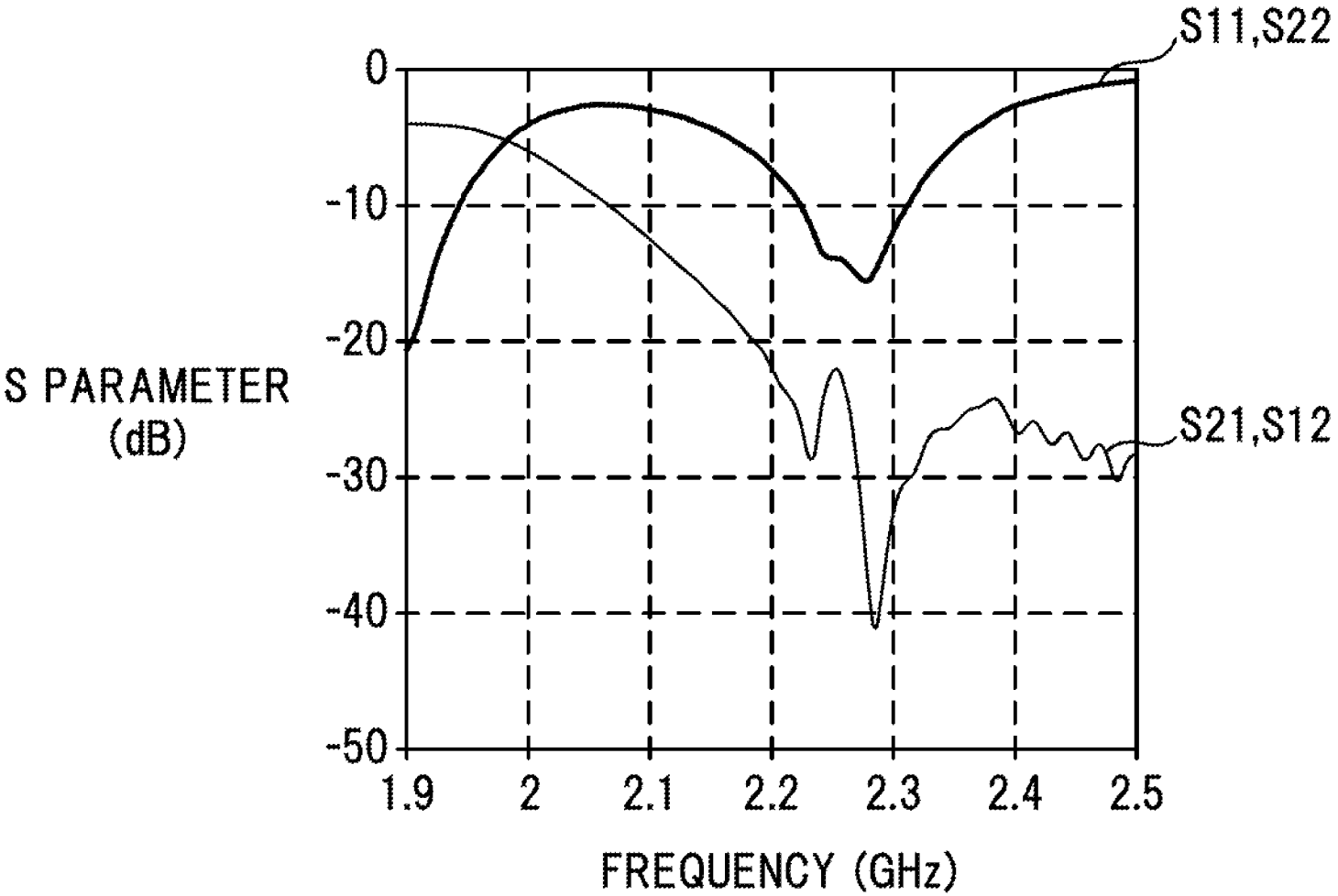
FIG. 23 is a diagram illustrating frequency characteristics of S parameters of the antenna device according to the fifth embodiment.

FIG. 23 is a diagram illustrating frequency characteristics of S parameters of the antenna device 500 according to the fifth embodiment.

With the antenna device 500 according to the fifth embodiment, favorable values of −10 dB or lower were obtained for S11 and S22 in a frequency band ranging from approximately 2.2 GHz to approximately 2.3 GHz. In addition, for S21 and S12, favorable values of −20 dB or lower were obtained over a wide range from approximately 2.2 GHz to approximately 2.5 GHz. In particular, for S21 and S12, very favorable values of −30 dB or lower were obtained at around approximately 2.3 GHz.

With the antenna device 500 according to the fifth embodiment, it is found that return loss may be reduced and mutual coupling may be decreased.

Figure 24:
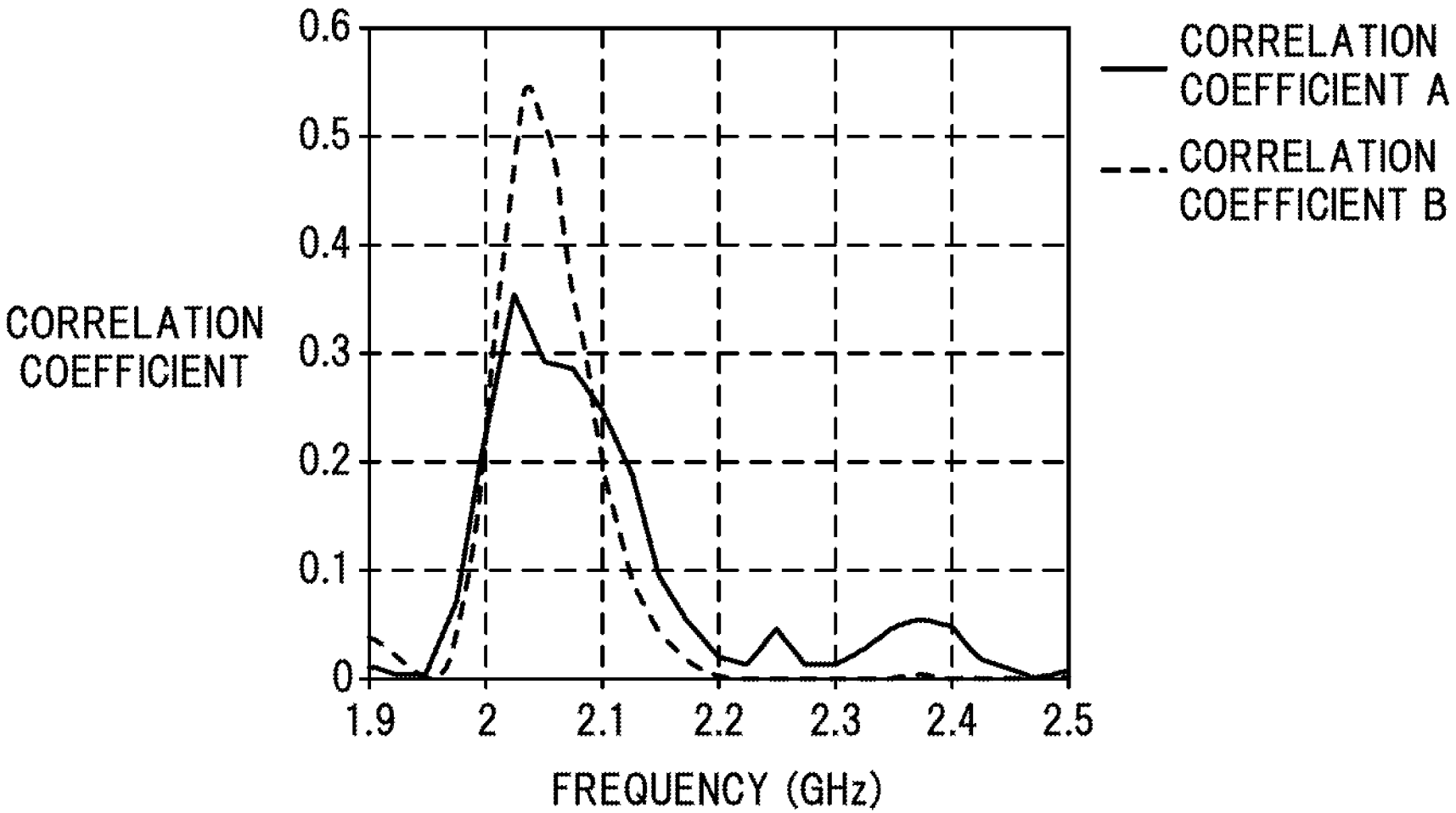
FIG. 24 is a diagram illustrating frequency characteristics of correlation coefficients of the antenna device according to the fifth embodiment.

FIG. 24 is a diagram illustrating frequency characteristics of correlation coefficients of the antenna device 500 according to the fifth embodiment.

In this case, two types of correlation coefficients A and B were calculated through simulation. The correlation coefficient A indicated by the solid line represents a degree of coincidence between the respective radiation patterns of the antenna elements 110 and 120. In addition, the correlation coefficient B indicated by the dashed line represents a correlation coefficient calculated based on the S parameters.

With the antenna device 500 according to the fifth embodiment, results of 0.05 or lower were obtained for both correlation coefficients A and B across a wide range from approximately 2.15 GHz to approximately 2.5 GHz. This indicates that the correlation coefficients are 10 times as low as a generally required level and that the correlation between the antenna elements 110 and 120 is extremely low, and a favorable communication state may be achieved as a diversity antenna device.

As described above, according to the fifth embodiment, by including a ground section 530 arranged on the rear surface 5B side of the printed circuit board 5, a diversity antenna device 500 may be provided which features low return loss, favorable radiation characteristics, a low mutual coupling between the antenna elements 110 and 120, and an extremely low correlation between the antenna elements 110 and 120.

Moreover, the usable frequency of the antenna device 500 may be adjusted by varying the dimensions of the slit sections 131, 132, 531, and 532, the dimensions of the antenna elements 110 and 120, or the capacitances of the chip capacitors 141 and 142. Even when the usable frequency is changed, favorable characteristics such as those described above may be achieved by forming a pair of the slit sections 131 and 132 at the ground section 130 and forming a pair of the slit sections 531 and 532 at the ground section 530 on the rear surface-side as described above.

In addition, while a description has been given above on a configuration in which the ground section 530 is included on the rear surface 5B side of the printed circuit board 5, the ground section 530 may alternatively be arranged between layers of the printed circuit board 5 as described above. However, as described using the antenna device 500A for comparison, it is required that the ground section 530 be shifted downward as seen in the diagram in the direction of the symmetrical axis I with respect to the ground section 130 on the front surface 5A side.

Figure 25B:
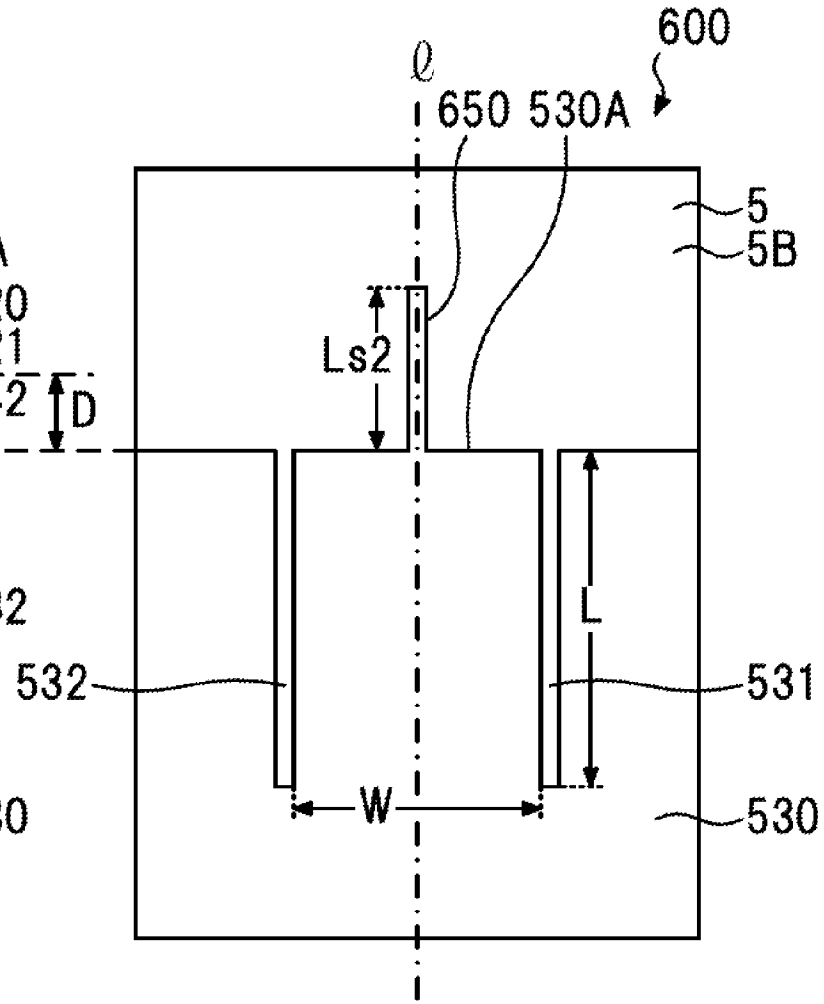
Figure 25A:
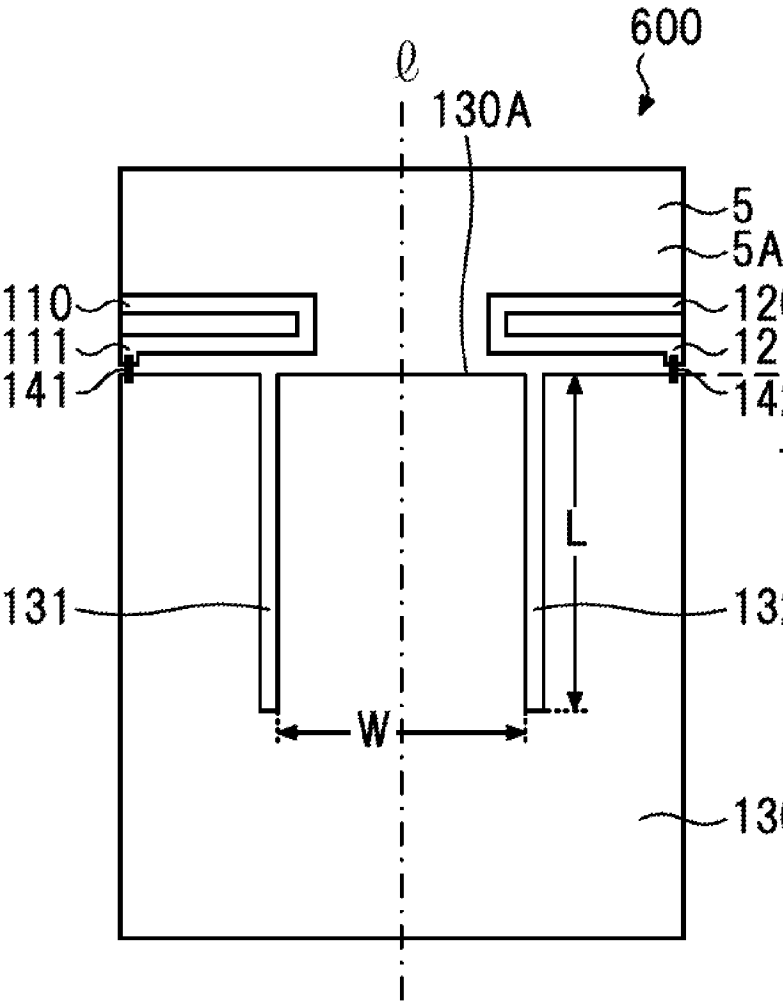

FIGS. 25A-B are diagrams illustrating an antenna device 600 according to a sixth embodiment, wherein FIG. 25A is a diagram illustrating the front surface 5A side of the printed circuit board 5 and FIG. 25B is a diagram illustrating the rear surface 5B of the printed circuit board 5. Moreover, FIG. 25A and FIG. 25B illustrate the surfaces 5A and 5B of the printed circuit board 5 with their positions aligned. In addition, the symmetrical axes 1 illustrated in both diagrams are substantially the same.

The antenna device 600 according to the sixth embodiment differs from the antenna device 500 according to the fifth embodiment in that a stub section is also formed on the rear surface 5B side of the printed circuit board 5. Since the configuration of the antenna device 600 according to the sixth embodiment is otherwise substantially the same as that of the antenna device 500 according to the fifth embodiment, like components will be denoted by like reference characters and descriptions thereof will be omitted.

The stub section 650 is a protruding section formed so as to extend over the symmetrical axis I from the end section 530A of the ground section 530. The stub section 650 is arranged so that a center line thereof is positioned above the symmetrical axis I (i.e., so as to be axisymmetrical with respect to the symmetrical axis I). The stub section 650 extends from the end section 530A by a length Ls2 of, for example, 14 mm, and has a width of 1 mm. In other words, the dimensions of the stub section 650 are substantially the same as those of the stub section 250 according to the second embodiment.

Figure 26:
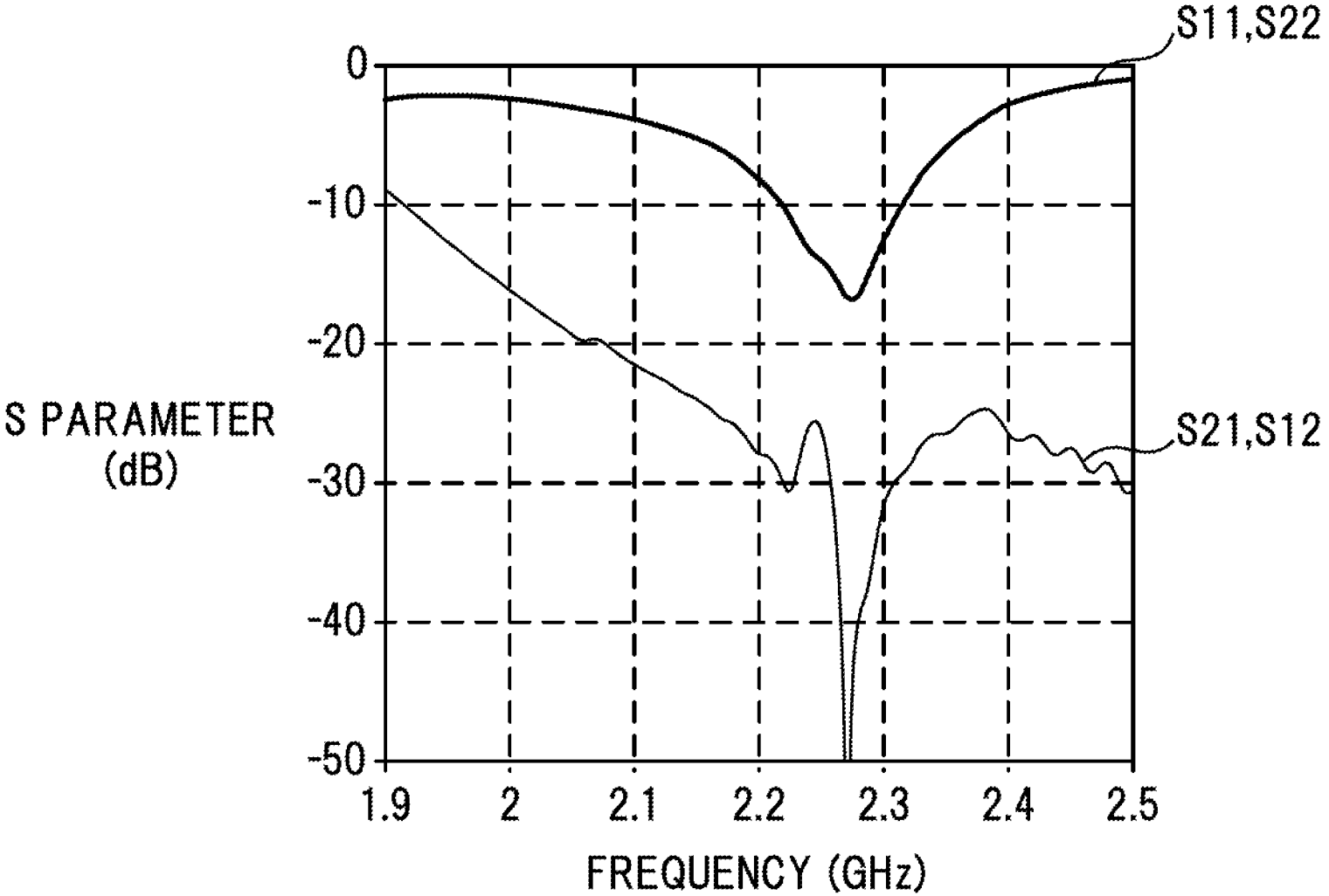
FIG. 26 is a diagram illustrating frequency characteristics of S parameters of the antenna device according to the sixth embodiment.

FIG. 26 is a diagram illustrating frequency characteristics of S parameters of the antenna device 600 according to the sixth embodiment.

With the antenna device 600 according to the sixth embodiment, favorable values of −10 dB or lower were obtained for S11 and S22 in a frequency band ranging from approximately 2.2 GHz to approximately 2.3 GHz. In addition, for S21 and S12, favorable values of −20 dB or lower were obtained over a wide range from approximately 2.1 GHz to approximately 2.5 GHz. In particular, for S21 and S12, very favorable values of −30 dB or lower were obtained from approximately 2.25 GHz to approximately 2.3 GHz. The values were more favorable over a wider range than those of the antenna device 500 according to the fifth embodiment which does not include the stub section 650.

As a result, with the antenna device 600 according to the sixth embodiment, it is found that return loss may be reduced and mutual coupling may be decreased.

Figure 27:
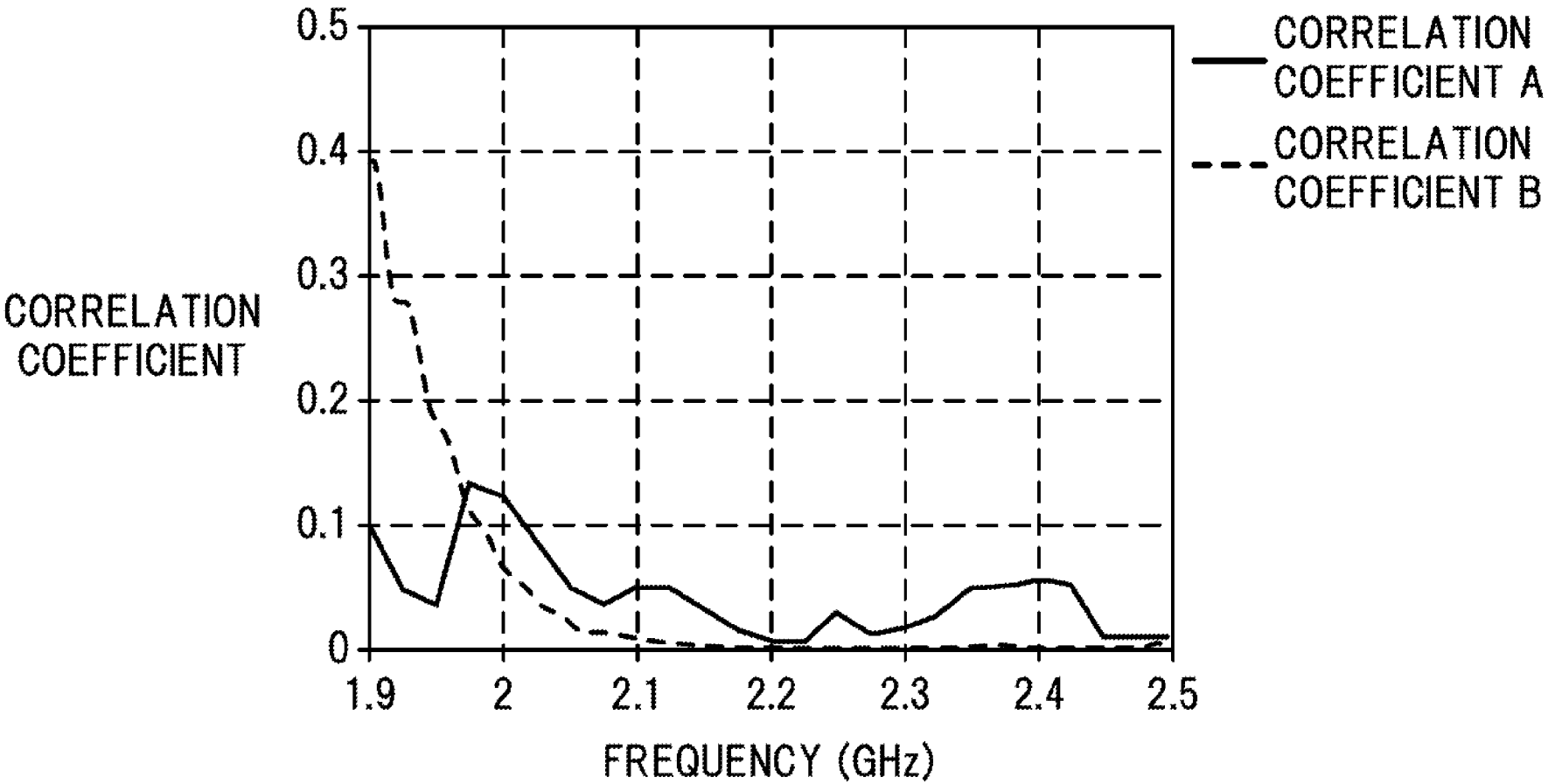
FIG. 27 is a diagram illustrating frequency characteristics of correlation coefficients of the antenna device according to the sixth embodiment.

FIG. 27 is a diagram illustrating frequency characteristics of correlation coefficients of the antenna device 600 according to the sixth embodiment.

In this case, two types of correlation coefficients A and B were calculated through simulation. The correlation coefficient A indicated by the solid line represents a degree of coincidence between the respective radiation patterns of the antenna elements 110 and 120. In addition, the correlation coefficient B indicated by the dashed line represents a correlation coefficient calculated based on the S parameters.

With the antenna device 600 according to the sixth embodiment, results of 0.05 or lower were obtained for both correlation coefficients A and B across a wide range from approximately 2.05 GHz to approximately 2.5 GHz. The values were more favorable over a wider range than those of the antenna device 500 according to the fifth embodiment which does not include the stub section 650.

As illustrated, with the antenna device 600 according to the sixth embodiment, it is found that correlation coefficients that are 10 times as low as a generally required level may be realized, the correlation between the antenna elements 110 and 120 is extremely low, and a favorable communication state may be achieved as a diversity antenna device.

As described above, according to the sixth embodiment, by forming a stub section 650 on the ground section 530 arranged on the rear surface 5B side of the printed circuit board 5, a diversity antenna device 600 may be provided which features low return loss, favorable radiation characteristics, a low mutual coupling between the antenna elements 110 and 120, and an extremely low correlation between the antenna elements 110 and 120.

Moreover, a calculation of the efficiency of the antenna device 600 according to the sixth embodiment resulted in a value of 85%.

Figure 28B:
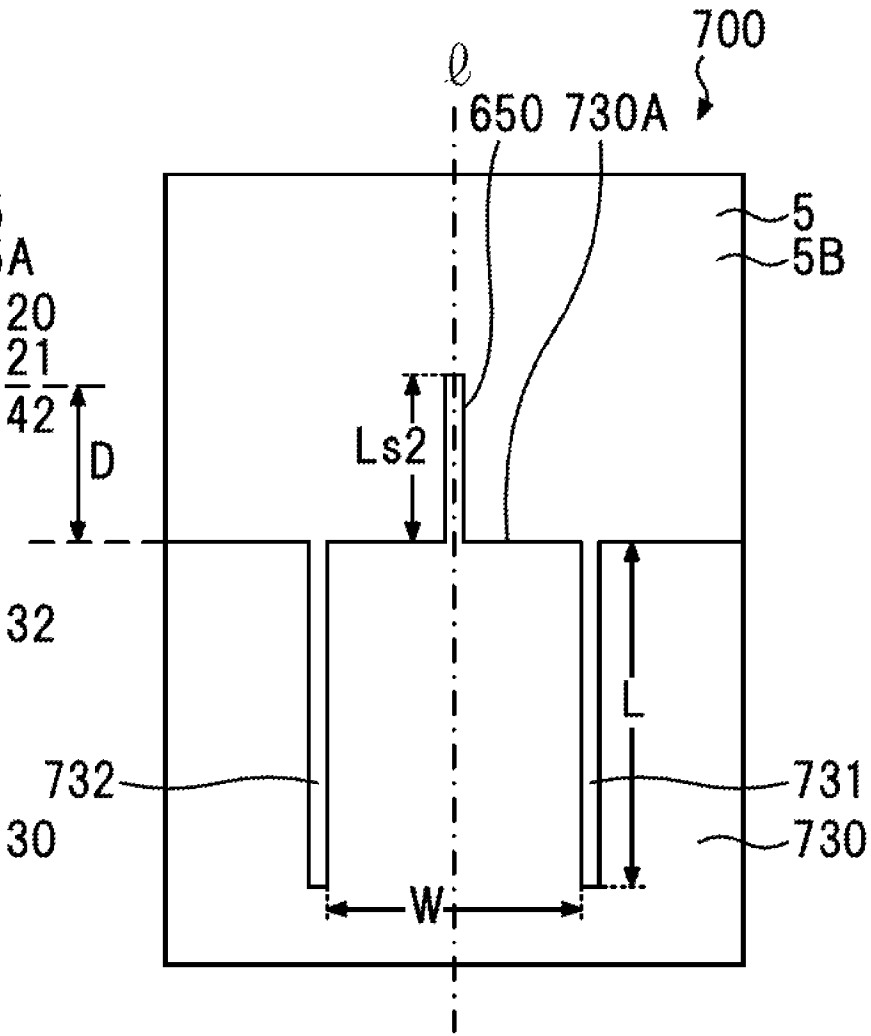
Figure 28A:
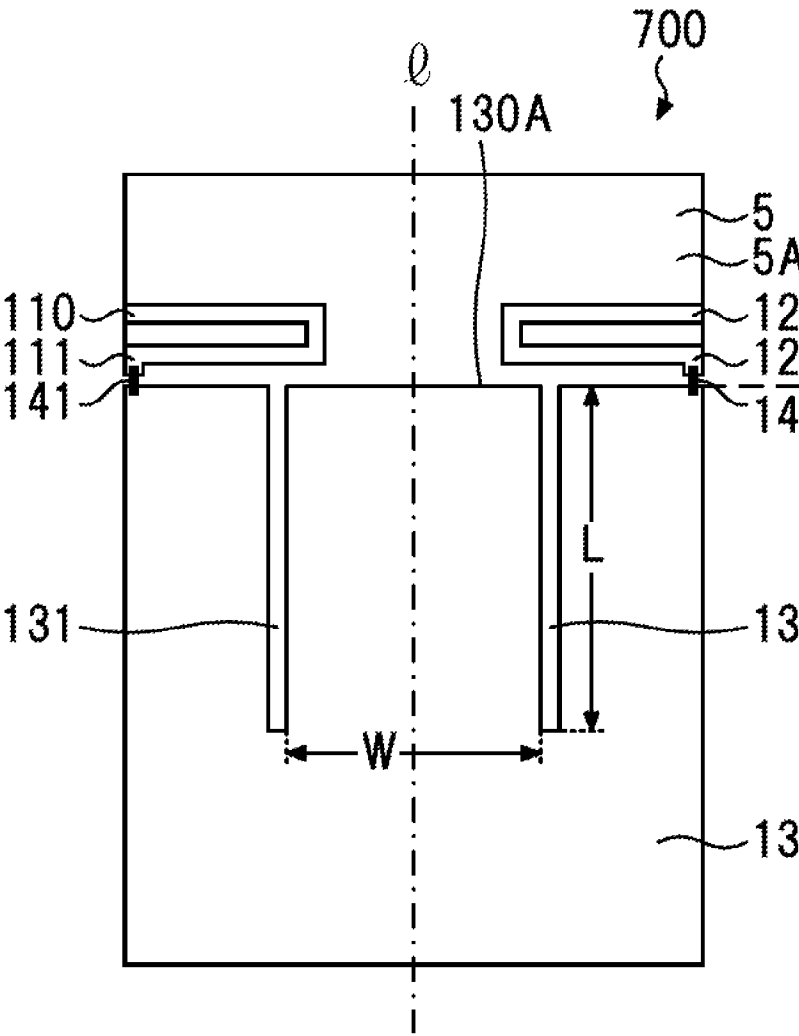

FIG. 28 is a diagram illustrating an antenna device 700 according to a seventh embodiment, wherein FIG. 28A is a diagram illustrating the front surface side of the printed circuit board 5 and FIG. 28B is a diagram illustrating the rear surface side of the printed circuit board 5.

The antenna device 700 according to the seventh embodiment differs from the antenna device 600 according to the sixth embodiment in that the distance D between an end section 730A of a ground section 730 on the rear surface 5B side and the end section 130A of the ground section 130 on the front surface 5A side of the printed circuit board 5 has been extended to 10 mm.

Moreover, slit sections 731 and 732 corresponding to the slit sections 531 and 532 formed on the ground section 530 of the antenna device 600 according to the sixth embodiment are formed on the ground section 730. Since the configuration of the antenna device 700 according to the seventh embodiment is otherwise substantially the same as that of the antenna device 600 according to the sixth embodiment, like components will be denoted by like reference characters and descriptions thereof will be omitted.

Figure 29:
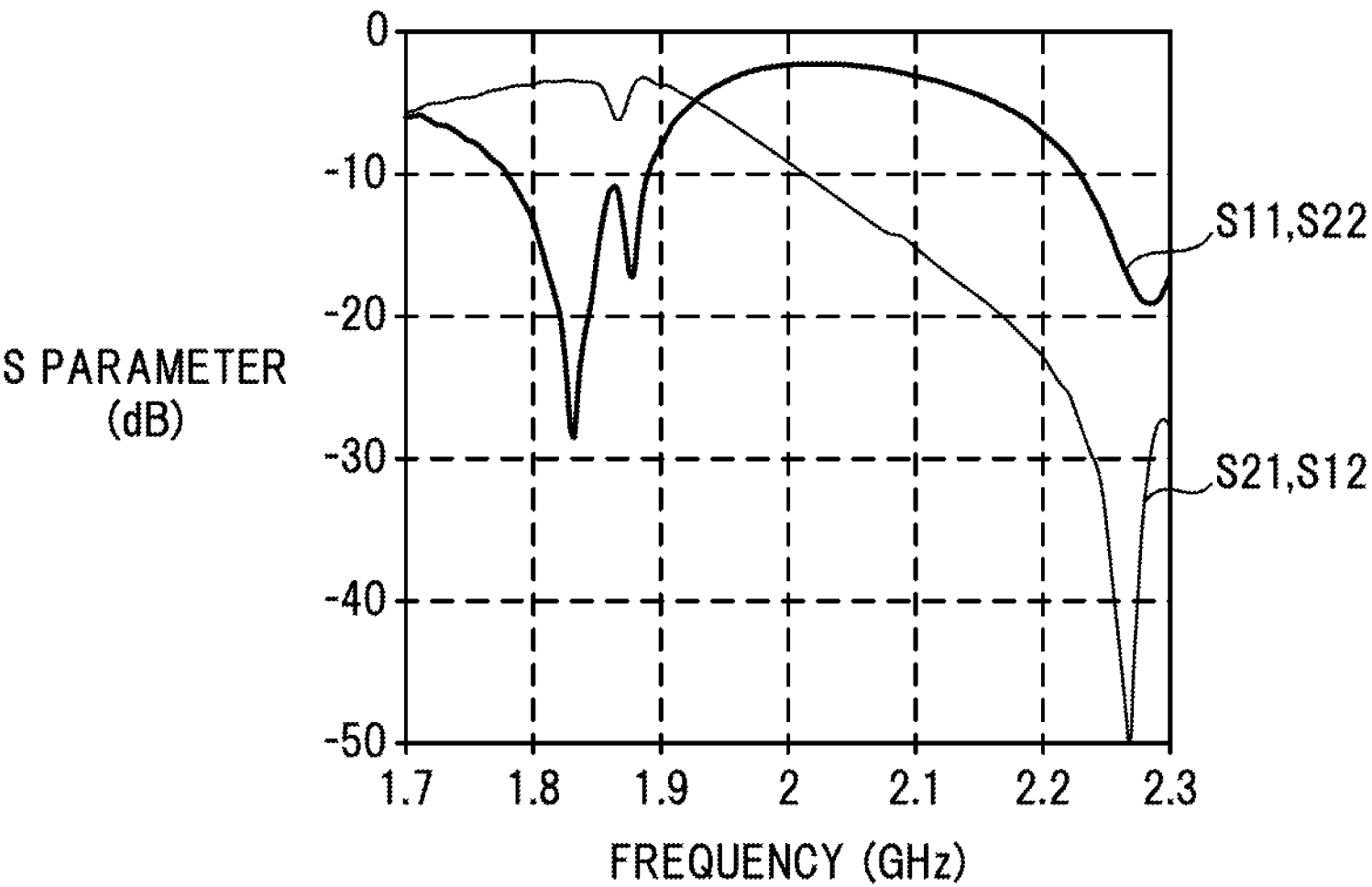
FIG. 29 is a diagram illustrating frequency characteristics of S parameters of the antenna device according to the seventh embodiment.

FIG. 29 is a diagram illustrating frequency characteristics of S parameters of the antenna device 700 according to the seventh embodiment.

With the antenna device 700 according to the seventh embodiment, favorable values of −10 dB or lower were obtained for S11 and S22 in frequency bands ranging from approximately 1.8 GHz to approximately 1.9 GHz and from approximately 2.25 GHz to approximately 2.3 GHz.

In addition, for S21 and S12, favorable values of −20 dB or lower were obtained over a wide range from approximately 2.15 GHz to approximately 2.3 GHz. In particular, for S21 and S12, very favorable values of −30 dB or lower were obtained from approximately 2.25 GHz to approximately 2.3 GHz. While the results are slightly inferior to those of the antenna device 600 according to the sixth embodiment in which the distance D to the end section 130A of the ground section 130 on the front surface 5A side is 5 mm, sufficiently favorable values were obtained.

Figure 30:
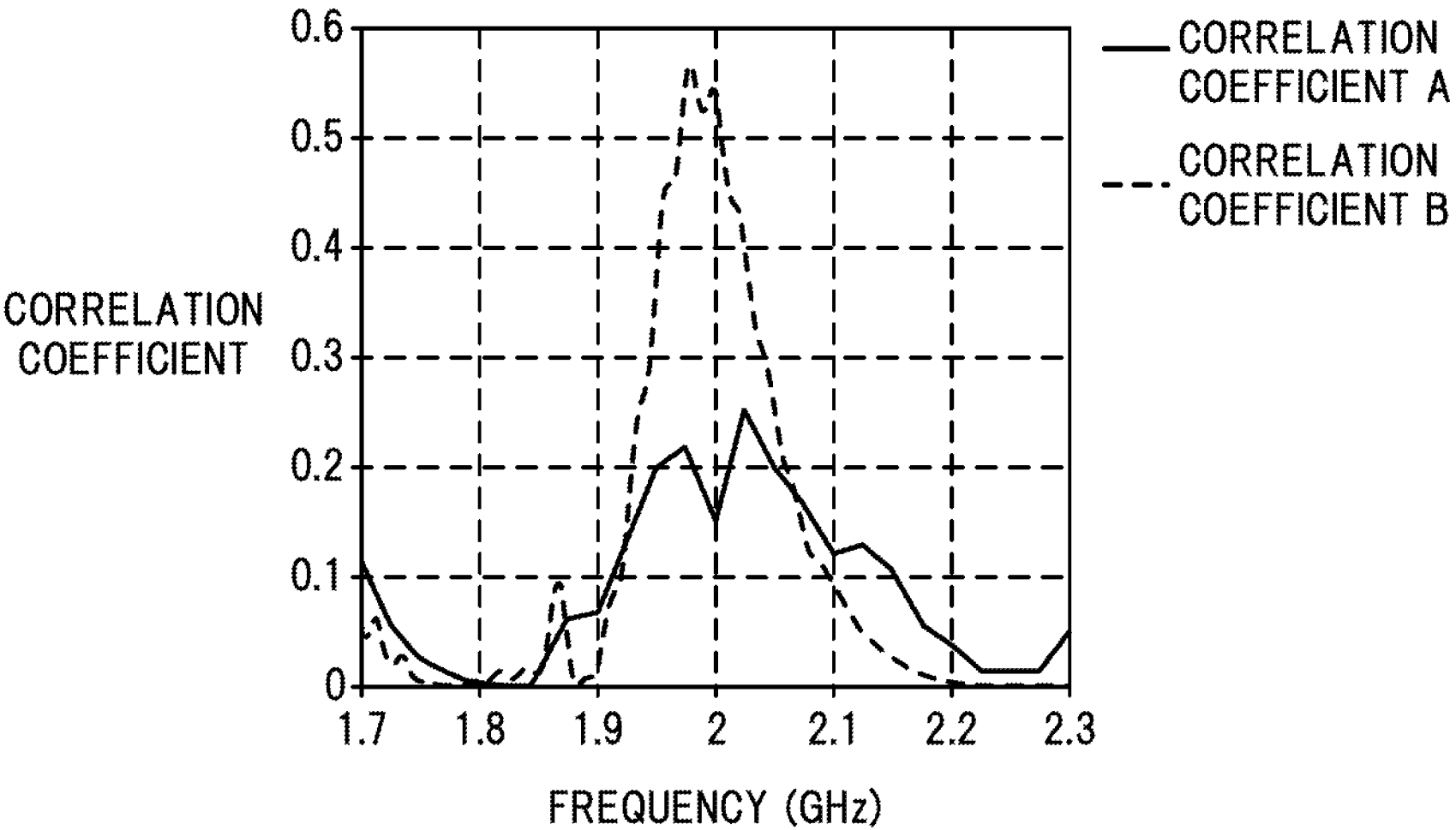
FIG. 30 is a diagram illustrating frequency characteristics of correlation coefficients of the antenna device according to the seventh embodiment.

FIG. 30 is a diagram illustrating frequency characteristics of correlation coefficients of the antenna device 700 according to the seventh embodiment.

In this case, two types of correlation coefficients A and B were calculated through simulation. The correlation coefficient A indicated by the solid line represents a degree of coincidence between the respective radiation patterns of the antenna elements 110 and 120. In addition, the correlation coefficient B indicated by the dashed line represents a correlation coefficient calculated based on the S parameters.

With the antenna device 700 according to the seventh embodiment, values close to approximately zero were obtained for both correlation coefficients A and B from approximately 2.25 GHz to approximately 2.3 GHz. The values are more favorable than those of the antenna device 600 according to the sixth embodiment in which the distance D to the end section 130A of the ground section 130 on the front surface 5A side is 5 mm.

As illustrated, with the antenna device 700 according to the seventh embodiment, it is found that correlation coefficients that are 10 times as low as a generally required level may be realized, the correlation between the antenna elements 110 and 120 is extremely low, and a favorable communication state may be achieved as a diversity antenna device.

As described above, according to the seventh embodiment, by further extending the distance D to the end section 130A of the ground section 130 on the front surface 5A side, a diversity antenna device 700 may be provided which features low return loss, favorable radiation characteristics, a low mutual coupling between the antenna elements 110 and 120, and an extremely low correlation between the antenna elements 110 and 120.

Moreover, a calculation of the efficiency of the antenna device 700 according to the seventh embodiment resulted in a value of 90%.

Figure 31B:
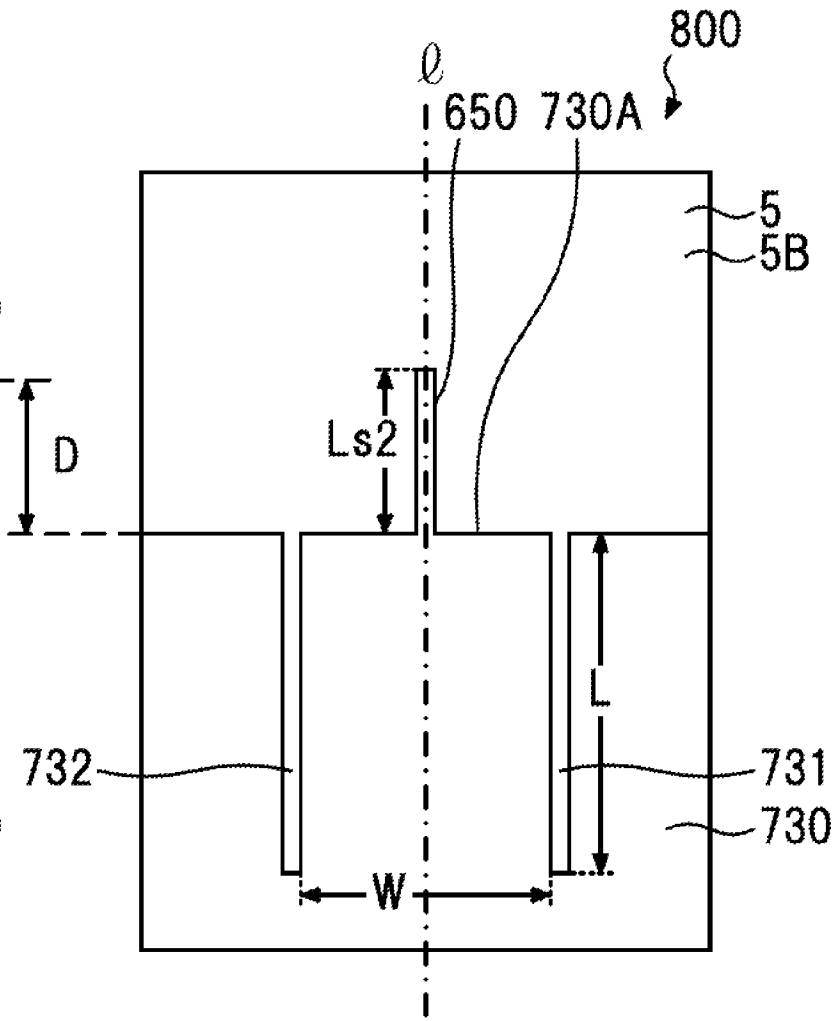
Figure 31A:
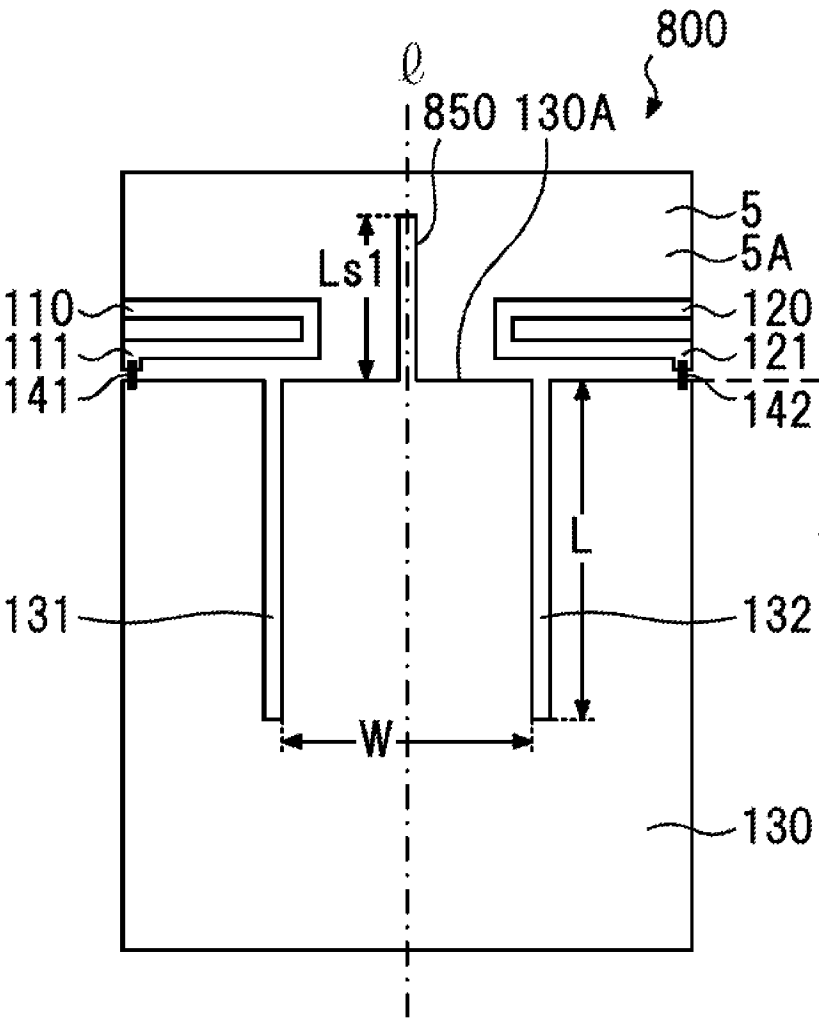

FIGS. 31A-B are diagrams illustrating an antenna device 800 according to an eighth embodiment, wherein FIG. 31A is a diagram illustrating the front surface side of the printed circuit board 5 and FIG. 31B is a diagram illustrating the rear surface side of the printed circuit board 5.

The antenna device 800 according to the eighth embodiment differs from the antenna device 700 according to the seventh embodiment in that a stub section 850 is also formed on the ground section 130 on the front surface 5A side of the printed circuit board 5. Since the configuration of the antenna device 800 according to the eighth embodiment is otherwise the same as that of the antenna device 700 according to the seventh embodiment, like components will be denoted by like reference characters and descriptions thereof will be omitted.

The stub section 850 is substantially the same as the stub section 250 according to the second embodiment and is a protruding section formed so as to extend over the symmetrical axis I from an end section 130A of the ground section 130 near the antenna elements 110 and 120. The stub section 850 is arranged so that a center line thereof is positioned above the symmetrical axis I (i.e., so as to be axisymmetrical with respect to the symmetrical axis I). The stub section 850 extends from the end section 130A by a length Ls1 of 14 mm and has a width of 1 mm.

Before describing the frequency characteristics of the S parameters and the correlation coefficients of the antenna device 800 according to the eighth embodiment, a description will be given on an antenna device 800A for comparison with reference to FIGS. 32 to 34.

Figure 32B:
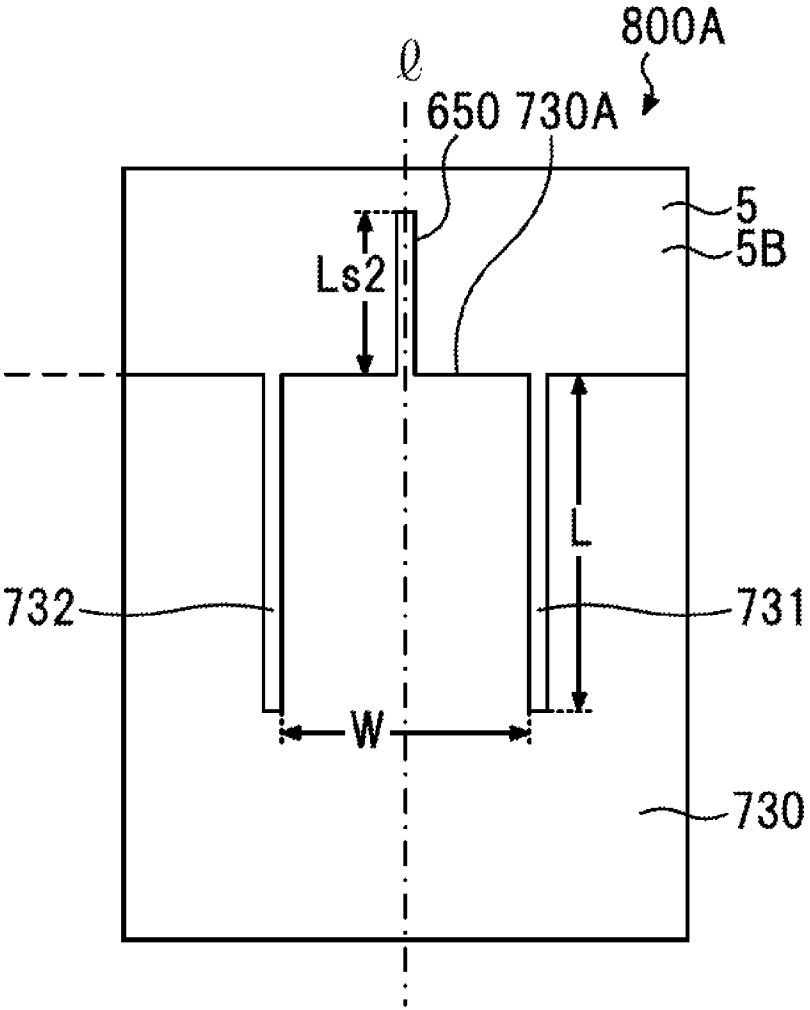
Figure 32A:
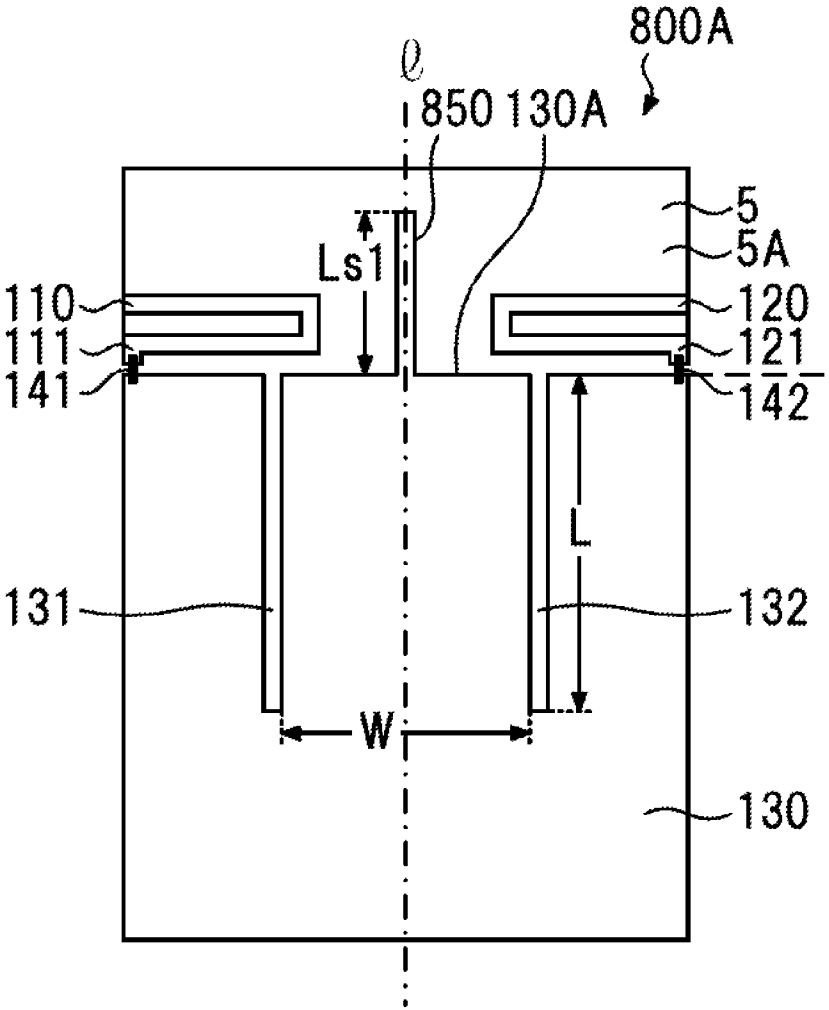

FIGS. 32A-B are diagrams illustrating the antenna device 800A for comparison, wherein FIG. 32A is a diagram illustrating the front surface 5A side of the printed circuit board 5 and FIG. 32B is a diagram illustrating the rear surface 5B side of the printed circuit board 5.

The antenna device 800A for comparison is arranged such that the position of the ground section 730 on the rear surface 5B side is aligned with the position of the ground section 130 on the front surface 5A side of the antenna device 800 according to the eighth embodiment illustrated in FIG. 31. All other components are substantially the same as those of the antenna device 500 according to the fifth embodiment illustrated in FIG. 19.

The result of a simulation on frequency characteristics of S parameters and correlation coefficients performed on the antenna device 800A for comparison arranged as described above is illustrated in FIG. 33 and FIG. 34.

Figure 33:
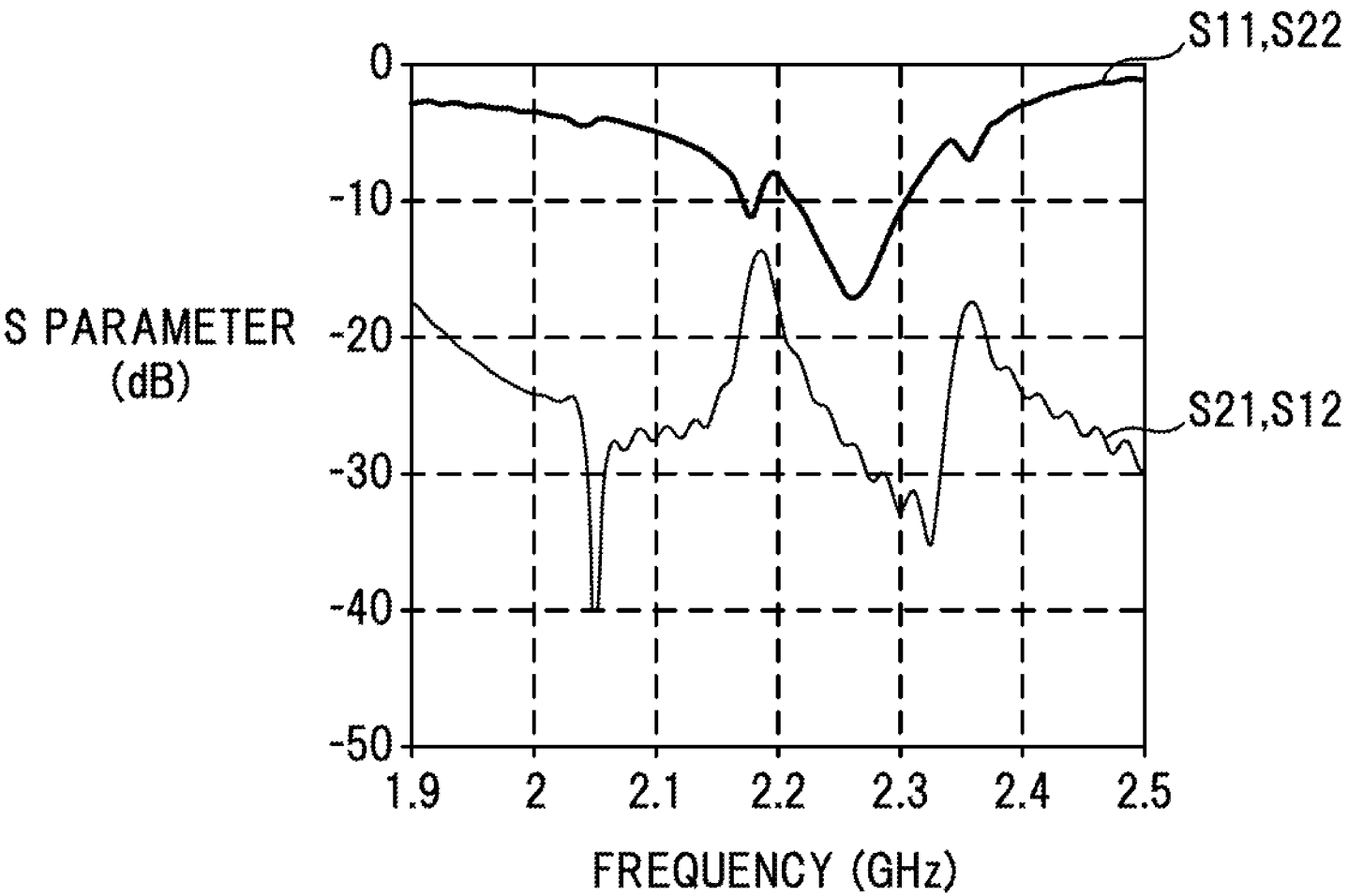
FIG. 33 is a diagram illustrating frequency characteristics of S parameters of the antenna device for comparison.

FIG. 33 is a diagram illustrating frequency characteristics of S parameters of the antenna device 800A for comparison.

With the antenna device 800A for comparison, while favorable values of −10 dB or lower were obtained for S11 and S22 in a frequency band ranging from approximately 2.2 GHz to approximately 2.3 GHz, relatively high values were exhibited overall.

In addition, as for S21 and S12, while favorable values of −20 dB or lower were obtained from approximately 1.95 GHz to approximately 2.15 GHz and from approximately 2.2 GHz to approximately 2.35 GHz, unstable characteristics were exhibited overall in comparison to the S parameter characteristics in the other embodiments.

Figure 34:
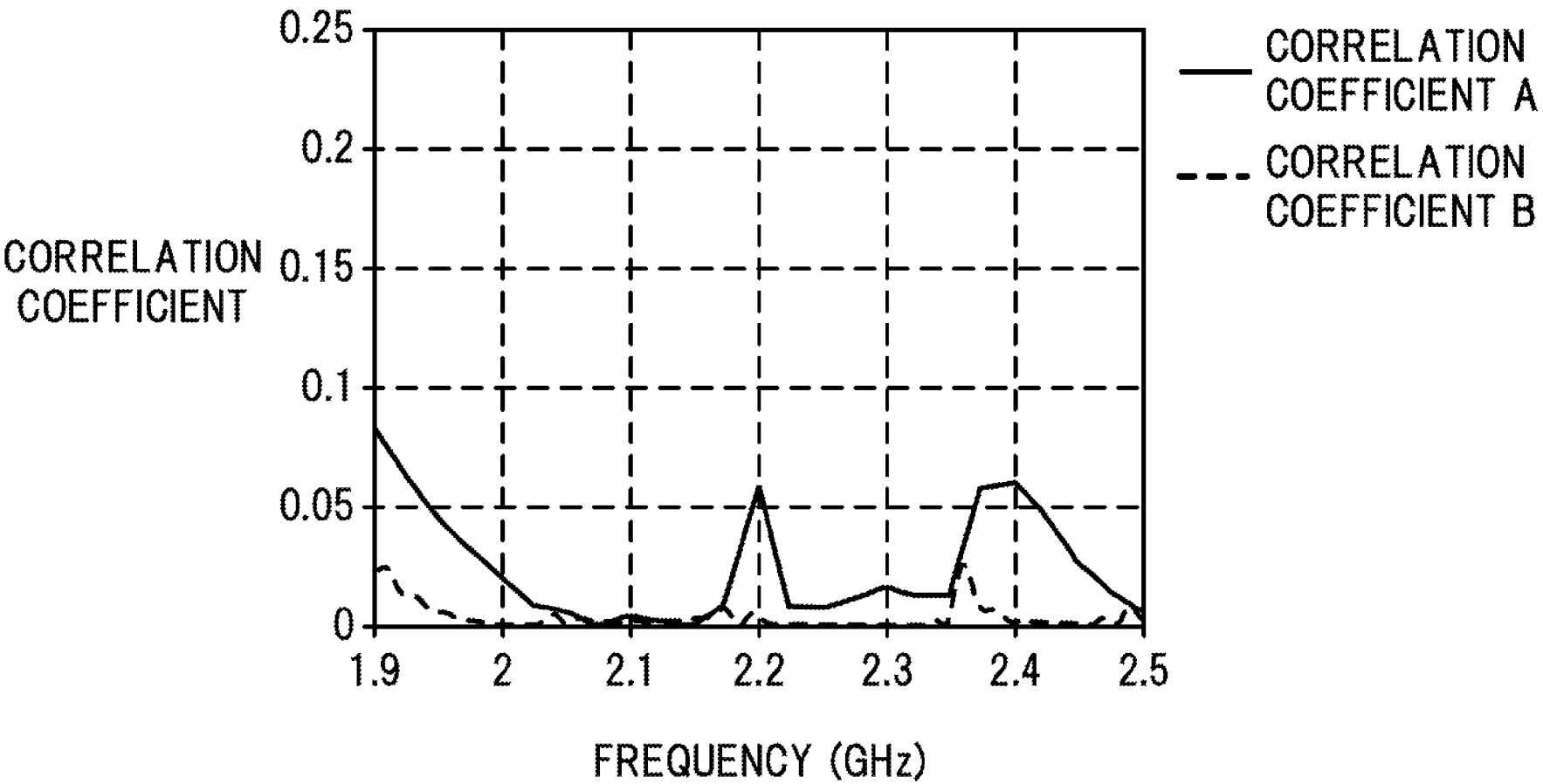
FIG. 34 is a diagram illustrating frequency characteristics of correlation coefficients of the antenna device for comparison.

FIG. 34 is a diagram illustrating frequency characteristics of correlation coefficients of the antenna device 800A for comparison.

In this case, two types of correlation coefficients A and B were calculated through simulation. The correlation coefficient A indicated by the solid line represents a degree of coincidence between the respective radiation patterns of the antenna elements 110 and 120. In addition, the correlation coefficient B indicated by the dashed line represents a correlation coefficient calculated based on the S parameters.

With the antenna device 800A for comparison, relatively favorable results of 0.05 or lower were obtained for both correlation coefficients A and B from approximately 1.95 GHz to approximately 2.35 GHz.

As illustrated, unlike the antenna device 500A for comparison according to the fifth embodiment, the antenna device 800A for comparison exhibited relatively favorable results. Conceivably, this is due to the fact that characteristics have been improved by respectively including the stub sections 850 and 650 on the front surface 5A side and the rear surface 5B side of the printed circuit board 5.

Figure 35:
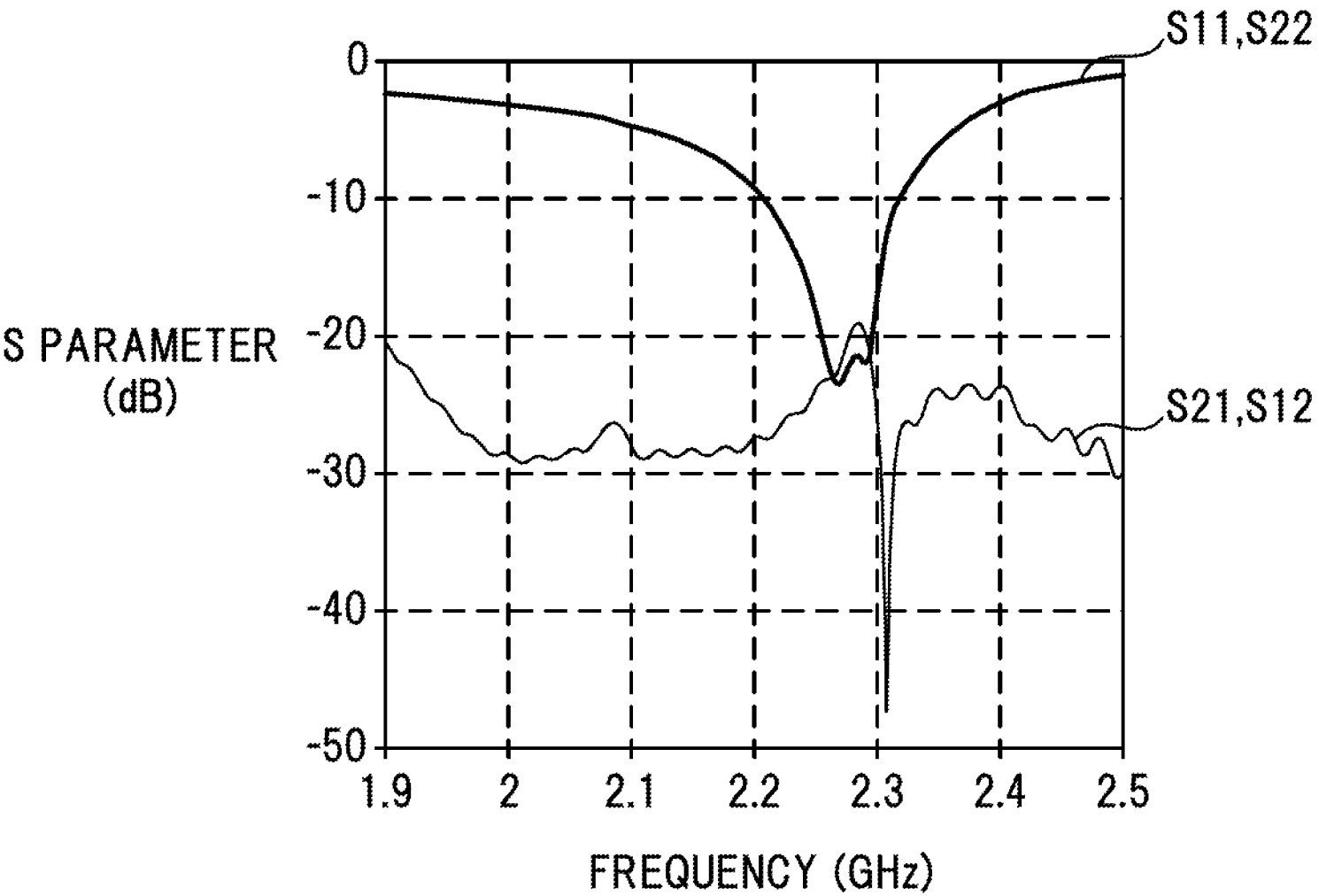
FIG. 35 is a diagram illustrating frequency characteristics of S parameters of the antenna device according to the eighth embodiment.

FIG. 35 is a diagram illustrating frequency characteristics of S parameters of the antenna device 800 according to the eighth embodiment.

With the antenna device 800 according to the eighth embodiment, favorable values of −10 dB or lower were obtained for S11 and S22 in a frequency band ranging from approximately 2.2 GHz to approximately 2.3 GHz. In particular, for S11 and S22, very favorable values of −20 dB or lower were obtained from approximately 2.25 GHz to approximately 2.3 GHz.

In addition, for S21 and S12, favorable values of −20 dB or lower were obtained over a wide range from approximately 1.9 GHz to approximately 2.5 GHz. In particular, for S21 and S12, very favorable values of approximately −30 dB were obtained from approximately 2.0 GHz to approximately 2.2 GHz.

With the antenna device 800 according to the eighth embodiment, it is found that return loss may be reduced and mutual coupling may be decreased.

Figure 36:
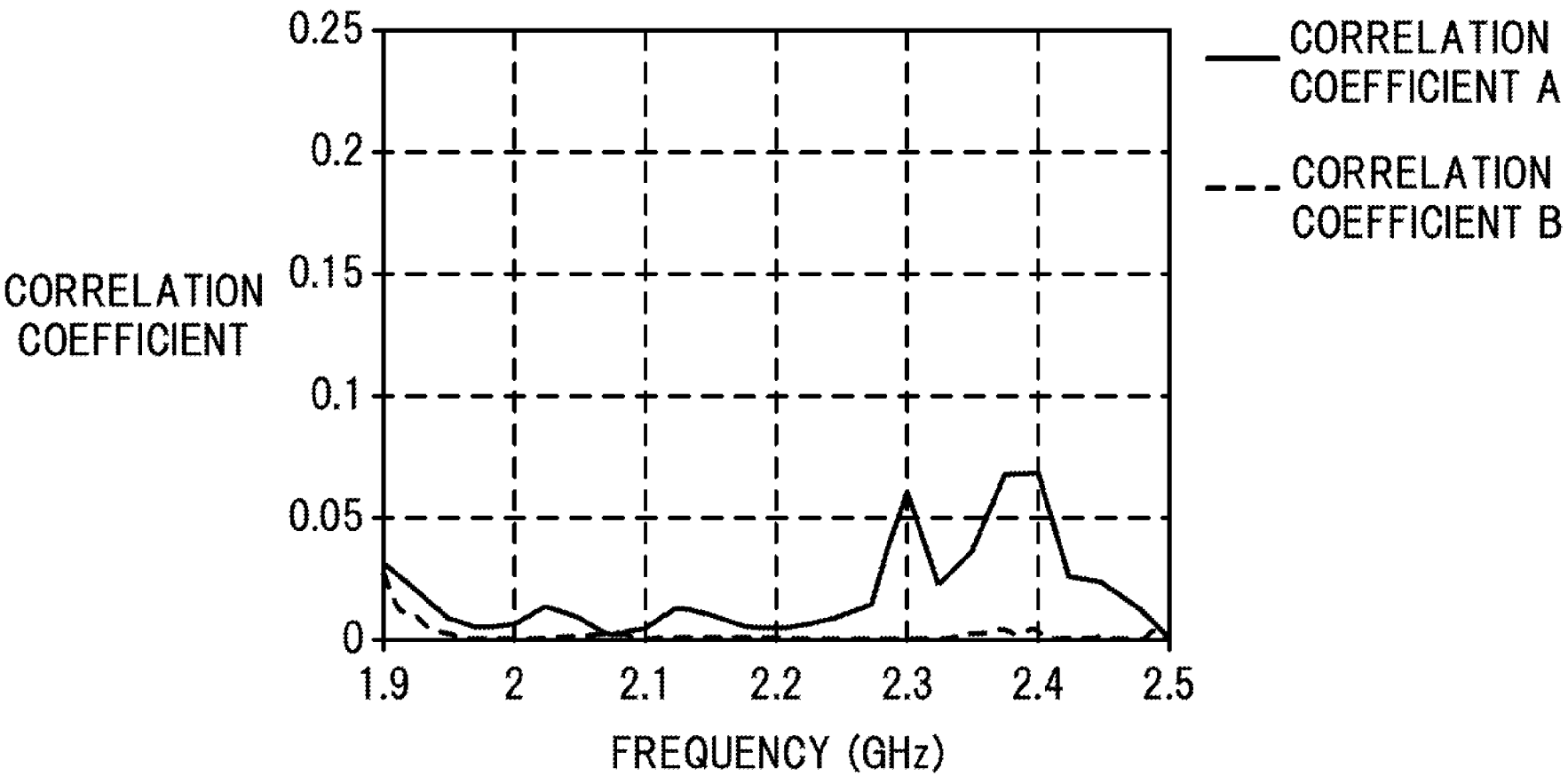
FIG. 36 is a diagram illustrating frequency characteristics of correlation coefficients of the antenna device according to the eighth embodiment.

FIG. 36 is a diagram illustrating frequency characteristics of correlation coefficients of the antenna device 800 according to the eighth embodiment.

In this case, two types of correlation coefficients A and B were calculated through simulation. The correlation coefficient A indicated by the solid line represents a degree of coincidence between the respective radiation patterns of the antenna elements 110 and 120. In addition, the correlation coefficient B indicated by the dashed line represents a correlation coefficient calculated based on the S parameters.

With the antenna device 800 according to the eighth embodiment, results of 0.05 or lower were obtained for the correlation coefficient A across a wide range from approximately 1.95 GHz to approximately 2.25 GHz. In addition, for the correlation coefficient B, very excellent values of approximately zero were obtained approximately over the entire range (1.9 GHz to 2.5 GHz).

This indicates that the correlation coefficients are 10 times as low as a generally required level and that the correlation between the antenna elements 110 and 120 is extremely low, and a favorable communication state may be achieved as a diversity antenna device.

Figure 37:
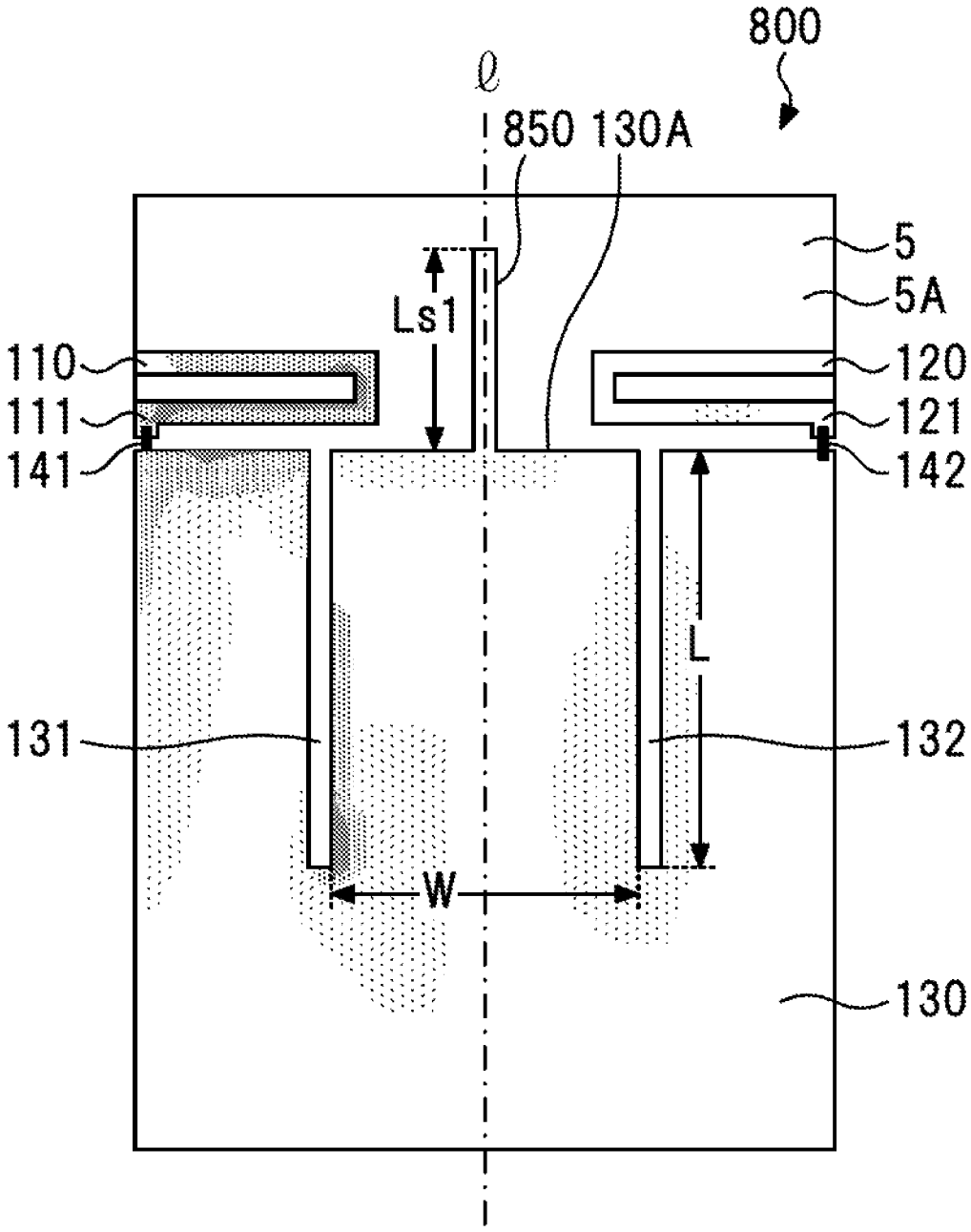
FIG. 37 is a diagram illustrating the result of a current density simulation performed on the antenna device 800 according to the eighth embodiment.

FIG. 37 is a diagram illustrating the result of a current density simulation performed on the antenna device 800 according to the eighth embodiment. FIG. 37 illustrates current density on the front surface 5A side of the printed circuit board 5.

The simulation result represents a state where power is supplied to the feed section 111 but not to the feed section 121. In other words, FIG. 37 illustrates current density in a state where communication is performed with the diversity antenna device 800 using the antenna element 110.

Current density is represented by the density of dots. That is, it is illustrated that places where dot density is higher have higher current density and, conversely, places where dot density is lower have lower current density.

As illustrated in FIG. 37, it is found that current density is high at the antenna element 110 and at portions of the ground section 130 which are near the feed section 111. In addition, it is found that current density is high around the slit section 131 and low around the right-side slit section 132.

Accordingly, it is found that current may be efficiently collected around one of the antenna elements 110 and one of the slit sections 131 and that communication may be efficiently performed. In addition, it is found that, in a diversity antenna including two antenna elements 110 and 120, the mutual coupling between the antenna elements has been reduced.

The antenna device 800 according to the eighth embodiment has a structure in which the ground section 130 on the front surface 5A side and the ground section 730 on the rear surface side of the printed circuit board 5 have been shifted by 10 mm and stub sections 850 and 650 have been formed on both ground sections 130 and 730.

As described above, according to the eighth embodiment, a diversity antenna device 800 may be provided which features low return loss, favorable radiation characteristics, a low mutual coupling between the antenna elements 110 and 120, and an extremely low correlation between the antenna elements 110 and 120.

Moreover, the usable frequency of the antenna device 800 may be adjusted by varying the dimensions of the slit sections 131, 132, 731, and 732, the dimensions of the antenna elements 110 and 120, or the capacitances of the chip capacitors 141 and 142. Even when the usable frequency is changed, favorable characteristics such as those described above may be achieved by forming a pair of the slit sections 131 and 132 at the ground section 130 and forming a pair of the slit sections 731 and 732 at the ground section 730 on the rear surface 5B side as described above.

Moreover, a calculation of the efficiency of the antenna device 800 according to the eighth embodiment resulted in a value of 94%.

Figures 38A, 38B, 38C:
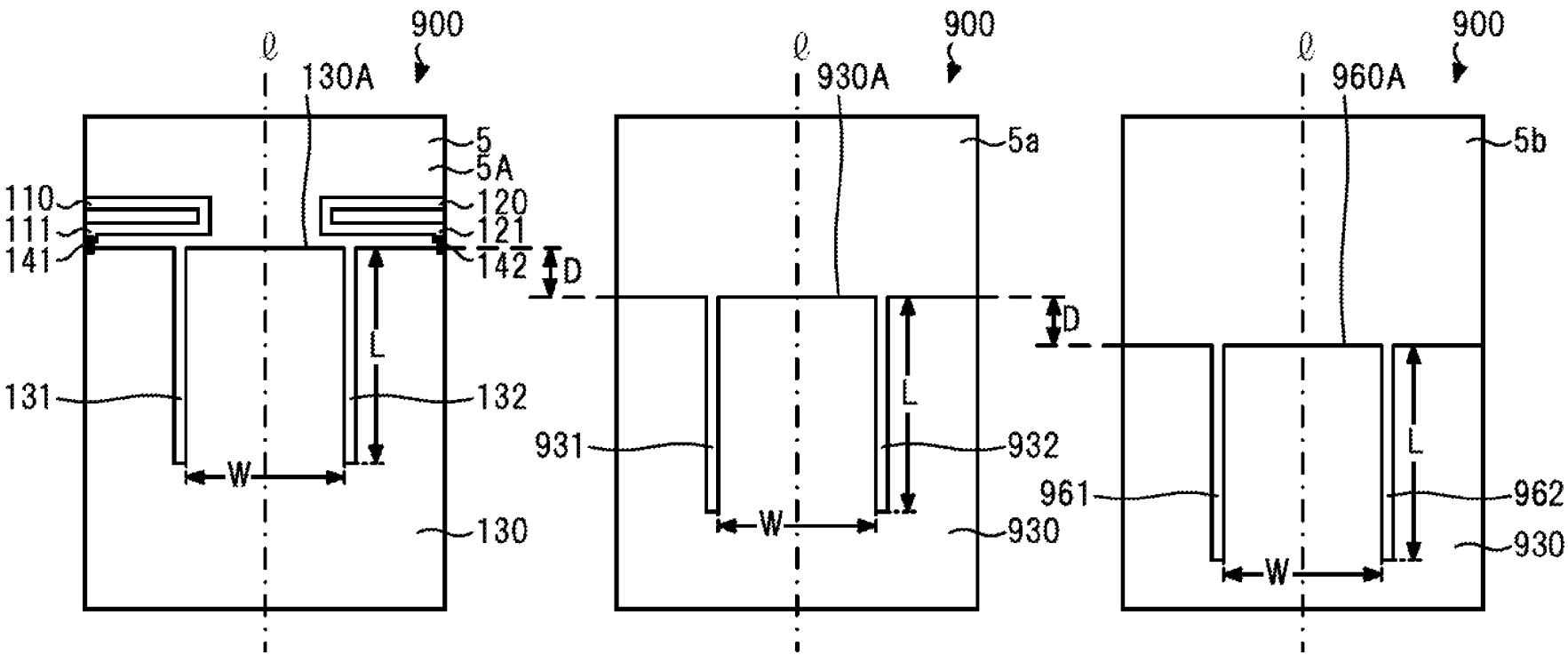

FIGS. 38A-C are diagrams illustrating an antenna device 900 according to a ninth embodiment, wherein FIG. 38A is a diagram illustrating the front surface 5A side of the printed circuit board 5, FIG. 38B is a diagram illustrating a ground section 930 formed between layers of the printed circuit board 5, and FIG. 38C is a diagram illustrating a ground section 960 formed between different layers of the printed circuit board 5 from those in FIG. 38B.

FIG. 38B and FIG. 38C are presented with positions thereof aligned with the front surface 5A of the printed circuit board 5, and both illustrate states as seen from the front surface 5A side of the printed circuit board 5. Moreover, the symmetrical axes I illustrated in FIGS. 38A to 38C are all substantially the same axis.

The antenna device 900 according to the ninth embodiment includes, in addition to the ground section 130 formed on the front surface 5A of the printed circuit board 5, two ground sections 930 and 960 formed between layers. The ground sections 930 and 960 are additional ground sections respectively formed on copper foil between different layers, and are electrically connected to the ground section on the front surface 5A via holes. The ground section 960 is formed between layers downward from the ground section 930.

As illustrated in FIG. 38B, the ground section 930 includes slit sections 931 and 932 arranged so as to be axisymmetrical with respect to a symmetrical axis in substantially the same manner as the slit sections 131 and 132 of the ground section 130. Dimensions of the slit sections 931 and 932 are substantially the same as the dimensions of the slit sections 131 and 132, with lengths L of 26 mm in the direction of the symmetrical axis I and a distance W of 12 mm between the slit sections 931 and 932. In addition, the widths of the slit sections 931 and 932 are 1 mm.

As illustrated in FIG. 38A and FIG. 38B, an upper-side end section 930A of the ground section 930 in the direction of the symmetrical axis I is shifted by a distance D with respect to the end section 130A on the side of the ground section 130 near the antenna elements 110 and 120. In the ninth embodiment, the distance D is set to 5 mm.

In other words, the ground section 930 is displaced downward as seen in the diagram by the distance D (5 mm) in the direction of the symmetrical axis I with respect to the ground section 130 on the front surface 5A side.

Therefore, while the lateral (left-right direction in the diagram) positions as seen in a plan view of the slit section 931 and the slit section 131 are consistent with each other, their positions in the direction of the symmetrical axis I have been shifted by the distance D (5 mm).

In addition, similarly, while the lateral (left-right direction in the diagram) positions as seen in a plan view of the slit section 932 and the slit section 132 are consistent with each other, their positions in the direction of the symmetrical axis I have been shifted by the distance D (5 mm).

Furthermore, as illustrated in FIG. 38C, the ground section 960 includes slit sections 961 and 962 arranged so as to be axisymmetrical with respect to a symmetrical axis in substantially the same manner as the slit sections 131 and 132 of the ground section 130. Dimensions of the slit sections 961 and 962 are substantially the same as the dimensions of the slit sections 131 and 132, with lengths L of 26 mm in the direction of the symmetrical axis I and a distance W of 12 mm between the slit sections 961 and 962. In addition, the widths of the slit sections 961 and 962 are 1 mm.

As illustrated in FIGS. 38B and 38C, the upper-side end section 960A of the ground section 960 in the direction of the symmetrical axis I is shifted by a distance D with respect to the end section 930A of the ground section 930. In the ninth embodiment, the distance D is set to 5 mm.

In other words, the ground section 960 is displaced downward as seen in the diagram by the distance D (5 mm) in the direction of the symmetrical axis I with respect to the ground section 930.

Therefore, while the lateral (left-right direction in the diagram) positions as seen in a plan view of the slit section 961 and the slit section 931 are consistent with each other, their positions in the direction of the symmetrical axis I have been shifted by the distance D (5 mm).

In addition, similarly, while the lateral (left-right direction in the diagram) positions as seen in a plan view of the slit section 962 and the slit section 932 are consistent with each other, their positions in the direction of the symmetrical axis I have been shifted by the distance D (5 mm).

Therefore, while the lateral (left-right direction in the diagram) positions as seen in a plan view of the slit sections 131, 931, and 961 are consistent with each other, their positions in the direction of the symmetrical axis I have been respectively shifted by the distance D (5 mm).

In addition, similarly, while the lateral (left-right direction in the diagram) positions as seen in a plan view of the slit sections 132, 932, and 962 are consistent with each other, their positions in the direction of the symmetrical axis I have been respectively shifted by the distance D (5 mm).

As illustrated, even with the antenna device 900 in which two ground sections 930 and 960 formed between layers are connected to the ground section 130 formed on the front surface 5A of the printed circuit board 5, in substantially the same manner as the antenna device 500 according to the fifth embodiment, a diversity antenna device 900 may be provided which features low return loss, favorable radiation characteristics, a low mutual coupling between the antenna elements 110 and 120, and an extremely low correlation between the antenna elements 110 and 120.

While a configuration has been described in which the ground section 960 is shifted downward as seen in the diagram in the direction of the symmetrical axis I with respect to the ground section 930, the positions of the end section 960A of the ground section 960 and the end section 930A of the ground section 930 may alternatively be coincident.

In addition, while a configuration in which two ground sections 930 and 960 are attached to the ground section on the front surface 5A has been described above, the number of ground sections to be attached may be set to a value of three or more.

Furthermore, as is the case with the second, sixth, seventh, and eighth embodiments, a stub section may be formed on any of the ground sections. Moreover, a stretched section may be provided on the antenna elements 110 and 120 as is the case with the third embodiment.

In addition, while configurations have been described above in which the ground sections 930 and 960 are formed between layers of the printed circuit board 5, the ground sections 930 and 960 may instead be formed on a different circuit board from the printed circuit board 5 as long as the positional relationship of the ground sections 930, 960 and the ground section 130 as seen in a plan view does not differ from the positional relationship thereof in the case where the ground sections 930 and 960 are formed between layers.

According to the disclosed antenna device, it is now possible to provide an antenna device that includes a pair of slit sections formed axisymmetrically with respect to a ground section so as to reduce the mutual coupling and correlation coefficients between antenna elements, a printed circuit board including the antenna device, and a wireless communication device including the antenna device.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a illustrating of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. An antenna device comprising:

a substrate;

a pair of antenna elements formed on a face of the substrate, the antenna elements having different feed sections respectively, and the antenna elements being arranged so as to be axisymmetrical to each other with respect to a symmetrical axis; and a ground section formed on the face of the substrate on which the pair of antenna elements is formed and which is arranged proximal to the pair of antenna elements, wherein the ground section is arranged so as to be axisymmetrical with respect to the symmetrical axis, and the ground section includes a first pair of slit sections notched from an end section and extending in one direction of the symmetrical axis.

2. The antenna device according to claim 1, wherein the ground section further includes additional one or more pairs of slit sections arranged so as to be axisymmetrical with respect to the symmetrical axis and which is notched from an end section and extending in the one direction of the symmetrical axis.

3. The antenna device according to claim 1, further comprising an additional ground section formed either on another face of the substrate or on a face of another substrate, the additional ground section having a pair of slit sections with substantially the same shape as the first pair of slit sections at substantially the same position in a width direction that is perpendicular to the symmetrical axis, and arranged inside an area in which the ground section is arranged as seen in a plan view.

4. The antenna device according to claim 3, wherein the additional ground section is offset from the ground section in a direction of the symmetrical axis and away from the antenna elements.

5. The antenna device according to claim 3, wherein at least one of the ground section and the additional ground section includes a stub section arranged along the symmetrical axis and which extends from an end section in another direction of the symmetrical axis.

6. The antenna device according to claim 1, wherein the end section from which the slit sections extend is the end section of the ground section closest to the pair of antenna elements.

7. The antenna device according to claim 1, wherein notches beginning the slit sections from which the slit sections extend are arranged on the end section of the ground section that is closest to the pair of antenna elements.

8. The antenna device according to claim 1, wherein the antenna elements respectively include portions stretching along an edge of the end section so as to make a meander shape.

9. An antenna device comprising:

a substrate;

a pair of antenna elements formed on a face of the substrate and which is arranged so as to be axisymmetrical with respect to a symmetrical axis; and a ground section formed on the face of the substrate on which the pair of antenna elements is formed and which is arranged proximal to the pair of antenna elements, wherein the ground section is arranged so as to be axisymmetrical with respect to the symmetrical axis, and the ground section includes a first pair of slit sections notched from an end section and extending in one direction of the symmetrical axis, wherein the ground section includes a stub section arranged along the symmetrical axis and which extends from the end section and extending in another direction of the symmetrical axis.

10. An antenna device comprising:

a substrate;

a pair of antenna elements formed on a face of the substrate and which is arranged so as to be axisymmetrical with respect to a symmetrical axis; and a ground section formed on the face of the substrate on which the pair of antenna elements is formed and which is arranged proximal to the pair of antenna elements, wherein the ground section is arranged so as to be axisymmetrical with respect to the symmetrical axis, and the ground section includes a first pair of slit sections notched from an end section and extending in one direction of the symmetrical axis, wherein the antenna elements include, on an end section opposite to an end section proximal to the ground section, stretched sections for stretching the antenna elements away from the end section proximal to the ground section.

11. An antenna device comprising:

a substrate;

a pair of antenna elements formed on a face of the substrate and which is arranged so as to be axisymmetrical with respect to a symmetrical axis; and a ground section formed on the face of the substrate on which the pair of antenna elements is formed and which is arranged proximal to the pair of antenna elements, wherein the ground section is arranged so as to be axisymmetrical with respect to the symmetrical axis, and the ground section includes a first pair of slit sections notched from an end section and extending in one direction of the symmetrical axis, wherein the substrate is a substrate in which a plurality of insulating layers are laminated, the antenna device further comprising an additional ground section formed between layers of the substrate, the additional ground section having a pair of slit sections with substantially the same shape as the first pair of slit sections at substantially the same position in a width direction that is substantially perpendicular to the symmetrical axis, and the additional ground section is covered by the ground section.

12. The antenna device according to claim 11, wherein the additional ground section is offset from the ground section in a direction of the symmetrical axis and away from the antenna elements.

13. The antenna device according to claim 11, wherein at least one of the ground section and the additional ground section includes a stub section arranged along the symmetrical axis and which extends from an end section proximal to the antenna elements in another direction of the symmetrical axis.

14. A printed circuit board comprising:

a processing circuit to process transmission signals; and an antenna device to transmit the transmission signals, the antenna device including:

a substrate;

a pair of antenna elements formed on a face of the substrate, the antenna elements having different feed sections respectively, and the antenna elements being arranged so as to be axisymmetrical to each other with respect to a symmetrical axis; and a ground section formed on the face of the substrate on which the pair of antenna elements is formed and which is arranged proximal to the pair of antenna elements, wherein the ground section is arranged so as to be axisymmetrical with respect to the symmetrical axis, and the ground section includes a first pair of slit sections notched from an end section and extending in a direction of the symmetrical axis.

15. The printed circuit board according to claim 14, wherein the end section from which the slit sections extend is the end section of the ground section closest to the pair of antenna elements.

16. The printed circuit board according to claim 14, wherein notches beginning the slit sections from which the slit sections extend are arranged on the end section of the ground section that is closest to the pair of antenna elements.

17. The printed circuit board according to claim 14, wherein the antenna elements respectively include portions stretching along an edge of the end section so as to make a meander shape.

18. A printed circuit board comprising:

a processing circuit to process transmission signals; and an antenna device to transmit the transmission signals, the antenna device including:

a substrate;

a pair of antenna elements formed on a face of the substrate and which is arranged so as to be axisymmetrical with respect to a symmetrical axis; and a ground section formed on the face of the substrate on which the pair of antenna elements is formed and which is arranged proximal to the pair of antenna elements, wherein the ground section is arranged so as to be axisymmetrical with respect to the symmetrical axis, and the ground section includes a first pair of slit sections notched from an end section and extending in a direction of the symmetrical axis, wherein the ground section includes a stub section arranged along the symmetrical axis and which extends from the end section in another direction of the symmetrical axis.

19. A wireless communication device comprising:

a processing circuit to process transmission signals; and an antenna device to transmit the transmission signals, the antenna device including:

a substrate;

a pair of antenna elements formed on a face of the substrate, the antenna elements having different feed sections respectively, and the antenna elements being arranged so as to be axisymmetrical to each other with respect to a symmetrical axis; and a ground section formed on the face of the substrate on which the pair of antenna elements is formed and which is arranged proximal to the pair of antenna elements, wherein the ground section is arranged so as to be axisymmetrical with respect to the symmetrical axis, and the ground section includes a first pair of slit sections notched from an end section and extending in a direction of the symmetrical axis.

20. The wireless communication device according to claim 19, wherein the end section from which the slit sections extend is the end section of the ground section closest to the pair of antenna elements.

21. The wireless communication device according to claim 19, wherein notches beginning the slit sections from which the slit sections extend are arranged on the end section of the ground section that is closest to the pair of antenna elements.

22. The wireless communication device according to claim 19, wherein the antenna elements respectively include portions stretching along an edge of the end section so as to make a meander shape.

23. A wireless communication device comprising:

a processing circuit to process transmission signals; and an antenna device to transmit the transmission signals, the antenna device including:

a substrate;

a pair of antenna elements formed on a face of the substrate and which is arranged so as to be axisymmetrical with respect to a symmetrical axis; and a ground section formed on the face of the substrate on which the pair of antenna elements is formed and which is arranged proximal to the pair of antenna elements, wherein the ground section is arranged so as to be axisymmetrical with respect to the symmetrical axis, and the ground section includes a first pair of slit sections notched from an end section and extending in a direction of the symmetrical axis, wherein the ground section includes a stub section arranged along the symmetrical axis and which extends from the end section in another direction of the symmetrical axis.

* * * * *